US006579020B2

(12) United States Patent
Jørgensen et al.

(10) Patent No.: US 6,579,020 B2
(45) Date of Patent: Jun. 17, 2003

(54) THERMAL PRINTER

(75) Inventors: Christian Jørgensen, Greve (DK); Torben Svensson, Rødovre (DK); Kristian Vang Jørgensen, Søborg (DK); Ernst R. Thorsager Olesen, Jystrup (DK); Tim Nielsen, Slagelse (DK)

(73) Assignee: Easyprint A/S, Karlslunde (DK)

( * ) Notice: Subject to any disclaimer, the term of this patent is extended or adjusted under 35 U.S.C. 154(b) by 0 days.

(21) Appl. No.: 10/127,699

(22) Filed: Apr. 23, 2002

(65) Prior Publication Data

US 2002/0154932 A1 Oct. 24, 2002

Related U.S. Application Data

(63) Continuation-in-part of application No. 09/950,924, filed on Sep. 13, 2001, which is a continuation-in-part of application No. 09/264,023, filed on Mar. 8, 1999, now Pat. No. 6,354,753, which is a continuation of application No. PCT/DK99/00017, filed on Jan. 12, 1999, which is a continuation-in-part of application No. 09/120,335, filed on Jul. 22, 1998, now abandoned.

(30) Foreign Application Priority Data

Jan. 12, 1998 (DK) ..... 1998 00038
Nov. 6, 1998 (DK) ..... 1998 01443

(51) Int. Cl.[7] ..... B41J 2/325

(52) U.S. Cl. ..... 400/120.01; 400/120.16; 400/232

(58) Field of Search ..... 400/120.16, 120.01, 400/213, 217, 218, 231, 232; 347/215, 217

(56) References Cited

U.S. PATENT DOCUMENTS

| | | | | |
|---|---|---|---|---|
| 3,984,809 A | | 10/1976 | Dertouzos et al. | 347/206 |
| 4,642,655 A | | 2/1987 | Sparer et al. | 347/178 |
| 4,650,350 A | | 3/1987 | Dorner | 400/120.01 |
| 4,712,115 A | | 12/1987 | Tatsumi et al. | 347/217 |
| 4,952,085 A | | 8/1990 | Rein | 400/120.07 |
| 5,017,943 A | | 5/1991 | Ogita et al. | 347/176 |
| 5,121,136 A | | 6/1992 | Kawakubo | 347/215 |
| 5,160,943 A | | 11/1992 | Pettigrew et al. | 347/215 |
| 5,162,815 A | | 11/1992 | Hodge | 347/217 |
| 5,297,879 A | | 3/1994 | Oikawa | 400/234 |
| 5,344,248 A | * | 9/1994 | Schoon et al. | 400/693 |
| 5,357,270 A | | 10/1994 | Herbert | 347/215 |
| 5,372,439 A | | 12/1994 | Poole et al. | 400/232 |
| 5,383,732 A | | 1/1995 | Berson et al. | 400/120.01 |
| 5,415,482 A | | 5/1995 | Poole et al. | 400/248 |
| 5,576,751 A | | 11/1996 | Wada et al. | 347/217 |
| 5,609,425 A | | 3/1997 | Kawano et al. | 400/120.01 |
| 5,647,679 A | | 7/1997 | Green et al. | 400/232 |
| 6,354,753 B1 | | 3/2002 | Jorgensen et al. | 400/120.01 |
| 2002/0031387 A1 | | 3/2002 | Jorgensen et al. | 400/120.01 |
| 2002/0154932 A1 | | 10/2002 | Jorgensen et al. | 400/120.01 |

FOREIGN PATENT DOCUMENTS

| | | |
|---|---|---|
| EP | 0 157 096 | 10/1985 |
| EP | 0 176 009 | 4/1986 |
| EP | 0 294 633 | 12/1988 |
| JP | 63-165169 | 7/1988 |
| JP | 62-58917 | 9/1994 |

* cited by examiner

*Primary Examiner*—Andrew H. Hirshfeld
*Assistant Examiner*—Minh Chau
(74) *Attorney, Agent, or Firm*—Jacobson Holman PLLC

(57) ABSTRACT

A thermal printer for producing a printing on the surface of a foil in an ink transfer operation. The thermal transfer ribbon is moved relative to an energizable printing device along a specific direction of motion for causing the ink of the thermal transfer ribbon to be transferred at the specific locations to the foil at specific areas thereof constituting the printing so as to smear the ink of the thermal transfer ribbon at the specific locations onto the foil through the motion of the thermal transfer ribbon relative to the foil.

15 Claims, 35 Drawing Sheets

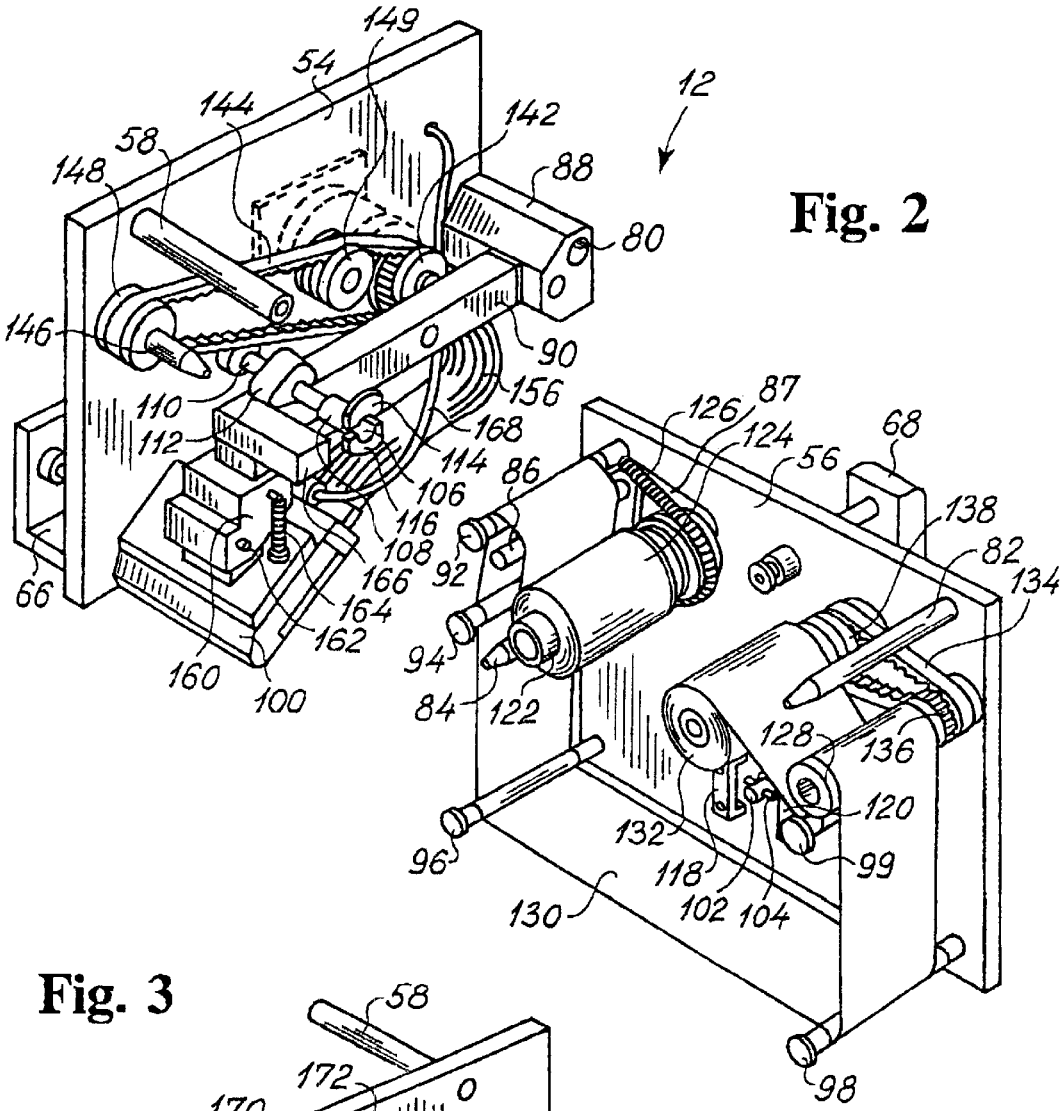
Fig. 2
Fig. 3
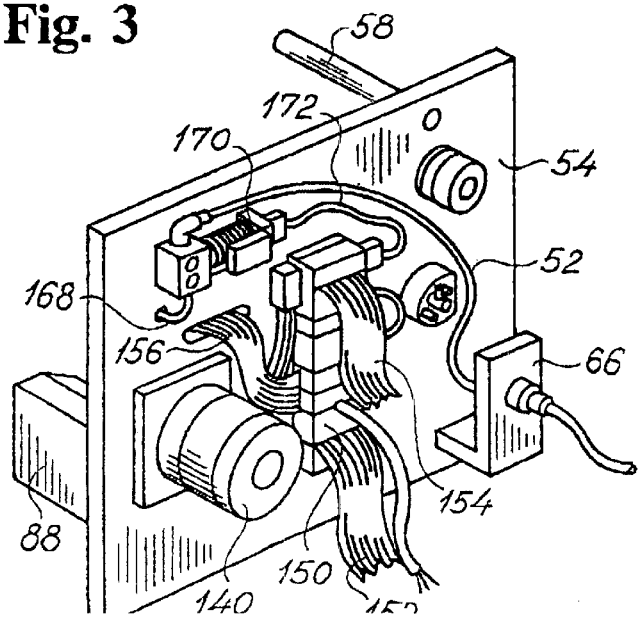

Fig. 5c
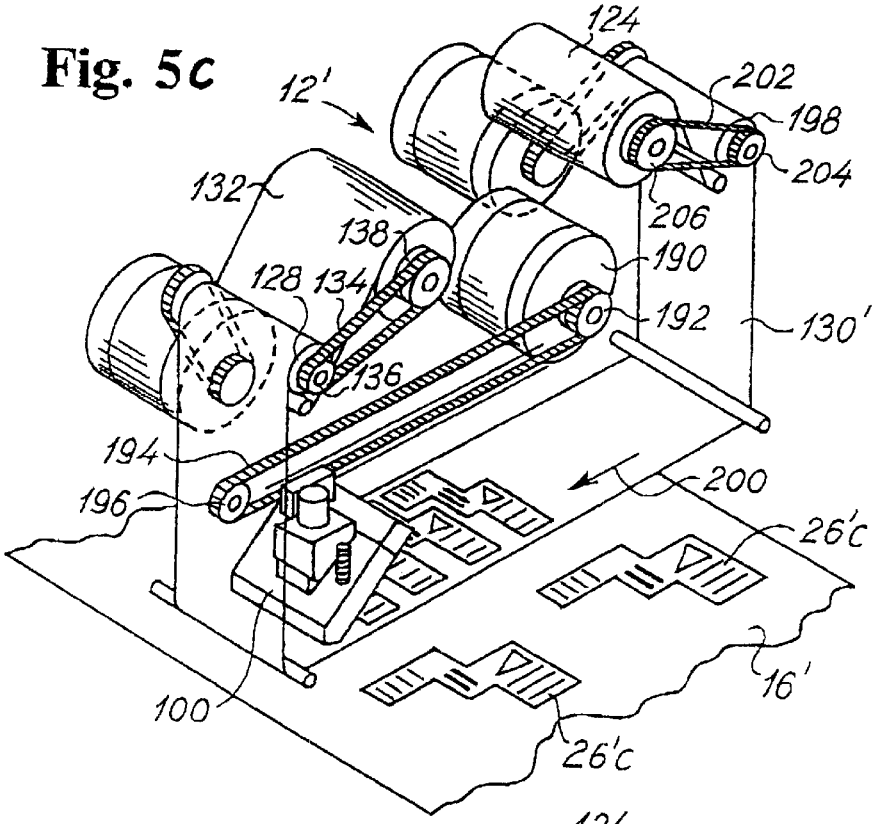
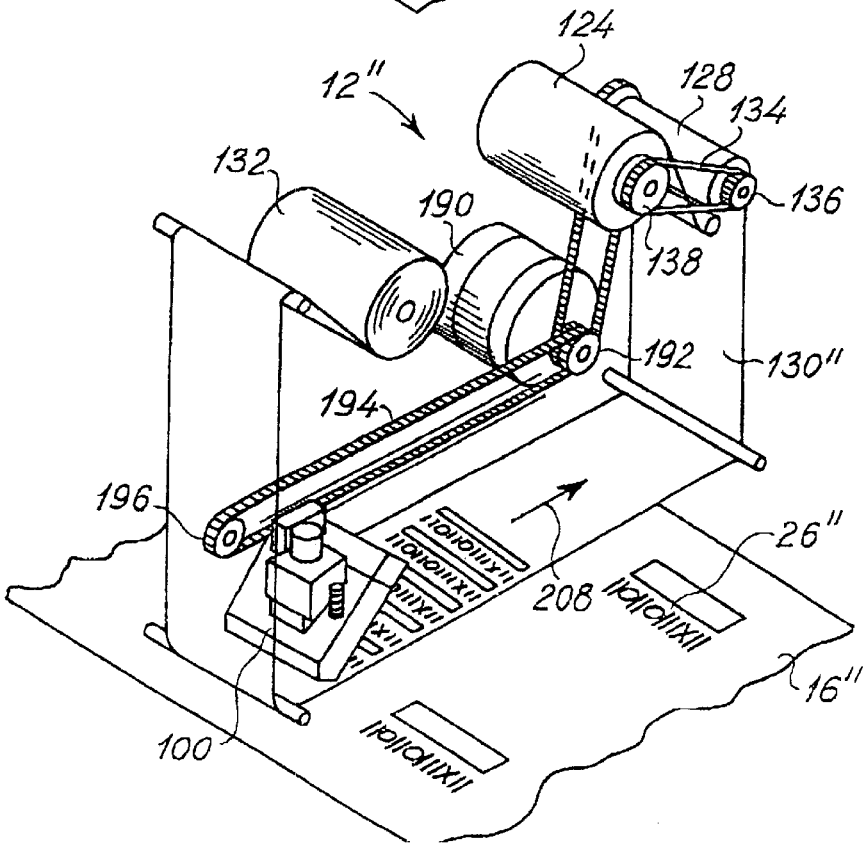
Fig. 6

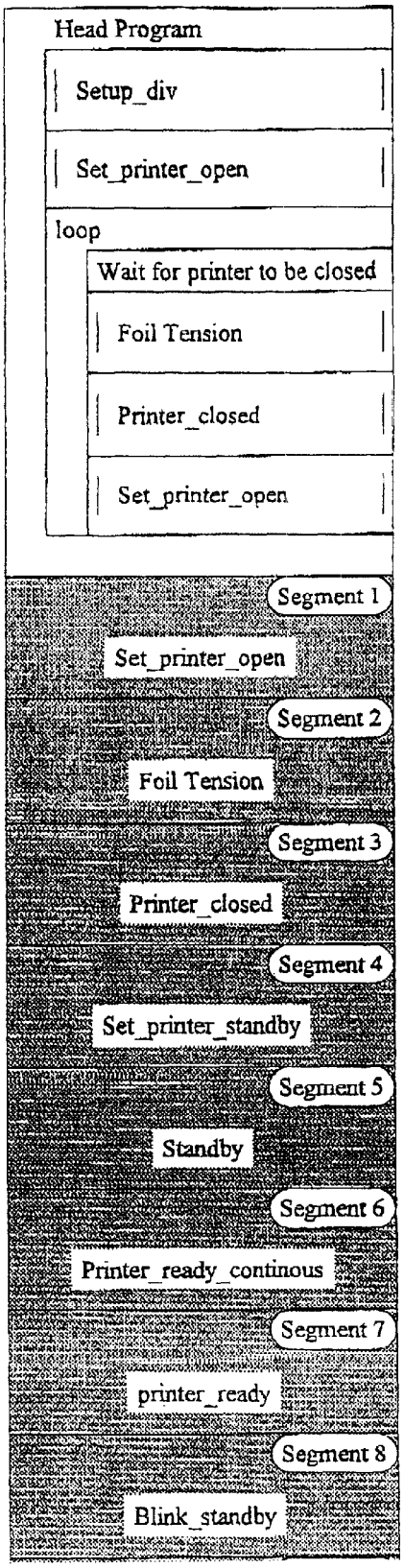
Fig. 9a
Fig. 9b
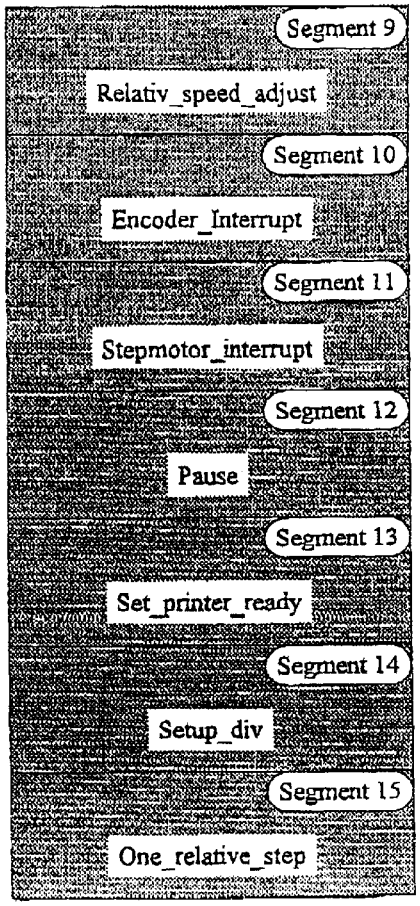

Segment 1

Set_printer_open

Segment 2

Foil Tension

Segment 3

Printer_closed

Segment 6

Printer_ready_continous printer_ready

Segment 11

Stepmotor_interrupt

```
procedure  Stepmotor_interrupt
    Clr step int flag
    if  Step_dir = 1
    then                                  else
    Step_pos = step_pos + Speed | Step_pos = step_pos - Speed
    Write step_pos til stepdrv.
```

Fig. 9m

Fig. 9n

Segment 12

Pause

```
procedure  Pause
    Setup timer0 (16 bit counter)
    TH0 = F8H, TL0 = 30H
    start timer0
    repeat  repeat
            until  TF0
            Clr TF0
            TH0 = F8H, TL0 = 30H
            Dec mSekunt
    until  mSekunt = 0
```

Fig. 9o

Segment 13

Set_printer_ready

```
procedure  Set_printer_ready
    Lift printhead
    Enable signal = on (printer ready to print)
    Enable encoder int
    Turn on power to printhead
    Clr Printing_on
```

Fig. 9p

Segment 14

Setup_div

```
procedure  Setup_div
    Setup display
    Read Relative Speed from EEprom
```

Fig. 9q

Segment 15

One_relative_step

```
procedure  One_relative_step
    Step_pos = Step_pos + Relativ_Speed
    Write step_pos to stepmotor driver
```

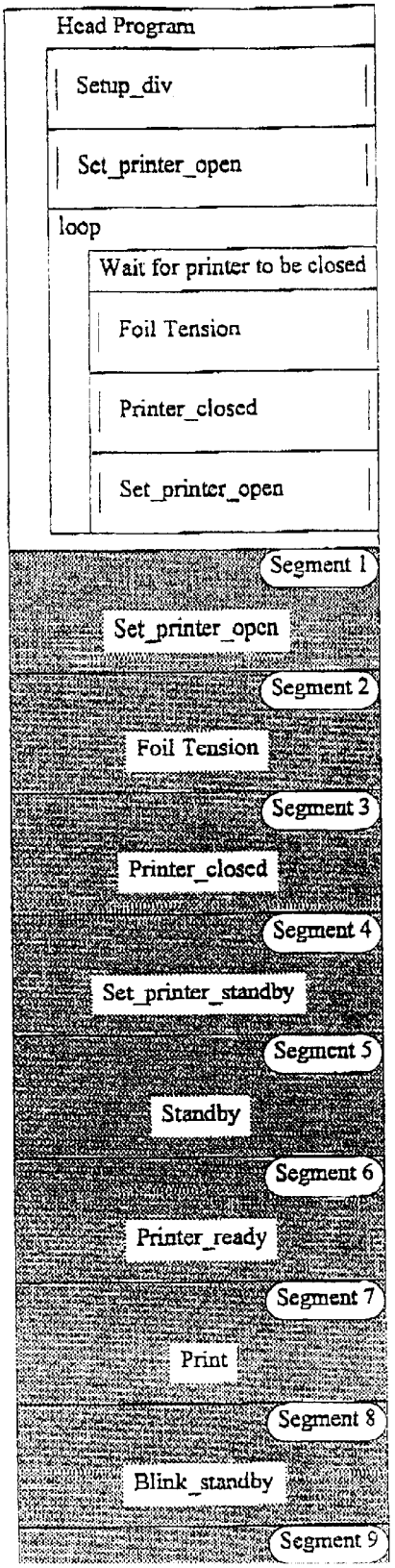
Fig. 10a
Fig. 10b
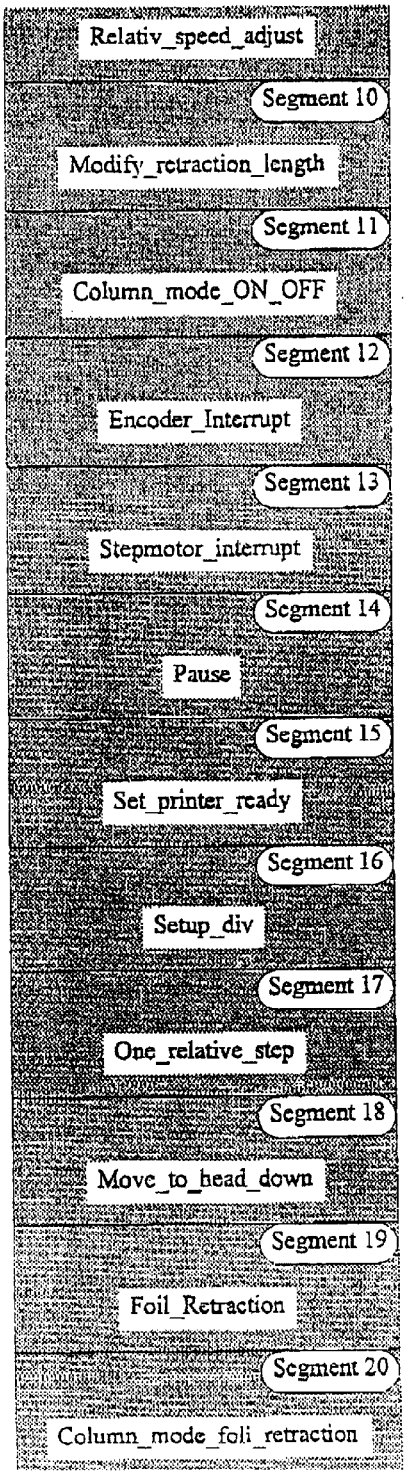

Fig. 10c

Segment 1

Set_printer_open

| procedure Set_printer_open |
|---|
| clear display |
| Write "printer open" |
| Enable signal = off (printer not ready to print) |
| Turn off stepmotor |
| Turn on open lamp |
| Foilwarning signal = off (No warning) |
| Turn off standby lamp |
| Turn off error lamp |
| Turn OFF power to printhead |
| Take head up |

Fig. 10d

Segment 2

Foil Tension

| procedure Foil_tension |
|---|
| Clr backward |
| Clear Display |
| Write "Foil tension" |
| Start stepmotor |
| Wait 750mS |
| Stop stepmotor |

Fig. 10e

Segment 3

Printer_closed

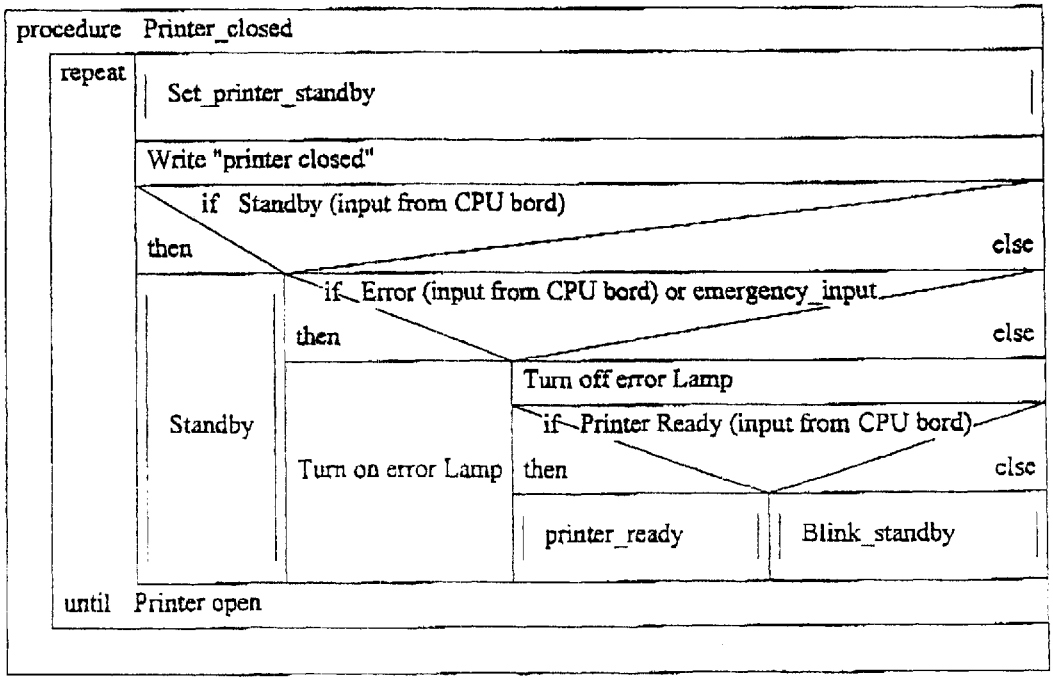

Printer_ready

Segment 6

Print

Segment 11

Column_mode_ON_OFF

Segment 13

Stepmotor_interrupt

Segment 15

Set_printer_ready

Segment 14

Pause

Segment 16

Setup_div

Fig. 10s

Segment 17

One_relative_step

```
procedure  One_relative_step
    Step_pos = Step_pos + Relativ_Speed
    Write step_pos to stepmotor driver
```

Fig. 10t

Segment 18

Move_to_head_down

```
procedure  Move_to_head_down
    repeat  Set val_clk
            wait 0.8 mSek
            clr val_clk
            wait 0.8 mSek
    until   Head_signal = down
```

Fig. 10u

Foil_Retraction

Segment 19

```
procedure  Foil_Retraction
    Number_of_step = (Retraction_length_mm * 41040) / backward_speed
    set backward
    start stepmotor int.
    repeat
    until  (stepmotor int is stopped) or (printer_open)
    clr backward
```

Fig. 10v

Segment 20

Column_mode_foli_retraction

```
procedure  Column_mode_foli_retraction
    Number_of_step = (column_length * backward_speed) / Relativ_Speed
    set backward
    start stepmotor int.
    repeat
    until  (stepmotor int is stopped) or (printer_open)
    column_length = 0
    clr backward
```

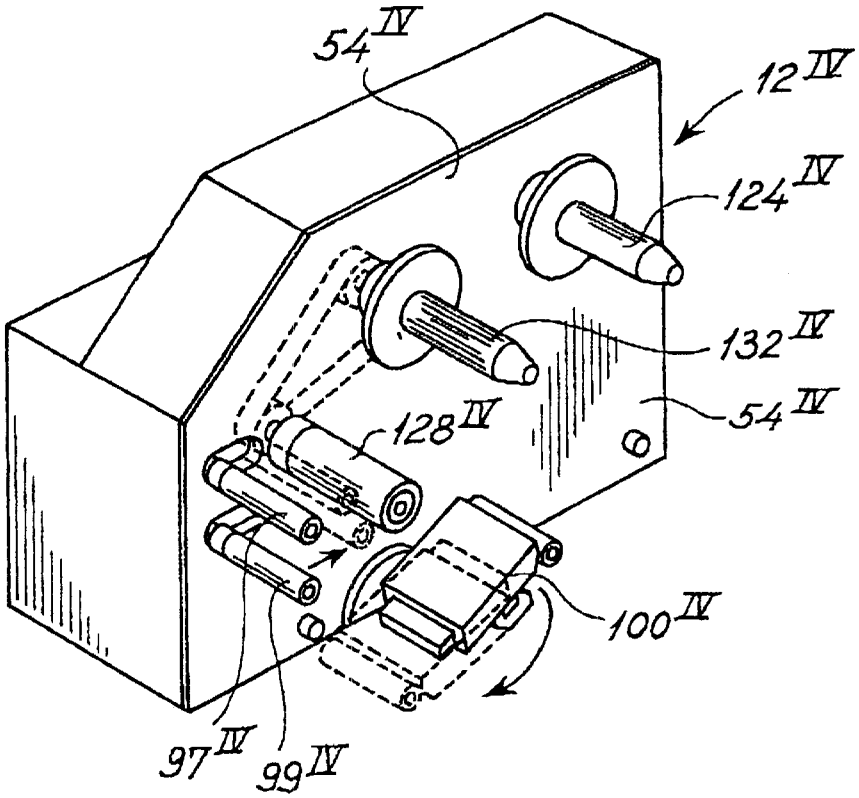
Fig. 15
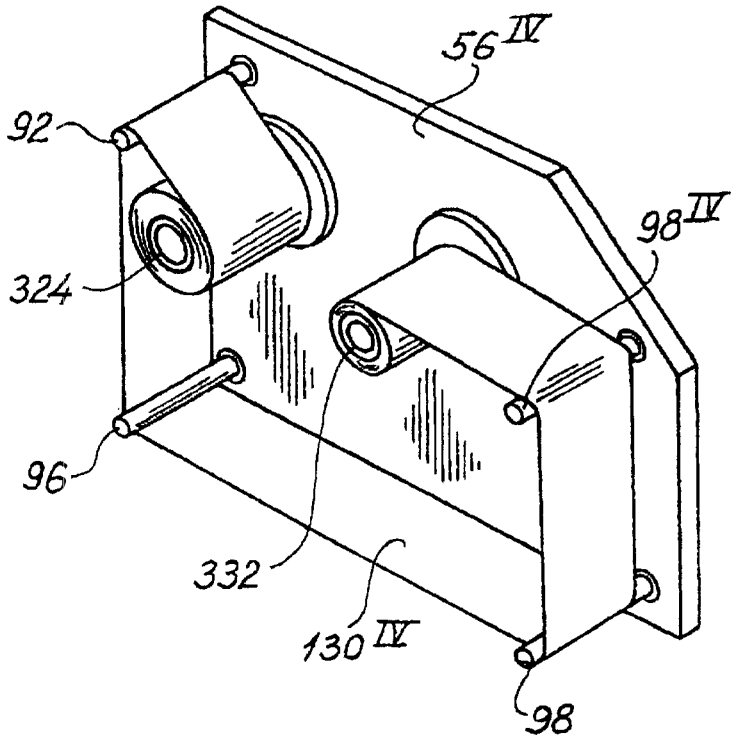

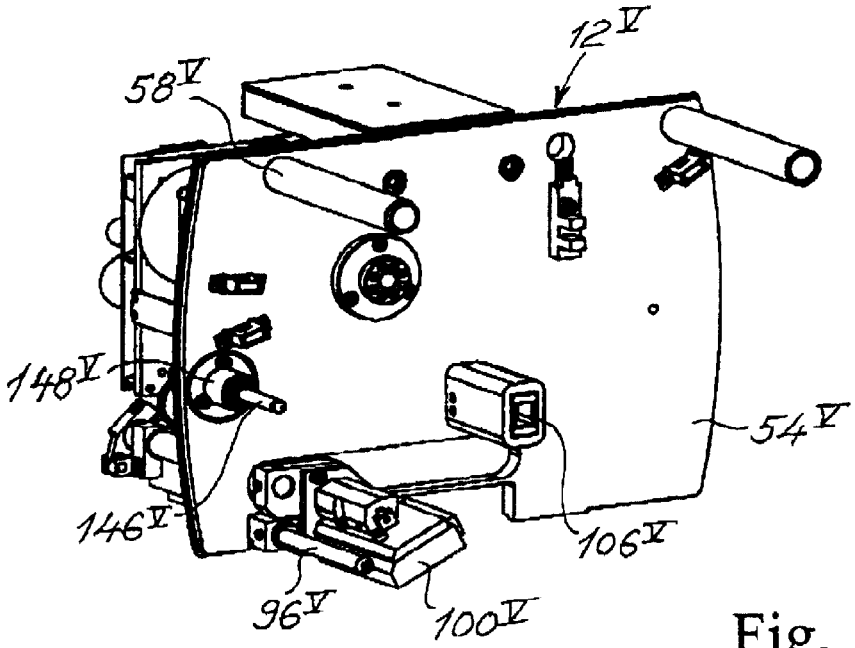
Fig. 17
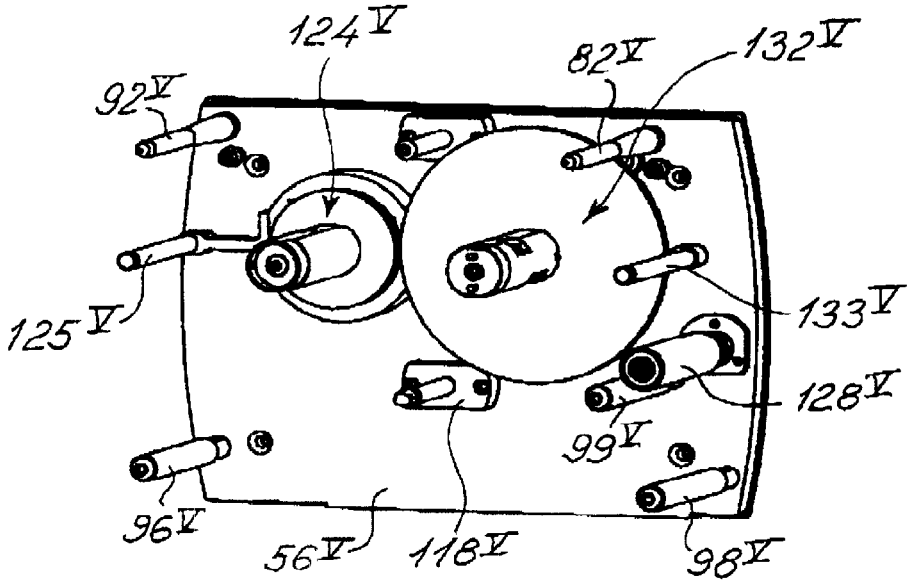

THERMAL PRINTER

This is a continuation-in-part application of U.S. application Ser. No. 09/950,924 filed on Sep. 13, 2001, which is a continuation-in-part of U.S. application Ser. No. 09/264,023, now U.S. Pat. No. 6,354,753, filed Mar. 8, 1999, which is a continuing application of International Application No. PCT/DK99/00017, filed Jan. 12, 1999, which claims priority from Denmark Appln. No. PA 1998 00038, filed Jan. 12, 1998 and Denmark Appln. No. PA 1998 01443, filed Nov. 6, 1998, and which was published in English and which, in turn, is a continuation-in-part of U.S. application Ser. No. 09/120,335, filed Jul. 22, 1998, claiming priority from Denmark Appln. No. 038/98, filed Jan. 12, 1998 and is now abandoned.

FIELD OF THE INVENTION

The present invention relates generally to the technique of producing a printing on a foil by means of a thermal transfer ribbon in an ink transfer operation.

The present invention relates in particular to the technique of producing a printing on a foil in a thermal printing operation during a packaging operation in which the foil is used as a packaging foil or as an information foil sheet to be applied to or below a wrap around or packaging foil for packaging a product being an organic or inorganic product. The examples of products relevant in the present context are unlimited ranging from toys, cosmetics, consumer products, foodstuffs, drugs etc. In general, any product which is to be packed in a foil or to be applied with an information printing after the product has been included in a separate package may be relevant in the present context. The invention in general relates to high speed printing and packaging operations in which the foil on which the printing is to be applied is moved at a speed up to several hundred millimeters per second.

BACKGROUND OF THE INVENTION

It is known to print continuous packaging materials constituting foil materials and other continuous printing media such as paper materials for producing labels with alfanumeric information and symbols, information, logos etc. while using a thermal printing or thermal transfer technique. According to the thermal transfer technique, a thermal transfer ribbon including an ink is heated at specific locations to an elevated temperature causing the ink to be fluid and at the same time, the thermal transfer ribbon is contacted with the print media such as the foil or paper material in question for causing the transfer of the fluid ink to the foil material or paper material. In the ink transfer operation, the thermal transfer ribbon is moved in synchronism with the print media or foil to which the printing is to be applied and the amount of thermal transfer ribbon material which is used in a high speed printing and packaging operation performed at a speed of several hundred millimeters per second may, as will be readily understood, be extremely high as the thermal transfer ribbon is also moved at the same high speed as the foil material amount to a speed of transportation of the order of several hundred metres per second.

Examples of prior art thermal printers of the above kind are described in EP 0 157 096, EP 0 176 009, EP 0 294 633, U.S. Pat. Nos. 5,297,879, 3,984,809, 4,650,350, 4,642,655, 4,650,350, 4,712,115, 4,952,085, 5,017,943, 5,121,136, 5,160,943, 5,162,815, 5,372,439, 5,415,482, 5,576,751, 5,609,425 and 5,647,679 to which reference is made and which US patents are hereby incorporated in the present specification by reference.

From the technical field of paper recorders, it is known to utilize a thermal transfer ribbon and produce a printing on a piece of paper by sandwiching the thermal transfer ribbon between a printing head or recorder head and the paper sheet on which the printings are to be produced. It is known in paper recorders of this kind to reduce the speed of the thermal transfer ribbon relative to the speed of the paper sheet for saving the amount of thermal transfer ribbon used and consequently obtain a reduction in costs and improve the economical efficiency of the paper recorder. Examples of paper recorders of this type are shown in Japanese patent publication (Kokoku) No. 62-58917), Japanese patent application laying open (Kokai) No. 63-165169, U.S. Pat. Nos. 5,121,136, 5,372,439 and 5,415,482. Reference is made to the above patent applications and patents and the above U.S. patents are hereby incorporated in the present specification by reference.

SUMMARY OF THE INVENTION

An object of the present invention is to provide a novel technique of producing high speed printings on a print media such as a foil allowing substantial material savings as far as the thermal transfer ribbon is concerned without to any substantial extent deteriorating the quality of the printing produced as compared to the prior art thermal printing techniques. It is a further object of the present invention to provide a novel thermal printing technique rendering it possible with a substantial ribbon material saving to establish an even improved printing quality as compared to the prior art thermal printing technique by providing an im-proved utilization of the thermal transfer ribbon material as compared to the utilization of the thermal transfer ribbon material in accordance with the prior art thermal printing technique.

An advantage of the present invention relates to the fact that a thermal transfer ribbon material saving up till 80% may be obtained without to any substantial extent deteriorating the printing quality as compared to the prior art thermal printing technique.

The above objects and the above advantage together with numerous other objects, advantages and features which will be evident from the below detailed description of preferred embodiments of the present invention are in accordance with a first aspect of the present invention obtained by means of a method of producing a printing on a surface of a foil by means of energizable printing means and a thermal transfer ribbon including an ink which is transferable in an ink transfer operation at specific locations of the thermal transfer ribbon by heating the specific locations to an elevated temperature by means of the energizable printing means causing the ink to be fluid, comprising the following steps:

- arranging the thermal transfer ribbon in facial contact with the surface of the foil,
- arranging the energizable printing means in contact with the thermal transfer ribbon opposite to the foil,
- moving the foil and the energizable printing means relative to one another at a specific speed while pressing the energizable printing means and the foil together so as to sandwich the thermal transfer ribbon there-between in a constrained state, and while energizing the energizable printing means, and
- moving the thermal transfer ribbon relative to the energizable printing means at a reduced speed as compared to the specific speed of the foil relative to the energizable printing means and consequently moving the thermal transfer ribbon relative to the foil for causing the ink of the thermal transfer ribbon to be transferred at the specific locations to the foil at specific areas thereof constituting the printing so as to smear the ink of the thermal transfer ribbon at the specific locations onto the foil through the motion of the thermal transfer ribbon relative to the foil.

Contrary to the prior art thermal printing technique in which the thermal transfer ribbon is moved in synchronism with the foil to which the printing is to be applied in the relative motion of the foil relative to the energizable printing means, it has been realized that the speed of motion of the thermal transfer ribbon relative to the energizable printing means may be reduced as compared to the speed of motion of the foil relative to the energizable printing means providing a substantial saving of thermal transfer ribbon material without reducing or deteriorating the quality of the printings produced. According to the prior art thermal transfer printing technique, the ink is transferred from a thermal transfer ribbon in a process of establishing facial contact between the thermal transfer ribbon and the foil during the process of moving the foil without causing any mutual movement between the thermal transfer ribbon and the foil as it has been considered mandatory to the obtaining of a high quality printing that no deviation between the movement of the thermal transfer ribbon and the foil should be allowed which mutual movement inevitably would deteriorate the printing quality. According to the teachings of the present invention, it has been realized that the quality of the printing process is by no means deteriorated provided the thermal transfer ribbon and the foil are moved relative to one another as the ink transfer process is converted from a facial contact transfer process into a combined facial contact transfer process and a smearing process in which the ink is smeared onto the foil from the thermal transfer ribbon. It is believed that the combined facial contact transfer operation and the smearing transfer operation of the ink from the thermal transfer ribbon to the foil provides an increased utilization of the ink content of the thermal transfer ribbon as compared to the prior art exclusive facial contact transfer operation.

The energizable printing means may according to the teachings of the present invention be constituted by any appropriate heating means for causing local heating at specific locations of the thermal transfer ribbon such as a laser, a pin head or preferably and advantageously a printing head including individual energizable printing elements.

According to a first implementation or embodiment of the method according to the first aspect of the present invention, the foil is moved continuously while the energizable printing means are stationary and the thermal transfer ribbon is moved relative to the foil and relative to the energizable printing means while the energizable printing means are heated during the ink transfer operation and kept stationary relative to the energizable printing means while the energizable printing means are not heated.

According to a second implementation or embodiment of the method according to the first aspect of the present invention, the foil is moved continuously while the energizable printing means are stationary and the thermal transfer ribbon is moved relative to the foil and relative to the energizable printing means while the energizable printing means are heated during the ink transfer operation and moved in the reverse direction relative to the energizable printing means while the energizable printing means are not heated so as to utilize an used part of the thermal transfer ribbon in a subsequent ink transfer operation.

According to a third implementation or embodiment of the method according to the first aspect of the present invention, the foil is moved intermittently and kept stationary during the ink transfer operation while the energizable printing means and the thermal transfer ribbon being moved relative to the stationary foil while the energizable printing means are heated during the ink transfer operation and moved in the reverse direction relative to the energizable printing means while the energizable printing means are not heated so as to utilize an unused part of the thermal transfer ribbon in a subsequent ink transfer operation.

According to a particular aspect of the present invention as far as the thermal transfer ribbon saving aspect is concerned, it has been realized that in numerous instances and in particular in printing on packages, packaging foils or the like, a substantial thermal transfer ribbon saving may be obtained provided the printings to be produced are slightly re-located from one printing operation to another without changing the geometric configuration of the printing. The above described second and third implementation or embodiment of the method according to the first aspect of the present invention constitute embodiments in the present context to be referred to as "side shift technique" and "retraction technique", respectively, which are to be considered independent aspects of the present invention as will be discussed below.

In accordance with the thermal transfer ribbon saving aspect of the present invention, a specific ink transfer operation is preferably performed utilizing a part of the thermal transfer ribbon not previously used in a preceding ink transfer operation and preferably further, the part of the thermal transfer ribbon used for the specific ink transfer operation being positioned at least partly transversly offset relative to that part of the thermal transfer ribbon used in a preceding ink transfer operation in order to use the maximum amount of the thermal transfer ribbon as compared to a printing technique not involving "side shifting technique" or "retraction technique".

The method according to the first aspect of the present invention may be operated at a high production rate corresponding to a high specific speed of the foil relative to the energizable printing means of the order of 50–1,000 mm/sec, such as of the order of 100–500 mm/sec, preferably of the order of 200–500 mm/sec, while said reduced speed constitutes 20–98%, such as 20–50% or 50–98% of said specific speed or alternatively constitutes 20–30%, 30–40%, 40–50%, 50–60%, 60–70%, 70–80%, 80–90% or 90–98% of said specific speed. Alternatively, the specific speed may be of the order of 100–200 mm/sec, 200–300 mm/sec, 300–400 mm/sec, 400–500 mm/sec, 500–600 mm/sec, 600–700 mm/sec, 700–800 mm/sec, 800–900 mm/sec or 900–1,000 mm/sec, while said reduced speed constitutes 20–30%, 30–40%, 40–50%, 50–60%, 60–70%, 70–80%, 80–90% or 90–98% of said specific speed.

The foil material to which the printing is to be applied may be any appropriate plastics or inorganic or organic material such as a PE or a PVC foil, a woven or non-woven plastic foil or a paper foil, aluminum foil or a combination thereof.

The printing head which according to the presently preferred embodiment of the method according to the first aspect of the present invention constitutes the energizable printing means may preferably include energizable printing elements arranged at a mutual spacing of the order of 0.05 mm–1 mm, such as of the order of 0.1 mm–0.5 mm, preferably approximately 0.1 mm.

The above objects and the above advantage together with numerous other objects, advantages and features which will be evident from the below detailed description of preferred embodiments of the present invention are in accordance with a second aspect of the present invention obtained by means of a method of producing a printing on a surface of a foil by means of energizable printing means and a thermal transfer ribbon including an ink which is transferable in an ink transfer operation at specific locations of the thermal transfer ribbon by heating the specific locations to an elevated temperature by means of the energizable printing means causing the ink to be fluid, comprising the following steps:

arranging the thermal transfer ribbon in facial contact with the surface of the foil, arranging the energizable printing means in contact with the thermal transfer ribbon opposite to the foil, and moving the foil and the energizable printing means relative to one another at a specific speed while pressing the energizable printing means and the foil together so as to sandwich the thermal transfer ribbon there-between in a constrained state, and while energizing the energizable printing means, for causing the ink of the thermal transfer ribbon to be transferred at the specific locations to the foil at specific areas thereof constituting the printing, the foil being moved continuously while the energizable printing means are stationary and the thermal transfer ribbon being moved relative to the energizable printing means while the energizable printing means are heated during the ink transfer operation and moved in the reverse direction relative to the energizable printing means while the energizable printing means are not heated so as to utilize an used part of the thermal transfer ribbon in a subsequent ink transfer operation. The method according to the second aspect of the present invention may advantageously be implemented in accordance with the above described preferred and advantageous implementations or embodiments of the method according to the first aspect of the present invention.

The above objects and the above advantage together with numerous other objects, advantages and features which will be evident from the below detailed description of preferred embodiments of the present invention are in accordance with a third aspect of the present invention obtained by means of a a method of producing a printing on a surface of a foil by means of energizable printing means and a thermal transfer ribbon including an ink which is transferable in an ink transfer operation at specific locations of said thermal transfer ribbon by heating said specific locations to an elevated temperature by means of said energizable printing means causing said ink to be fluid, comprising the following steps:

arranging said thermal transfer ribbon in facial contact with said surface of said foil, arranging said energizable printing means in contact with said thermal transfer ribbon opposite to said foil, and moving said foil and said energizable printing means relative to one another at a specific speed while pressing said energizable printing means and said foil together so as to sandwich said thermal transfer ribbon there-between in a constrained state, and while energizing said energizable printing means, for causing said ink of said thermal transfer ribbon to be transferred at said specific locations to said foil at specific areas thereof constituting said printing said foil being moved continuously while said energizable printing means are stationary and said thermal transfer ribbon being moved relative to said foil and relative to said energizable printing means while said energizable printing means are heated during said ink transfer operation and moved in the reverse direction relative to said energizable printing means while said energizable printing means are not heated so as to utilize an used part of said thermal transfer ribbon in a subsequent ink transfer operation. The method according to the third aspect of the present invention may advantageously be implemented in accordance with the above described preferred and advantageous implementations or embodiments of the method according to the first aspect of the present invention.

The above objects and the above advantage together with numerous other objects, advantages and features which will be evident from the below detailed description of preferred embodiments of the present invention are in accordance with a fourth aspect of the present invention obtained by means of a method of producing a plurality of individual printings on a surface of a foil by means of energizable printing means and a thermal transfer ribbon defining a specific width along a transversal direction thereof and including an ink which is transferable in an ink transfer operation by heating the thermal transfer ribbon at specific locations thereof to an elevated temperature by means of the energizable printing means causing the ink to be fluid, each of the printings defining a maximum dimension along a direction coinciding with the transversal direction constituting no more than 50% of the width, comprising the following steps:

(a) arranging the thermal transfer ribbon in facial contact with the surface of the foil, (b) arranging the energizable printing means in contact with the thermal transfer ribbon opposite to the foil, (c) moving the foil and the energizable printing means relative to one another at a specific speed and moving the thermal transfer ribbon relative to the energizable printing means in the ink transfer operation while pressing the energizable printing means and the foil together so as to sandwich the thermal transfer ribbon there-between in a constrained state, and simultaneously energizing the energizable printing means causing the ink to be transferred to the foil at a first area thereof producing a first printing on the foil at one of the longitudinal edges of the thermal transfer ribbon, (d) relocating the thermal transfer ribbon relative to the energizable printing means while the energizable printing means are not heated so as to utilize an unused part of the thermal transfer ribbon and repeating step (c) to provide a second printing on the foil at the opposite longitudinal edge of the thermal transfer ribbon.

The above objects and the above advantage together with numerous other objects, advantages and features which will be evident from the below detailed description of preferred embodiments of the present invention are in accordance with a fifth aspect of the present invention obtained by means of a thermal printer for producing a printing on the surface of a foil in an ink transfer operation, comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for pressing the energizable printing means and the foil together so as to sandwich the thermal transfer ribbon therebetween in a constrained state, means for moving the foil and the energizable printing means relative to one another at a specific speed while pressing the energizable printing means and the foil together and while energizing the energizable printing means, and means for moving the thermal transfer ribbon relative to the energizable printing means at a reduced speed as compared to the specific speed of the foil relative to the energizable printing means and consequently moving the thermal transfer ribbon relative to the foil for causing the ink of the thermal transfer ribbon to be transferred at the specific locations to the foil at specific areas thereof constituting the printing so as to smear the ink of the thermal transfer ribbon at the specific locations onto the foil through the motion of the thermal transfer ribbon relative to the foil.

The above objects and the above advantage together with numerous other objects, advantages and features which will be evident from the below detailed description of preferred embodiments of the present invention are in accordance with a sixth aspect of the present invention obtained by means of a thermal printer for producing a printing on the surface of a foil in an ink transfer operation, comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for pressing the energizable printing means and the foil together so as to sandwich the thermal transfer ribbon therebetween in a constrained state, means for moving the foil and the energizable printing means relative to one another at a specific speed while pressing the energizable printing means and the foil together and while energizing the energizable printing means, and means for moving the thermal transfer ribbon relative to the energizable printing means at a reduced speed as compared to the specific speed of the foil relative to the energizable printing means and consequent-ly moving the thermal transfer ribbon relative to the foil for causing the ink of the thermal transfer ribbon to be transferred at the specific locations to the foil at specific areas thereof constituting the printing the energizable printing means being stationary and the means for moving the foil and the energizable printing means relative to one another causing the foil to move relative to the energizable printing means in a continuous motion and the means for moving the thermal transfer ribbon relative to the energizable printing means moving the thermal transfer ribbon relative to the energizable printing means at the reduced speed while the energizable printing means are heated during the ink transfer operation and moving the thermal transfer ribbon relative to the energizable printing means in the reverse direction relative to the energizable printing means while the energizable printing means are not heating so as to utilize an unused part of the thermal transfer ribbon in a subsequent ink transfer operation.

The above objects and the above advantage together with numerous other objects, advantages and features which will be evident from the below detailed description of preferred embodiments of the present invention are in accordance with a seventh aspect of the present invention obtained by means of a thermal printer for producing a printing on the surface of a foil in an ink transfer operation, comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for pressing the energizable printing means and the foil together so as to sandwich the thermal transfer ribbon therebetween in a constrained state, means for moving the foil and the energizable printing means relative to one another at a specific speed while pressing the energizable printing means and the foil together and while energizing the energizable printing means, and means for moving the thermal transfer ribbon relative to the energizable printing means at a reduced speed as compared to the specific speed of the foil relative to the energizable printing means and consequently moving the thermal transfer ribbon relative to the foil for causing the ink of the thermal transfer ribbon to be transferred at the specific locations to the foil at specific areas thereof constituting the printing the means for moving the foil and the energizable printing means relative to one another causing the foil to move intermittently and maintaining the foil stationary during the ink transfer operation and causing the energizable printing means to move relative to the stationary foil and the means for moving the thermal transfer ribbon relative to the energizable printing means moving the thermal transfer ribbon relative to the energizable printing means at the reduced speed while the energizable printing means are heated during the ink transfer operation and moving the thermal transfer ribbon in the reverse direction relative to the energizable printing means while the energizable printing means are not heated so as to utilize an unused part of the thermal transfer ribbon in a subsequent ink transfer operation.

The above objects and the above advantage together with numerous other objects, advantages and features which will be evident from the below detailed description of preferred embodiments of the present invention are in accordance with a eighth aspect of the present invention obtained by means of a thermal printer for producing a plurality of individual printings on the surface of a foil in an ink transfer operation, comprising:

means for supplying said foil to said thermal printer, a thermal transfer ribbon defining a specific width along a transversal direction thereof each of said printings defining a maximum dimension along a direction coinciding with said transversal direction constituting no more than 50% of said width and including an ink which is transferable in said ink transfer operation at specific locations of said thermal transfer ribbon by heating said specific locations to an elevated temperature causing said ink to be fluid, means for arranging said thermal transfer ribbon i facial contact with said surface of said foil, energizable printing means for heating said specific locations of said thermal transfer ribbon to said elevated temperature in said ink transfer operation, means for energizing said energizable printing means, means for pressing said energizable printing means and said foil together so as to sandwich said thermal transfer ribbon therebetween in a constrained state, means for moving said foil and said energizable printing means relative to one another at a specific speed means for moving said thermal transfer ribbon relative to said energizable printing means in said ink transfer operation while pressing said energizable printing means and said foil together and while energizing said energizable printing means causing said ink to be transferred to said foil at a first area thereof producing a first printing on said foil at one of the longitudinal edges of said thermal transfer ribbon, and said means for moving said thermal transfer ribbon relative to said energizable printing means causing said thermal transfer ribbon to be relocated relative to said energizable printing means while said energizable printing means are not heated so as to utilize an unused part of said thermal transfer ribbon.

The present invention in particular relates to a thermal printer in which the proper positioning of the printing head or the energizable printing means relative to the thermal transfer ribbon be reestablished or maintained irrespective of any deviation of the transportation of the foil past the energizable printing means during a preceding printing operation. It has been realised that the proper operation of the thermal printer is highly dependent on the accuracy of positioning of the energizable printing means relative to the thermal transfer ribbon. In particular, it has been realised that a self-aligning structure is of the outmost importance to the obtainment of a reliable and thermal printer. Consequently, according to an eighth aspect of the present invention, a thermal printer is provided comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for moving the energizable printing means towards the foil so as to sandwich the thermal transfer ribbon therebetween in a constrained state and for moving the energizable printing means away from the foil, means for moving the foil and the energizable printing means relative to one another at a specific speed while pressing the energizable printing means and the foil together and while energizing the energizable printing means, and means for moving the thermal transfer ribbon relative to the energizable printing means along a specific direction of motion, the means for moving the energizable printing means towards and away from the foil including a supporting structure, the energizable printing means being pivotably mounted in the supporting structure for allowing the energizable printing means to pivote transversally relative to the specific direction of motion of the thermal transfer ribbon, the supporting structure including a biasing element for biasing the energising printing means in the pivotable mounting towards a specific initial position for self-aligning the energizable printing means in the specific initial position. Particular aspect features and advantages of the above thermal printer according to the eighth aspect of the present invention will be evident from the below detailed description of presently preferred embodiments of the thermal printer.

Still further, it has been realised that the proper operation of the thermal printer may be unintentionally deteriorated or ruined provided the mecahnical drive elements of the thermal printer be exposed to unintentional tampering during for instance the operation of cleaning the thermal printer or the operation of replacing a used thermal transfer ribbon with an unused or new thermal transfer ribbon. In order to improve the reliability of the thermal printer and also provide a more easy serviceble thermal printer, a thermal printer has been provided according to an eighth aspect of the present invention, which thermal printer comprises:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for moving the energizable printing means towards the foil so as to sandwich the thermal transfer ribbon therebetween in a constrained state and for moving the energizable printing means away from the foil, the means for moving the energizable printing means towards and away from the foil including an actuator means, means for moving the foil and the energizable printing means relative to one another at a specific speed while pressing the energizable printing means and the foil together and while energizing the energizable printing means, and means for moving the thermal transfer ribbon relative to the energizable printing means at a reduced speed as compared to the specific speed of the foil relative to the energizable printing means and consequently moving the thermal transfer ribbon relative to the foil for causing the ink of the thermal transfer ribbon to be transferred at the specific locations to the foil at specific areas thereof constituting the printing asid thermal transfer ribbon being delivered from a delivery reel, being moved past the energizable printing means and being received by a take-up reel, the means for moving the thermal transfer ribbon relative to the energizable printing means including a roller driven by a motor, the thermal printer further including a housing wall, the reels and the energizable printing means being exposed at an outer side of the housing wall, and the actuator means and the motor driving the roller being concealed behind the housing wall.

Still further it has been realised that the proper and swift operation of the thermal printer may be improved provided the delivery reel and take-up reel of the apparatus be allowed not to be subjected to excessive acceleration and deceleration which would necessitate high power motor drive for providing the swift acceleration and deceleration. In order to allow the thermal printing ribbon to be swiftly accelerated or decelerated, a thermal printer has been provided according to a ninth aspect of the present invention which thermal printer comprises:

A thermal printer for producing a printing on the surface of a foil in an ink transfer operation, comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for moving the energizable printing means towards the foil so as to sandwich the thermal transfer ribbon therebetween in a constrained state and for moving the energizable printing means away from the foil, the means for moving the energizable printing means towards and away from the foil including an actuator means, means for moving the foil and the energizable printing means relative to one another at a specific speed while pressing the energizable printing means and the foil together and while energizing the energizable printing means, and means for moving the thermal transfer ribbon relative to the energizable printing means for causing the ink of the thermal transfer ribbon to be transferred at the specific locations to the foil at specific areas thereof constituting the printing, the thermal transfer ribbon being delivered from a delivery reel to a first spring biased tensioning pin, being moved past the energizable printing means to a second spring biased tensioning pin and being received by a take-up reel, the means for moving the thermal transfer ribbon relative to the energizable printing means including a roller driven by a motor, and the first and second tensioning pins serving the purpose of allowing the thermal transfer ribbon to be accelerated or decelerated without simultaneously accelerating or decelerating, respectively, the delivery and take-up reels.

According to a particular aspect of the present invention, a thermal printer is provided in which a plastics or cardboard core or bobbin, on which the thermal transfer ribbon is delivered, and a further plastics or cardboard core or bobbin on which the thermal transfer ribbon is received are safely fixated relative to a supporting shaft of the delivery reel and relative to a supporting shaft of the take-up reel, respectively. Conventionally a problem exists in providing fixation elements allowing a safe fixation of a plastics material core and also a cardboard core. According to this aspect of the present invention, a thermal printer is provided for producing a thermal printer for producing a printing on the surface of a foil in an ink transfer operation, comprising:

means for supplying the foil to the thermal printer, a thermal transfer ribbon including an ink which is transferable in the ink transfer operation at specific locations of the thermal transfer ribbon by heating the specific locations to an elevated temperature causing the ink to be fluid, means for arranging the thermal transfer ribbon i facial contact with the surface of the foil, energizable printing means for heating the specific locations of the thermal transfer ribbon to the elevated temperature in the ink transfer operation, means for energizing the energizable printing means, means for moving the energizable printing means towards the foil so as to sandwich the thermal transfer ribbon therebetween in a constrained state and for moving the energizable printing means away from the foil, the means for moving the energizable printing means towards and away from the foil including an actuator means, means for moving the foil and the energizable printing means relative to one another at a specific speed while pressing the energizable printing means and the foil together and while energizing the energizable printing means, and means for moving the thermal transfer ribbon relative to the energizable printing means for causing the ink of the thermal transfer ribbon to be transferred at the specific locations to the foil at specific areas thereof constituting the printing, the thermal transfer ribbon being delivered from a delivery reel, being moved past the energizable printing means and being received by a take-up reel, the means for moving the thermal transfer ribbon relative to the energizable printing means including a roller driven by a motor, the delivery reel and the take-up reel being constituted by hollow plastics or cardboard cores or bobbins received on respective reel cores, each of the reel cores having a cylindrical or conical shaft defining an outer surface in which outer surface a pair of planar and non-radially extending support surfaces are provided for supporting in a respective support surface a rotatably and tiltably journalled, circular plate extending beyond the outer surface of the cylindrical or conical shaft.

BRIEF DESCRIPTION OF THE DRAWINGS

The present invention is now to be further described with reference to the drawings, in which FIG. 2 is a perspective and schematic view of a printing assembly of the first embodiment of the printing apparatus in a disassembled state disclosing the interior of the printing assembly, FIG. 3 is a perspective and schematic view of a part of the printing assembly shown in FIG. 2, as the printing assembly is illustrated from the opposites side as compared to the views of FIGS. 1 and 2, FIG. 5*c* is a perspective and schematic view similar to the views of FIGS. 5*a* and 5*b* illustrating the further feature of saving thermo-transfer ribbon through retraction during the printing operation, FIG. 6 is a perspective and schematic view similar to the view of FIG. 6 of a still further, or third, embodiment of a printing apparatus according to the present invention, FIG. 15 is a perspective and schematic view similar to the view of FIG. 2 of a printing assembly of a fifth embodiment of the printing apparatus according to the present invention in a disassembled state disclosing the interior of the printing assembly, FIG. 17 is a perspective and schematic view similar to the views of FIG. 2 and FIG. 15 of a printing assembly of a seventh embodiment of the printing apparatus according to the present invention in a disassembled stage disclosing the interior of the printing assembly.

DETAILED DESCRIPTION OF THE PREFERRED EMBODIMENTS

Figure 1:
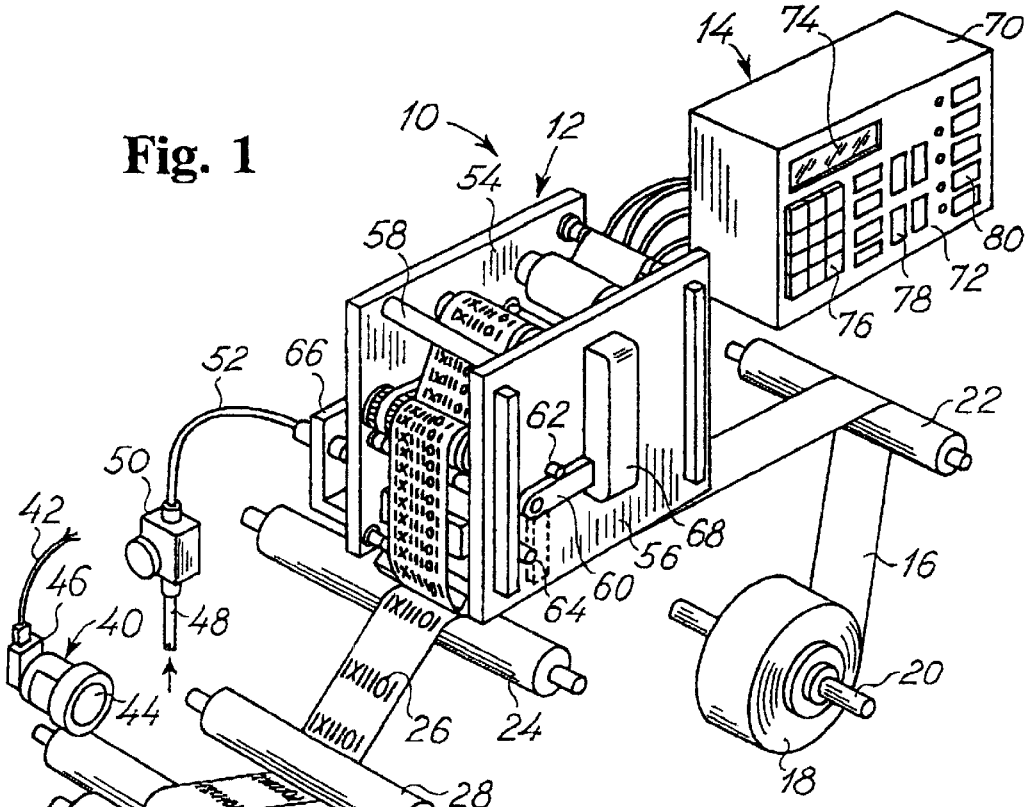
FIG. 1 is an overall perspective and schematic view of a first embodiment of a printing apparatus according to the present invention, illustrating a feature of saving thermo-transfer ribbon by decelerating the thermo-transfer ribbon.

In FIGS. 1–3, a first embodiment of a printing apparatus implemented in accordance with the teachings of the present invention is shown and designated the reference numeral 10 in its entirety. The apparatus basically comprises two parts or sections, a printing assembly 12 to be described in greater detail below with reference to FIGS. 2 and 3 and a control assembly or housing 14, the structure of which is illustrated in FIGS. 7 and 8*a*–8*c*, and the function of which for controlling the overall operation of the printing apparatus 10 is illustrated in FIGS. 9*a*–9*q*.

The printing apparatus 10 is mounted in a frame, not shown in greater detail, of a packaging apparatus or similar apparatus in which a continuous foil 16 is to be applied with a large number of printings. The foil 16 may constitute any appropriate foil of a material allowing the printing of a number of prints by means of a heat transfer foil, such as conventional polymer foil materials used in the packaging industry or for packaging purposes. Examples of relevant foil materials are PE, PVC, PP of woven or non-woven structure and organic fibre materials, such as paper materials or combined paper and polymer foil materials. The foil 16 is supplied from a foil supply reel 18 mounted on a stationary shaft 20 and guided round two rollers 22 and 24 of the packaging apparatus, which rollers define a substantially horizontal path of travel of the foil 16. The printing assembly 12 is positioned above the roller 24 and establishes the printing of the printings on the foil 16 as the foil 16 passes by the roller 24 in its continuous high-speed motion. It is in this context to be realized that the foil 16 may be travelling at a speed of several hundred mm/s, such as a speed of 2–300 mm/s, or even more.

It is further to be realized that the orientation of the foil 16 and the orientation of the printing apparatus as illustrated in FIG. 10 is by no means mandatory in relation to the teachings of the present invention as the foil 16 may travel along a path differing from the horizontal, or substantially horizontal, path of travel illustrated in FIG. 1, such as a sloping or a vertical path of travel, and similarly, the printing apparatus 10 may be mounted or arranged so as to apply printings on the foil of an orientation differing from the horizontal, or substantially horizontal, From the roller 24, the foil 16 to which printings 26 are applied, as will be described in greater detail below, travels on and is guided below a further roller 28. The rollers 22, 24 and 28 all constitute idler rollers and the foil 16 is caused to travel by means of a drive roller 30 which cooperates with a capstan roller 32. The drive roller 30 is caused to rotate defining a peripheral speed of travel corresponding to the speed of travel of the foil 16 by means of a motor 34 which is connected to the roller through a gear assembly 38. The motor 34 may constitute any AC or DC motor, the operation and speed of which may be controlled by means of an external motor controller, not shown in the drawings. The drive motor 34 receives electric power through a power supply cord 36 from an external power supply source being an AC or DC power supply source. The capstan roller 32 cooperates with the drive roller 30 for causing the foil 16 to move as the capstan roller 32 contacts the outer surface of the roller 30 and causes the foil 16 to move as is well-known in the art per se.

The idler rollers 22 and 28 and the capstan roller 32 are made from steel, whereas the drive roller 30 is a roller provided with an elastomeric outer surface, such as a rubber surface which may be slightly deformed through contact with the capstan roller 32. The drive roller 24 is also provided with an elastomeric outer surface constituting a soft deformable surface, such as a Teflon surface, providing a counter surface during a printing operation.

The rotational motion of the foil 16 is detected by the control assembly 14 of the printing apparatus 10 by means of a detector or encoder 40 which supplies an electric control or encoder signal to the control assembly 14 through a signal wire 42. The detector or encoder 40 may be constituted by a contact or non-contact detector or encoder based on inductive, capacitive or optic detecting principles well-known in the art per se. In the embodiment illustrated in FIG. 1, the detector or encoder 40 is constituted as a contact encoder which comprises a rotating wheel 44 which transfers the rotational motion of the roller 30 to an optic detector 46 for generating pulses representing the rotational motion of the drive roller 30 and consequently the motional travel of the foil 16.

For operating the printing mechanism of the printing assembly 12, the printing apparatus 10 receives pressurized air from an external pressurized air source through a supply tubing 48 and through a pressurized air valve 50 which controls the supply of pressurized air to the printing apparatus 10 through a pressurized air inlet tube 52. The pressurized air valve 50 receives a signal from the control assembly 14 through an electric wire, not shown in the drawings. The function of the pressurized air supply will be evident from the below discussion of the structure and function of the printing assembly 12. The printing assembly 12 is composed of two parallel plate or wall elements 54 and 56 which are kept in spaced-apart relationship by means of distance elements, including a hollow element 58, and by means of a locking element which is operated by means of a locking lever 60 shown in FIG. 1 in solid line in its locked position and shown in FIG. 1 in its unlocked or released position. The locking position of the locking lever 60 is defined by a pin 62 and the unlocked position or released position of the locker lever 60 is defined by a further pin 64. The plate element 54 constitutes a rear plate or rear wall supporting a solenoid-actuated pressurized air supply valve to be described below and supported on a bracket 66. The plate element 56 constitutes a front plate or front wall supporting a handle 68 by means of which the front plate 56 and the components and elements supported on the front plate 56 may be held when the front plate 56 is separated from the rear plate 54, as is illustrated in FIG. 2, provided the locker lever 60 is in the unlocked or released position shown in dotted line in FIG. 1. The handle 68 is in FIG. 1 illustrated in a recessed position and in FIG. 2 shown in an extracted position, allowing the handle 68 to be used for gripping and holding the front wall 56.

Within the inner-space defined between the rear plate 54 and the front plate 56, a heat-transfer ribbon is moved in an intermittent motion controlled by the controller assembly 14 for establishing the printings 26 on the foil 16. The various elements of the printing mechanism received within the inner-space defined between the rear wall 54 and front wall 56 will be described below with reference to FIG. 2. The terms "inner" and "outer" and equivalent terms are used in the present context referring to the inner space defined between the rear wall 54 and front wall 56.

The controller assembly 14 is housed within a housing 70 which defines a front plate 72 in which a display 74 is provided together with a number of keys 76 for programming and operating the controller assembly 14 and the printing apparatus 10 along with a number of control lamps 78 and display elements 80 which serves the purpose of presenting information to the operator concerning the programming of the controller assembly 14, and also the operation of the overall printing apparatus 10. The various keys, lamps and display elements 80 are not to be described in greater detail, as these elements may be configured and implemented in accordance with specific requirements, or alternatively may be eliminated provided the printing apparatus is configured so as to perform one single preset and specific printing operation which is addressed or controlled and monitored by an external source, such as a remote PC-based controller.

In FIG. 2, the inner-space defined within the rear plate 54 and the front plate 56 is revealed, disclosing the components of the printing mechanism contained within the inner-space. The rear plate 54 supports, as stated above, the tubular element 58 which serves the purpose of receiving and arresting a pin element 82 supported by and protruding inwardly from the front plate 56. A further pin element 84 is provided protruding inwardly from the front plate 56. The pin element 84 is adapted to be received within a bore 86 of a block 88 which is rigidly connected to the rear wall 55 and includes a recess for receiving an arm 90 which is journalled pivotally relative to the block 88, and consequently the rear wall 54, on an inner shaft of the block 88. The arm 90 supports at its outer distal end a printing head 100 and may be raised and lowered during the process of disassembling and assembling the printing assembly 10 for allowing easy access to the interior of the printing assembly as the arm 90 is biased towards its raised position shown in FIG. 2 by means of a spring included within the block 88.

Apart from the pin elements 82 and 84, four additional pins 92, 94, 96 98 and 99 protrude inwardly from the front plate 56, serving the purpose of maintaining the front plate in a specific spaced-apart relationship relative to the rear wall 54 as the pin elements 82 and 84 are received within the bores of the block 88 and the tubular element 58, respectively, provided the front plate 56 is locked in its locked position as the locking lever 60 is in the position illustrated in solid line in FIG. 1.

The locking lever 60 cooperates with a locking pin 102 which at its outer distal end is provided with a transverse minor pin 104. As the front plate 56 is positioned juxtaposed the rear plate 54 as the pins 82 and 84 are received within the respective bores of the block 88 and the tubular element 58, respectively, and kept in its intentional spaced-apart relationship relative to the rear wall 54, the locking pin 102 is received within an inner bore 106 of a locking element 108 which is journalled on a rotating shaft 110 supported by the rear wall 54 and which is provided with outwardly extending wing elements 114 and 116. On the rotating shaft 110, a cam element 112 is mounted for cooperating with the outer distal end of the arm 90. As the locking lever 60 is rotated from its unlocked position shown in dotted lines in FIG. 1 to its locked position shown in solid line in FIG. 1, the transverse pin 104 of the locking pin 102 causes through its cooperation with the locking element 108 the shaft 110 to rotate in its counter-clockwise direction, causing the cam 112 to be lowered and rotated 90° in the counter-clockwise direction urging the outer distal end of the arm 90 downwardly, causing the printing head 100 to be lowered. Similarly, when the locking lever 60 is rotated from its locked position shown in solid line in FIG. 1 to its unlocked position shown in dotted lines in FIG. 1, the arm 90 is raised as the cam 112 is rotated clockwise from its lowered position, not shown in FIG. 2, to the position shown in FIG. 2.

The locking of the front plate 56 relative to the rear plate 54 is established as the element 106 is rotated 90° counter-clockwise from its position shown in FIG. 2, causing the outwardly extending wing elements 114 and 116 to be locked and arrested behind locking brackets 118 and 120 supported by the front wall 56. The front wall 56 further supports an inwardly protruding shaft 122 on which a thermo-printing ribbon reel 124 is received and supported from which a thermo-printing ribbon 130 is supplied. The thermo-printing ribbon 130 is delivered from the reel 124 as the reel 124 is rotated on the shaft 122, still, the rotation of the reel 124 relative to the shaft 122 is controlled through a braking spring 126 serving the purpose of preventing that the ribbon 130 is freely delivered from the reel 124 in a non-tensioned mode. Furthermore, a rotably mounted tensioning pin 86 is provided which is mounted on a rotating arm 87 for catching up any slack in the ribbon 130 and for collecting a length of the ribbon 130 delivered from the reel 124. The tensioning pin 86 is spring-biased in the counter-wise direction and is of importance not only as far as compensating for any ribbon material delivered from the reel 124, but also for allowing the printing apparatus to reverse the direction of movement of the ribbon 130 relative to the printing head 100 in certain operations to be described below and referred to as "side shift technique" and "retraction technique" to be described below with reference to FIGS. 1*a* and 1*b*. The ribbon 130 is guided round the distance pins 92, 94, 96 and 98 defining a lower horizontal path which is kept substantially parallel to the path of travel of the foil 16 when the printing assembly 12 is in the assembled state illustrated in FIG. 1. From the distance pin 98, the ribbon 130 is guided around a drive roller 128 which is driven by a motor assembly supported by the rear wall 54 and further guided from the drive roller 128 round the distance pin 99 and collected on a take-up reel 132. The take-up reel 132 is connected to the drive roller 128 through a belt drive mechanism including a toothed belt 134 which is driven by a drive gear wheel 136 of the drive shaft 128 and further cooperates with a gear wheel 138 of the take-up reel 132, which gear wheel 138 is connected to the take-up reel 132 through a frictional clutch compensating for the change of diameter of the take-up reel 132 as the ribbon 130 is collected on the take-up reel 132 in the transmission of the rotation of the drive shaft 128 to the take-up reel 132.

The inner side of the rear wall 54 is illustrated in the upper left-hand part of FIG. 2 and the outer side of the rear wall 54 is illustrated in FIG. 3. The rear wall 54 supports a motor assembly for actuating the drive roller 128 of the front plate 56, which motor assembly includes a motor 140 arranged at the outer side of the rear plate 54 and protruding outwardly relative thereto. The motor 140 has its output shaft extending through the rear plate 54 and connected to a drive pulley 142 positioned at the inner side of the front plate 54, which drive pulley 142 cooperates with a belt 144 cooperating with a drive shaft 146 which is journalled on a journalling bearing 148 and protrudes inwardly into the inner space defined within the printing assembly 112 and cooperates with the drive roller 128 as the drive shaft 146 is received within the drive roller 128 when the front wall 56 is received and locked in position relative to the rear plate 54.

The motor assembly further includes a tensioning pulley 149 which serves the purpose of establishing a preset and specific tensioning of the drive belt 144. As will be understood, the rotational motion of the output shaft of the motor 140 is transmitted through the drive pulley 142, the belt 144 and the drive shaft 146 to the drive roller 128 when the front plate 56 is positioned and locked relative to the rear plate 54 as described above.

In FIG. 3, a printed circuit board 150 is shown, including the motor control electronics for controlling the function and operation of the motor 140. The printed circuit board 150 is connected to the controller assembly 14 through two multicore cables 152 and 154 and is connected to the motor 140, and optionally detectors of the printing assembly for detecting whether or not the front plate 56 is properly positioned and locked relative to the rear plate 54. In the below description of the electronic circuitry of the printing apparatus 10, a detector 180, not shown in FIG. 2, is described serving the above purpose. As is evident from FIGS. 2 and 3, a further multicore cable 156 is provided for establishing connection between the printing head 100 and the control assembly 14.

The arm 90 is, as discussed above, caused to be raised through the biasing from the bias spring contained within the block 88 to its raised position shown in FIG. 2, provided the cam 112 is in its raised position also shown in FIG. 2. As the shaft 110 is rotated 90° clockwise, the cam 112 forces the arm 90 downwardly, positioning the printing head 100 in its stand-by position ready for performing a printing function.

The outer end of the arm 90 is provided with a printing head suspension block 160 in which the printing head 100 is suspended pivotally. The printing head 100 is journalled pivotally relative to the suspension block 160 by means of a rotating shaft 162 and is urged to a raised position by means of a biasing spring 164, forcing the printing head 100 to be raised or lifted upwardly relative to the foil 16 in its stand-by mode. When a printing operation is to be performed, the printing head 100 is lowered as the pressurized air supplied to the printing assembly 12 through the pressurized air-inlet tube 52 is further supplied to a pneumatic actuator valve 166 through a pressurized air supply hose 168 from a solenoid-actuated pressurized air supply valve 170 mounted on the outer side of the rear wall 54 and connected to the motor controller circuit board 150 through an electric wire 172.

Figure 4:
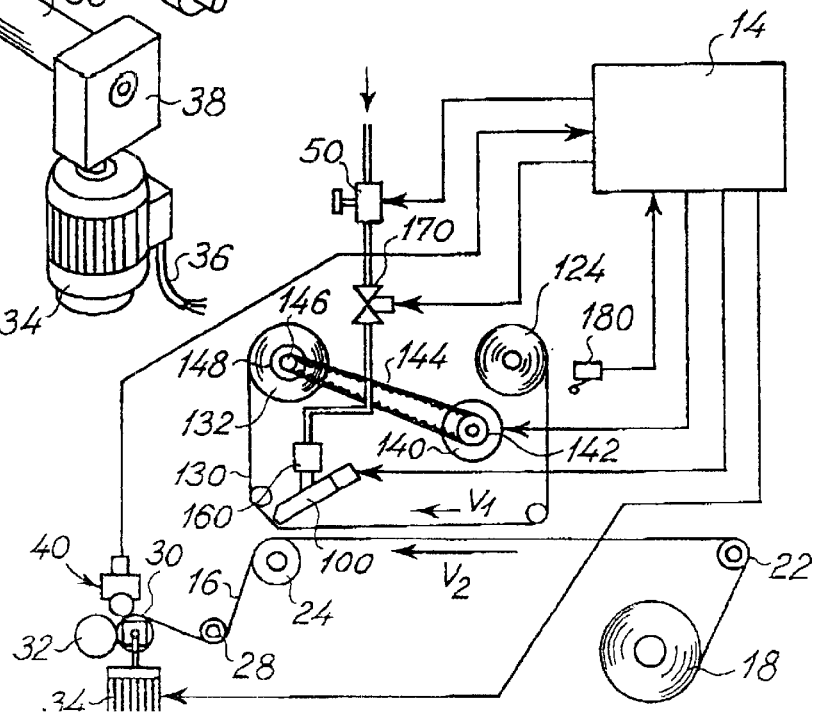
FIG. 4 is a schematic view illustrating the overall operation of the printing apparatus illustrated in FIG. 1.

Before turning to a specific description of the printing operation to be performed by means of the printing apparatus 10 described above with reference to FIGS. 1–3, and also with reference to FIG. 4, it is to be realized that the printing head 100 is a thermo-transfer printing head including a number of transversly spaced-apart heating elements, such as ten heating elements per mm, or even more heating elements, allowing a specific point-like area of the lower exposed surface of the printing head to be heated by heating a specific heating element. The printing head 100 is in itself a component well-known in the art per se and readily available from numerous manufacturers, such as the Japanese manufacturer Kyocera. The printing head may be of any specific transverse dimension, such as a 1 inch, 2 inch width, or even wider. Also in a modified embodiment, a plurality of printing heads may be mounted on a common operational shaft, allowing a wider ribbon to be used for producing even wider printings in excess of 2 inch, e.g. of any arbitrary width, e.g. an integer multiple of 1 or 2 inches.

The printing operation is performed as follows. The control assembly 14 is preprogrammed locally or remotely through an external in/out port from a remote computer, such as a remote PC, for producing a print of a specific typographic shape and also of a specific spacing on the foil 16. It is to be realized that the computerized controlling of the printing apparatus 10 allows the printing apparatus to produce individual prints on the foil 16, such as prints of a consecutive numbering, including individual data or identifications of any arbitrary kind, such as a production number, a time of date, etc., without in any way changing the overall function of the printing apparatus. The foil 16 is caused to travel along its substantially horizontal path between the rollers 22 and 24, vide FIG. 4, at a speed of travel of V2 up to 500 mm/s, driven by the motor 34 and the drive roller 30 as discussed and described above. The motion of the foil 16 is detected by means of the motion sensor or detector 40. Provided the printing assembly 12 is properly assembled, which is detected by means of the above-mentioned detector 180 preferably cooperating with the locking lever 60, the control assembly 14 controls the pressure valve 50 to open for the supply of pressurized air to the solenoid-actuated valve 170. As the control assembly 14 detects the motion of the foil 16 and on the basis of its programme establishes that a printing is to be performed, the motor 140 of the motor assembly is energized for causing the ribbon 130 to move in parallel with the foil 16 and at the same time energizes the solenoid-actuated valve 170, causing the printing head 100 to be forced downwardly towards the counter roller 24 for pressing the ribbon 130 into contact with the surface of the foil 16. The specific heating elements of the printing head 100 is addressed in conformity with the printing to be made for heating specific areas of the thermo-transfer ribbon 130 for causing the ink of the thermo-transfer ribbon to be heated to an elevated temperature allowing the ink to be transferred to the foil 16 as the ribbon 130 is pressed or squeezed against the foil 16. According to the teachings of the present invention, the ribbon 130 is moved at a lower speed V1 as compared to the speed of travel of the foil 16 on the one hand providing a perfectly readable printing and at the same time saving ribbon material as compared to a printing operation i which the thermo-transfer ribbon 130 is moved in synchronism with the foil 16.

It has, surprisingly, been realized that the technique of reducing the speed of the thermo-transfer ribbon 130 relative to the foil 16 does not deteriorate the quality of the printing which is believed to be caused by the fact that the process of transferring ink from the heated areas of the thermo-transfer ribbon 130 to the foil 16 may be considered as a smearing process rather than a contact printing process, which smearing process smears the heated ink onto the foil rather than simply transferring the ink through facial contact between the thermo-transfer ribbon 130 and the foil 16. The speed of motion of the thermo-transfer ribbon 30 is controlled by the control assembly 14 and according to the teachings of the present invention it has been realized that the speed of motion V1 of the thermo-transfer foil 130 may be reduced to even 20–30% of the speed of motion of the foil 16. Also, according to the teachings of the present invention, it has surprisingly been realized that an improved printing, as compared to a printing process in which the velocities V1 and V2 are identical, is obtained, provided the velocity V1 is reduced to 95–97% of the speed V2 which is believed to be originating from the above described smearing effect.

Figure 1A:
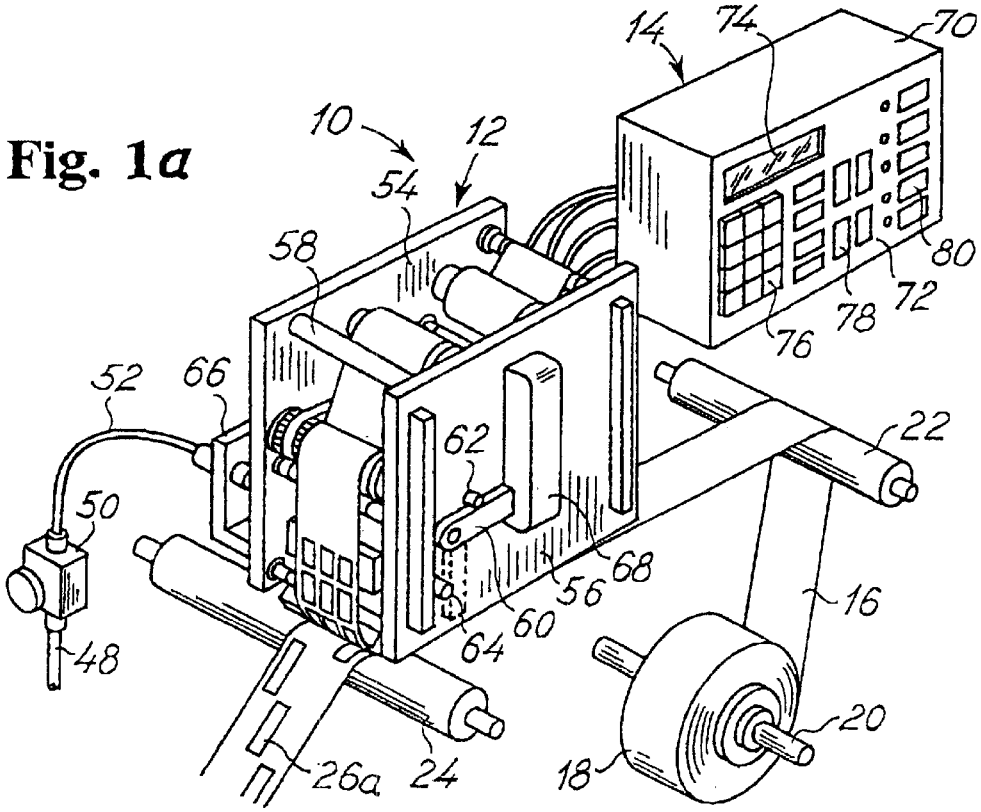
FIG. 1*a* is a part of a perspective and schematic view similar to the view of FIG. 1 illustrating a further feature of saving thermal transfer ribbon by side-shifting during the printing operation.
Figure 1B:
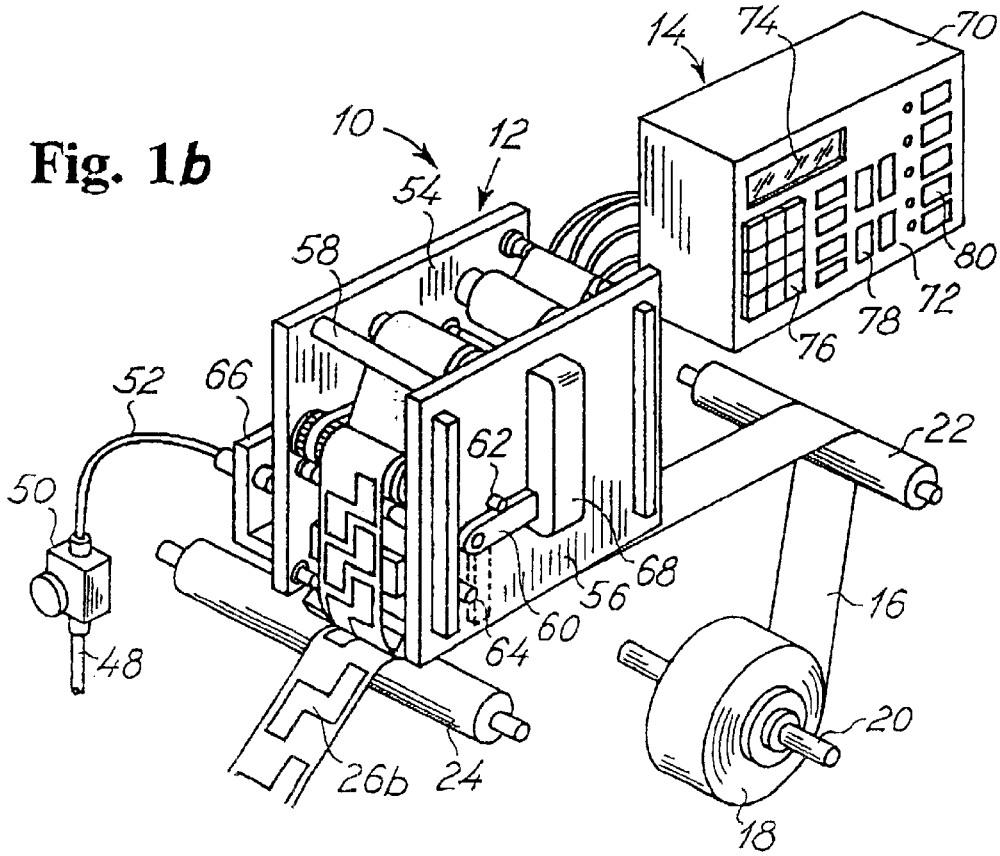
FIG. 1*b* is a part of a perspective and schematic view similar to the view of FIG. 1*a* illustrating a further feature of saving thermo-transfer ribbon through retraction during the printing operation.

It has, furthermore, surprisingly been realized that further thermal-transfer ribbon material may be saved during the printing operation through further techniques which are illustrated in FIGS. 1*a* and 1*b* and relate to side-shifting the printings during the printing operation and retraction of the thermal-transfer ribbon during the printing operation, re-spectively.

In FIG. 1*a,* a printing 26*a* is to be produced on the foil 16 which printing defines a width perpendicular to the longitudinal direction of the foil 16 constituting only a fraction and in particular less than 50% of the width of the foil 16. In numerous instances, the specific location of the printings on the foil 16 are of minor relevance, e.g. provided the printings constitute printings representing the date of packaging the material or printings identifying the packaging machine or any other identify, in which instance the printings such as the printing 26*a* illustrated in FIG. 1*a* need not to be positioned as a specific location on the foil 16 allowing that the printing 26*a* be shifted sidewise during the printing operation allowing the entire width of the thermo-transfer ribbon 130 to be utilized. As an example, assuming the width of the printing 26*a* constitutes less than 20% of the total width of the foil 16, a first printing 26*a* is produced adjacent to one of the edges of the foil 16 whereupon the next printing is produced shifted one fifth of the width of the foil 16 sidewise and so on for the next three printings allowing a total of five prints to be produced sidewise shifted along the foil 16 still utilizing no more than a single peace of thermo-transfer ribbon material corresponding to a single thereby producing a total saving of 80% of the thermo-transfer ribbon material as compared to a conventional thermo-transfer printer or a thermo-transfer printer operated in accordance with the technique of reducing the speed of the thermo-transfer ribbon relative to the foil as discussed above with reference to FIG. 1. Consequently, through combining the speed reduction technique described above with reference to FIG. 1 and further the sideway shifting technique illustrated in FIG. 1*a* and discussed above, an extreme saving of thermo-transfer ribbon material may be obtained provided the printings to be applied to the foil 16 constitute only a fraction of the width of the foil material and provided it is acceptable to shift the printings sidewise along the foil 16. Assuming that e.g. 50% material is saved through the speed reduction technique described above, and assuming that a total of e.g. five prints may be produced side by side on the foil in the above described side-shifting operation, the amount of thermo-transfer ribbon material used in a printing process combining the speed reduction technique and the side-shift technique allows that only 10% of the thermo-transfer ribbon material be used in the apparatus according to the present invention as compared to a conventional non-speed reducing and non-side-shifting apparatus producing the same printings.

It has still further surprisingly been realized that a saving of thermo-transfer ribbon material may be obtained provided the direction or movement of the thermo-transfer ribbon be reversed during the printing operation or between any two printing operations for retraction of the thermo-transfer ribbon providing the printings to be produced define a configuration having outer contours allowing any two adjacent printings to be positioned in closely juxtaposed position. In FIG. 1*b,* this technique of saving thermo-transfer ribbon material through reversing the direction or motion of the thermo-transfer ribbon or retraction of the thermo-transfer ribbon after the completion of a single printing operation is illustrated. In FIG. 1*b,* the printings to be produced on the foil 16 is a printing of an overall configuration of a Z having two wings protruding in opposite directions along the longitudinal direction of the foil 1. Provided the thermo-transfer ribbon 130 is not reversed for retraction of the thermo-transfer ribbon, the leading edge of the Z printing 26*b* would be initiated at a location of the thermo-transfer ribbon 30 in spaced apart relationship from the area used for the previous printing as the new printing would be produced by the utilization of thermo-transfer ribbon material starting from the end of the material previously used for the previous printing. By the retraction of the thermo-transfer ribbon, the starting point for the new printing may be located within an area of the thermal-transfer ribbon material which was unused for the previous printing and which may still be utilized in the new printing without producing overlaps between the areas used during the two printing operations on the thermal-transfer ribbon 130.

The retraction technique illustrated in FIG. 1*b* may in certain instances be combined with the side-shifting technique illustrated described above with reference to FIG. 1*a* and may advantageously with or without the combination with the side-shifting technique be combined with the speed reduction technique described above with reference to FIG. 1.

Figure 5A:
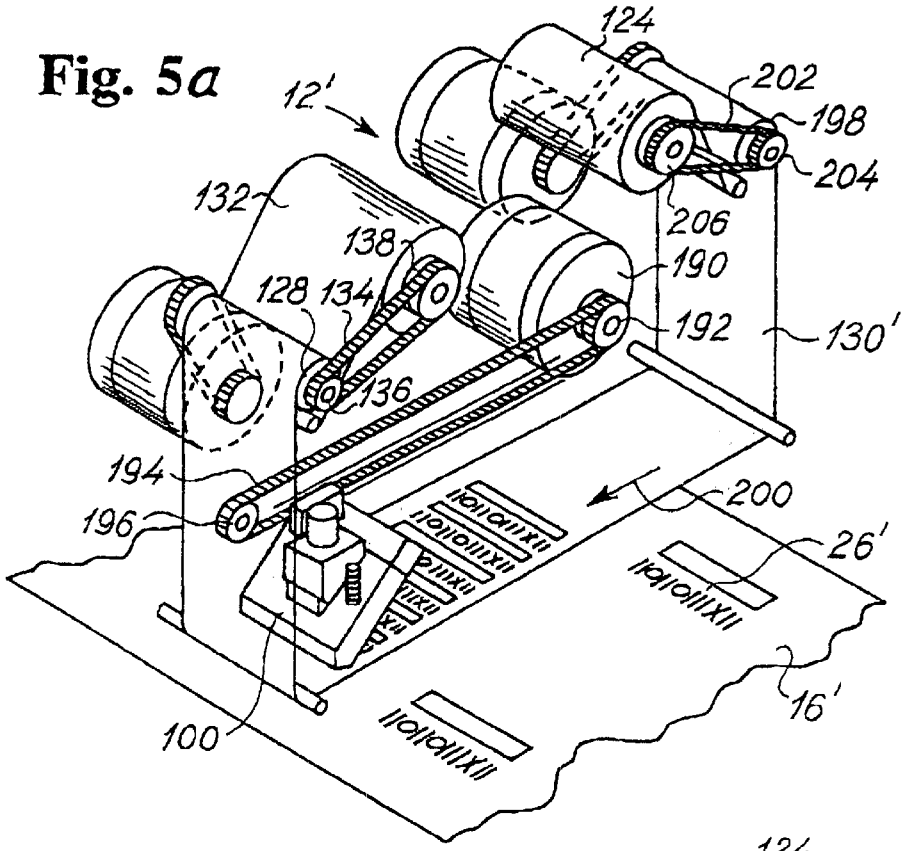
FIG. 5*a* is a perspective and schematic view illustrating a printing assembly of a further, or second, embodiment of the printing apparatus according to the present invention, illustrating the feature also illustrated in FIG. 1 of saving thermo-transfer ribbon through decelerating the thermo transfer ribbon.

The above described first embodiment of the printing apparatus 10 according to the present invention performs its printing operation in an orientation or direction co-extensive with the direction of travel of the continuously moving foil 16 to which the printings are to be applied. The teachings of the present invention, however, may also advantageously be utilized in connection with printing apparatuses which operate in connection with intermittently moving foils and perform their printing operations along a direction of orientation transversly relative to the direction of motion of the foil. In FIGS. 5*a* and 6, two alternative embodiments of printing assemblies are shown schematically for producing printings in a direction transversly relative to the direction of travel of the foil to which the printings are to be applied. In FIGS. 5*a* and 6, elements or components identical to elements or components described above with reference to FIGS. 1–4 are designated the same reference numerals, whereas elements or components similar to or serving the same purpose as elements described above with reference to FIGS. 1–4 are designated the same figure, however, added the marking ' in FIG. 5*a* and the marking " in FIG. 6.

The printing assembly 12' shown in FIG. 5*a* includes a further motor assembly including a motor 190 for causing the printing head 100 to be moved from a left-hand position transversly to a right-hand position relative to the foil 16'. The printing head 100 is in FIG. 5*a* shown in its stand-by position. The motor 190 cooperates with the printing head through a drive pulley 192 mounted on the output shaft of the motor 190, a belt 194 and a pulley 196 journalled on a supporting slide, not shown in FIG. 5*a,* on which the printing head 100 is mounted, allowing the printing head to be raised and lowered as described above with reference to FIG. 2. The thermo-transfer ribbon 130 is moved in its overall direction of motion as indicated by an arrow 200 and supplied from the ribbon supply reel 124 to the ribbon take-up reel 132. Contrary to the above described first embodiment, the supply reel 124 is also motorized as the printing assembly includes an additional motor assembly and a further drive roller 198 corresponding to the drive roller 128, a further belt 202 corresponding to the belt 134, and also a further cam gear wheel 204 and a gear wheel 206 including a frictional clutch corresponding to the drive gear wheel 136 and the gear wheel 138 described above with reference to FIG. 2.

The printing assembly 12' is operated in the following manner. As the foil 16' is kept stationary, the printing head 100 is forced into contact with the upper side of the thermo-transfer ribbon 130 and moved from its left-hand position shown in FIG. 5*a* to its right-hand position and at the same time the thermo-transfer ribbon 30 is reversed and moved at a lower speed as compared to the speed of motion of the printing head 100. After the printing operation has been performed, the printing head 100 is raised in its right-hand position and reverts to its stand-by position shown in FIG. 5*a,* and the foil 16' is intermittently moved one further step and at the same time, the thermo-transfer foil 130 is moved in the direction indicated by the arrow 200 for collecting the used thermo-ribbon material on the reel 130 and positioning unused thermo-transfer ribbon material for the next printing operation.

Figure 5B:
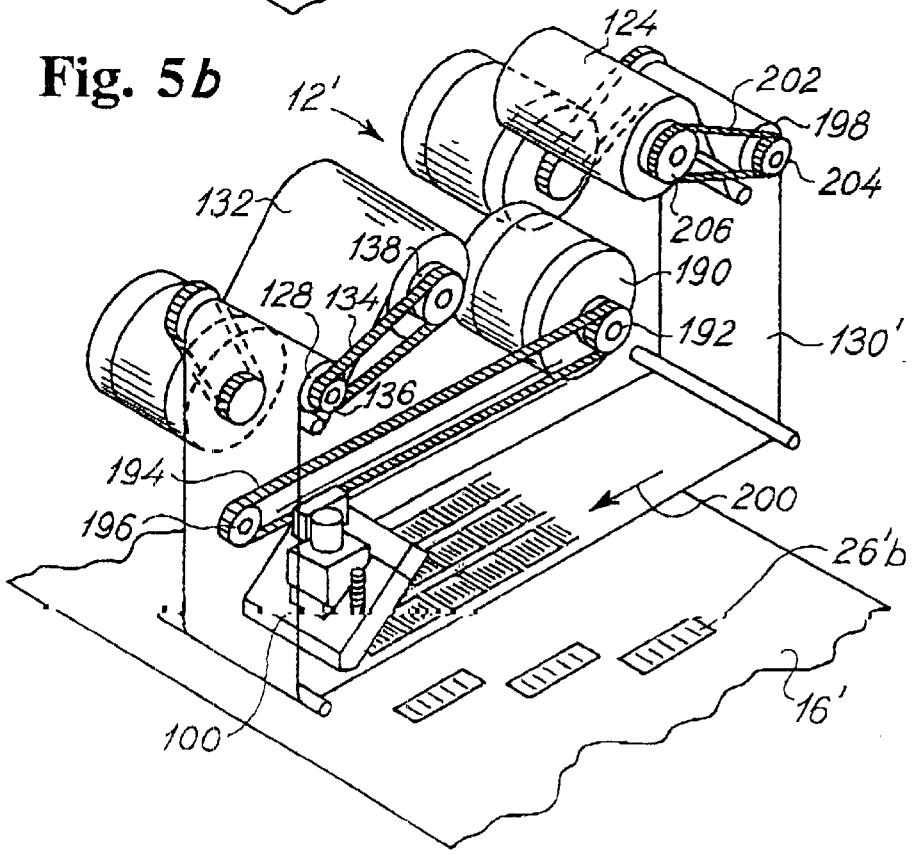
FIG. 5*b* is a perspective and schematic view similar to the view of FIG. 5*b* illustrating the feature of saving thermo-transfer ribbon also illustrated in FIG. 5*a* through side-shifting during the printing operation.

The second embodiment of the printing apparatus illustrated in FIG. 5*a* may further advantageously be used for the above described side shifting and/or the above described retraction technique as is illustrated in FIGS. 5*b* and 5*c,* respectively, allowing the further saving of thermo-transfer ribbon material. In FIG. 5*b,* the side shifting technique is illustrated as three identical printings 26'*b* are produced side-shifted relative to one another still produced without lengthwise shifting the thermo-transfer ribbon 130' along the direction of the arrow 200 or in the opposite direction as the areas of the thermo-transfer ribbon material 130' used for these three side-shifted printings 26'*b* are positioned adjacent one another.

In FIG. 5*c,* the retraction technique by utilizing or employing the second embodiment of the printing assembly illustrated in FIGS. 5*a* and 5*b* is disclosed as a printing 26 is produced involving the above described retraction technique in combination with the speed reduction technique described above with reference to FIG. 5*a*. The two neighbouring printings 26'*c* are produced by utilizing mutually overlapping areas of the thermo-transfer ribbon 130' by shifting or retraction of the thermo-transfer ribbon 130' in the direction opposite to the arrow 200 after the completion of a first printing operation and before the initiation of a second printing operation.

In FIG. 6, a modified third embodiment of the printing assembly illustrated in FIG. 5*a* is shown designated the reference numeral 12". The third embodiment 12" basically differs from the above described second embodiment 12" in that the above described further motor assembly for producing a motorized supply reel 124 is eliminated as the thermo-transfer ribbon 130 is moved in one and the same direction during the printing operation, also producing the take-up on the take-up reel 132 of the thermo-transfer ribbon material without necessitating any reversal of the direction of motion of the thermo-transfer ribbon 130. In FIG. 6, the direction of motion of the thermo-transfer foil is indicated by an arrow 208, which direction of motion is parallel to and unidirectional relative to the direction of motion of the printing head 100 during the printing operation, providing an overall simplified structure as compared to the structure illustrated in FIG. 5*a*.

The third embodiment of the printing assembly illustrated in FIG. 6 may also be used for utilizing the side-shifting and retraction technique described above with reference to FIGS. 1*b* and 1*c,* respectively, and further with reference to FIGS. 5*b* and 5*c,* respectively.

In FIGS. 5*a* and 6, the thermo-transfer ribbon saving aspect of the present invention is illustrated as the width, i.e. the dimension of the printings 26' and 26" produced on the foils 16' and 16" in FIGS. 5*a* and 6, respectively, is larger than the corresponding width of the signatures produced on the thermo-transfer ribbons 130' and 130". Similarly, in FIG. 1, the lengthwise or longitudinal extension of the printing 26 is substantial-ly larger than the corresponding extension of the signature produced on the thermo-transfer ribbon 130.

In FIGS. 1*a* and 5*b,* the thermo-transfer ribbon saving aspect of the present invention through utilizing the above described side-shifting technique is illustrated as the signatures produced on the thermo-transfer ribbons 130 and 130' for producing the side-wise shifted printings are located adjacent one another covering the entire width of the thermo-transfer ribbon. Similarly, in FIGS. 1*b* and 5*c,* the thermo-transfer ribbon saving aspect by utilizing the retraction technique is illustrated as the signatures produced on the thermo-transfer ribbons for producing the printings 26*c* and 26'*c,* respectively, are fitted into one another rather than located within separate areas of the respective thermo-transfer ribbons.

Figure 11A:
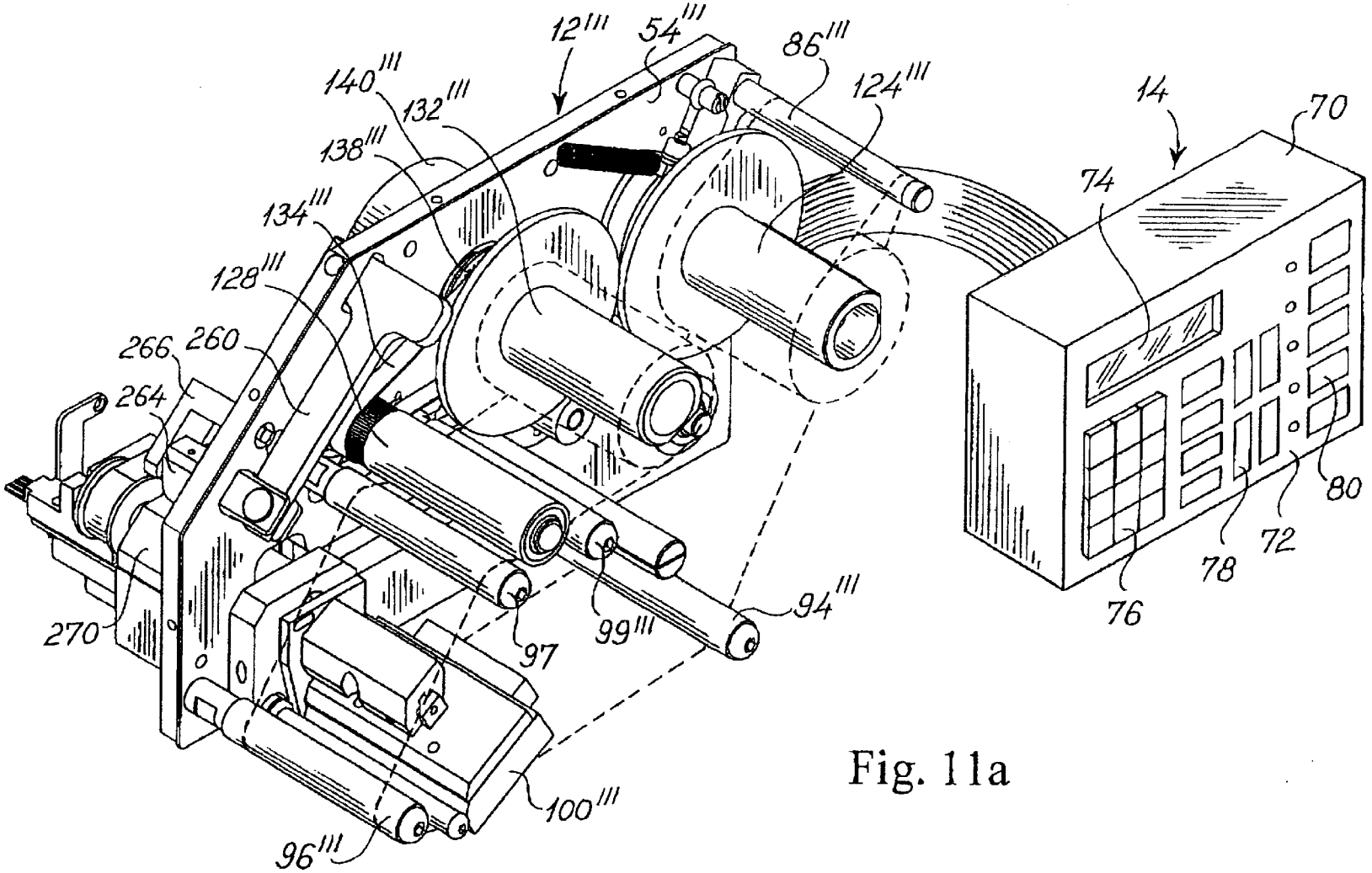
FIG. 11*a* is a perspective and schematic view similar to the view of FIG. 1*a* of a still further or fourth and presently preferred embodiment of the printing apparatus according to the present invention, as viewed from the front side of the apparatus.
Figure 11B:
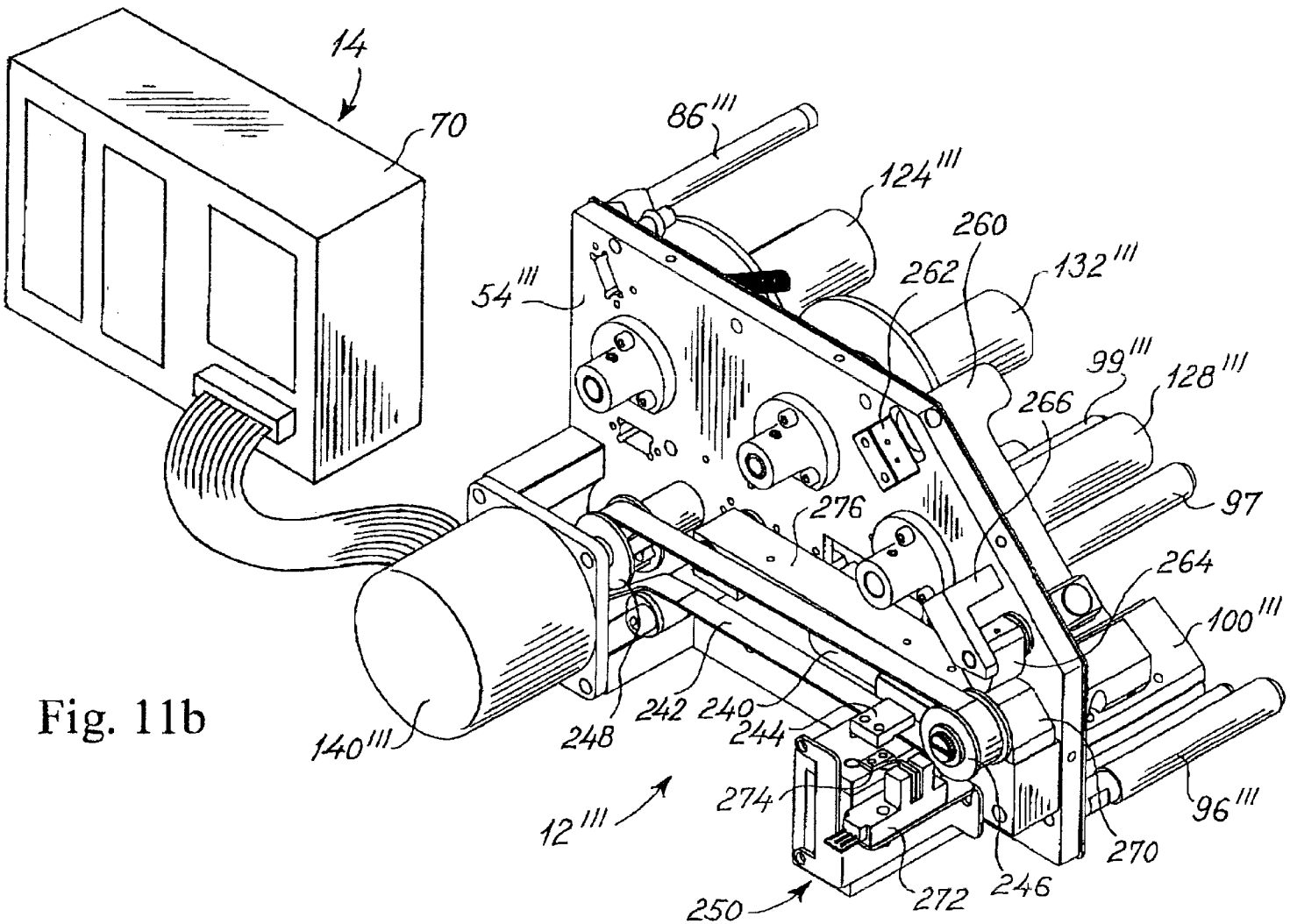
FIG. 11*b* is a perspective and schematic view similar to the view of FIG. 11*b* of the fourth and presently preferred embodiment of the printing apparatus according to the present invention, as viewed from the rear side of the apparatus.
Figure 11C:
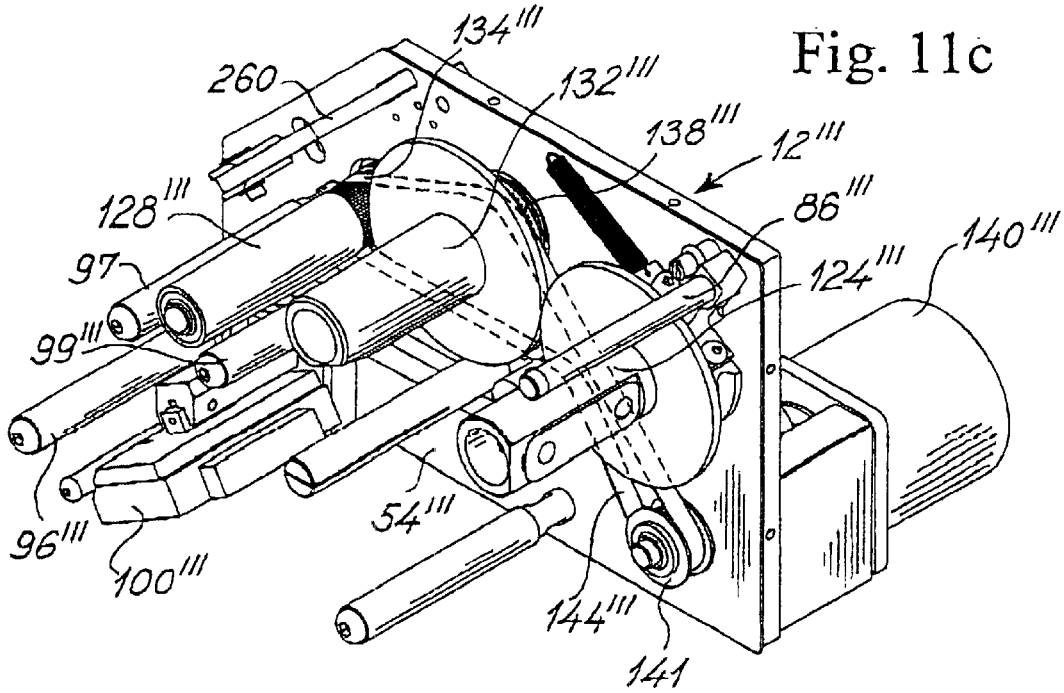
FIG. 11*c* is a perspective and shematic view of a part of the fourth and presently preferred embodiment of the printing apparatus according to the present invention as viewed from the rear side and from the opposite end as compared to the view of FIG. 11*b*.

In FIGS. 11*a*–11*c,* a fourth and presently preferred embodiment of the printing apparatus according to the present invention is shown designated the reference numeral 12''' in its entirety. In FIGS. 11*a*–11*c,* elements or components identical to elements or components described above with FIGS. 1–6 are designated the same reference numerals, whereas elements or components similar to or serving the same purpose as elements or components described above with reference to FIGS. 1–6 are designated the same Figure, however, added the marking '''. Furthermore, in FIGS. 11*a*–11*c,* exterior housing components are omitted for the sake of clarity. The fourth and presently preferred embodiment of the printing apparatus according to the present invention shown in FIGS. 11*a*–11*c* basically differs from the above-described first embodiment 10 shown in FIGS. 1–4 in that the motor and the motion generating elements are mounted behind the supporting plate 54''' in order to on the one hand provide a structure in which the mechanical drive elements are protected by the supporting plate 54''' for being unintentionally damaged by an operator and on the other hand providing a simple structure in which the thermo-printing ribbon 130''' which is shown in phantom lines in FIG. 11*a* is easily accessible. As distinct from the above-described first embodiment 12 shown in FIGS. 1–4, the printing apparatus 12''' shown in FIGS. 11*a*–11*c* is of a unitary structure in which the thermo-printing ribbon 130''' is mounted onto the unitary printing apparatus 12''' rather than received on a separate part to be connected to and locked in relation to the stationary printing apparatus part. Consequently, the printing apparatus 12''' is mechanically of a more simple structure as compared to the above-described first embodiment shown in FIGS. 1–4. The thermo-printing ribbon 130''' is received on a hollow core not shown in FIG. 11*a* which is further received on a reel 124''' serving the same purpose as the shaft 122 described above with reference to FIGS. 1–4. From the reel 124''', the ribbon 130''' extends round a tensioning pin 86''' which is mounted on a rotatable plate or disc element located behind the reel 124''' and which is biased by means of a spring in the counter clockwise direction for causing the thermo-printing ribbon 133''' to be maintained in a specific pretensioned state irrespective of the location of the thermo-printing ribbon which is movable in both directions by means of the drive elements or motor of the apparatus. Irrespective of the motion of the thermo-printing ribbon 130''', the reel 124''' is only allowed to rotate in the one direction, namely the clockwise direction.

From the tensioning pin 86, the thermo-printing ribbon 130''' extends round a bottom pin 94''' and further on round a further pin 96'''. Below the pins 94''' and 96''', the thermo-printing ribbon 130''' is moving in a substantially horisontal and rectilinear path. Between the two pins 94''' and 96''', the printing head 100''' is located and is movable between two positions, the one position shown in FIG. 1*a* in which the printing head 100''' is located juxtaposed the pin 96''' and the retracted position in which the printing head 100''' is located juxtaposed the pin 94'''.

Along with the motion of the printing head 100" along the path defined between the two pins 94''' and 96''', the thermo-printing ribbon 130''' may also be relocated by the actuation of the drive of the thermo-printing ribbon allowing the thermo-printing ribbon 130''' to be moved in both directions relative to the overall direction of motion of the thermo-printing ribbon 130''' from the pin 94''' towards the pin 96'''. As discussed above, the return motion of the thermo-printing ribbon 130''' is allowed due to the tensioning pin 86'''.

From the pin 96''', the thermo-printing ribbon 130''' moves in its overall direction of motion towards two additional pins 97 and 99'''.

Between the two pins 97 and 99''', the drive roller 128''' is located which drive roller serves the same purpose as the drive roller 128 described above with reference to FIGS. 1–4, namely of moving the thermo-printing ribbon 130''' from the reel 124''' past the printing head 100''' to the take-up reel 132'''. The take-up reel 132''' and the drive roller 128''' are interconnected through a belt 134''' and the take-up reel 132''' is mounted on a frictional clutch of a gear wheel 138''' all serving the same purposes as described above with reference to FIG. 2. As already mentioned, the above-described thermo-printing ribbon motion elements of the fourth and presently preferred embodiments 12''' shown in FIG. 11*a* are as distinct from the embodiment described above with reference to FIG. 2 mounted on the one supporting plate 54''' as distinct from the first embodiment described above with reference to FIG. 2 in which the drive elements and the pins etc. are all mounted on a separate disengageable plate 56.

The printing head 100''' is mounted on a horisontally movable sledge structure to be described in greater details below with reference to FIG. 13. The printing head supporting sledge structure is guided in a horisontal aperture 240 and moved between the two positions juxtaposed the two pins 94''' and 96''', respectively by means of a drive including a belt 242. The belt 242 is fixed to the printing head supporting sledge structure 250 by means of a clamp 244 and passes round a roller 246. The belt is shortened by the rotation of a drive roller 248 by the rotation of the roller 248 in the counter clockwise direction providing a shortening of the length of the free belt extending between the two rollers or wheels 246 and 248, thereby causing the printing head supporting sledge 250 to move from the position juxtaposed the pin 96''' towards the pin 94''' guided within the aperture 240 of the supporting plate 54'''.

The aperture 240 is, as is indicated in FIG. 11*a* of an overall L-shaped configuration allowing the printing head supporting sledge 150 to move lengthwise along the horisontal part of the L and to be raised at the front end of the L-shaped aperture provided the sledge mechanism be disengaged for allowing the raising of the sledge assembly 50. For this purpose, a handle 260 is provided, which handle cooperates with a micro-switch 262 shown in FIG. 11*b*, which micro-switch serves the purpose of detecting that the handle 260 is in the locked and operational position shown in FIGS. 11*a* and 11*b*. Provided the handle is shifted to a position extending perpendicular from the supporting front plate 54''', the handle is disengaged from the micro-switch 262 which tells the microprocessor of the control apparatus included in the housing 70 that all functions are to be interrupted. As the handle is swung to the perpendicularly outwardly protuding position, the handle 260 may be rotated in the clockwise direction in FIG. 11*a* for rotating a pressure block 264 to disengage its contact with the upper surface of a rotatable bar 270. The pressure block 264 is journalled relative to the supporting plate 54''' in an L-shaped bracket 266. Opposite its free end of contact with the pressure block 274, the rotatable pressure bar 270 is journalled relative to the supporting plate 54''' in a journalling bearing not shown in FIG. 11*b* as the journalling bearing is hidden behind the belt 242. As the pressure block 264 is rotated out of contact with the upper surface of the rotatable pressure bar 270, the printing head supporting sledge 250 is allowed to be lifted along the vertical part of the L-shaped aperture 270 for allowing the person claening and repositioning a thermo-printing ribbon 130''' on the apparatus to obtain easy access to the interior of the apparatus for easy cleaning and reloading of thermo-printing ribbon.

In FIG. 11*b*, an optical detector 272 is also shown which cooperates with a light intransparent plate element 274 which is mounted on the printing head supporting sledge 250. The optical detector 274 is rigidly connected to the supporting plate 54''' of detecting the positioning of the printing head supporting sledge 250 in the frontmost position in which the printing head 100''' is positioned juxtaposed the pin 96'''.

In FIG. 11*c*, a detail of the belt drive mechanism interconnecting the motor 140''' of the printing apparatus 12''' with the drive of the drive roller 128''' and the take-up reel 132''' as a drive pulley 141 of the drive mechanism is disclosed, which drive pulley 141 is journalled on the output shaft of the motor 140''' and cooperates with the drive belt 144''' of the drive mechanism.

Figure 12:
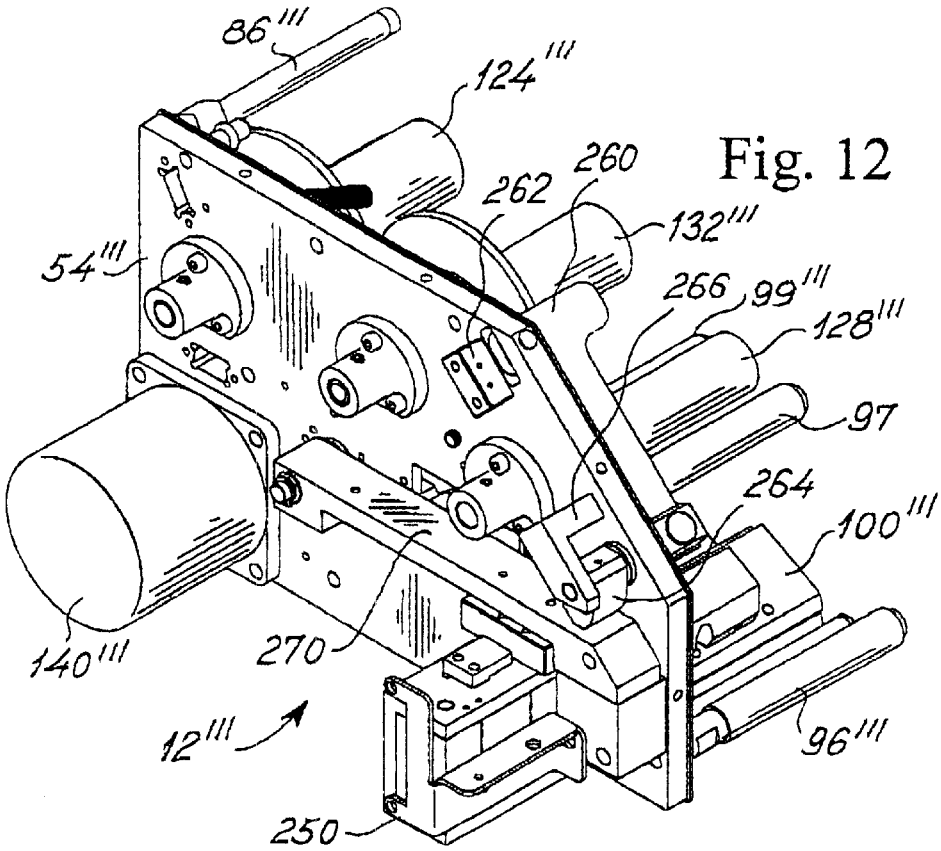
FIG. 12 is a perspective and schematic view similar to the view of FIG. 11*b* of a modified version of the fourth and presently preferred embodiment of the printing apparatus according to the present invention.

In FIG. 12, a slightly modified version of the above-described fourth and presently preferred embodiment of the printing apparatus 12''' shown in FIGS. 11*a*–11*c* is illustrated, which modified version differs from the above-described version in that the horisontale motion of the printing head 100''' is omitted. Consequently, the horisontal aperture 240 is omitted together with the belt 242 and the rollers 246 and 248. Still, the printing head 100 is, as is evident from FIG. 12, mounted vertically raisable by the provision of the handle 260 which cooperates, as described above, with the pressure block 264 and the rotatable pressure bar 270.

Figure 13:
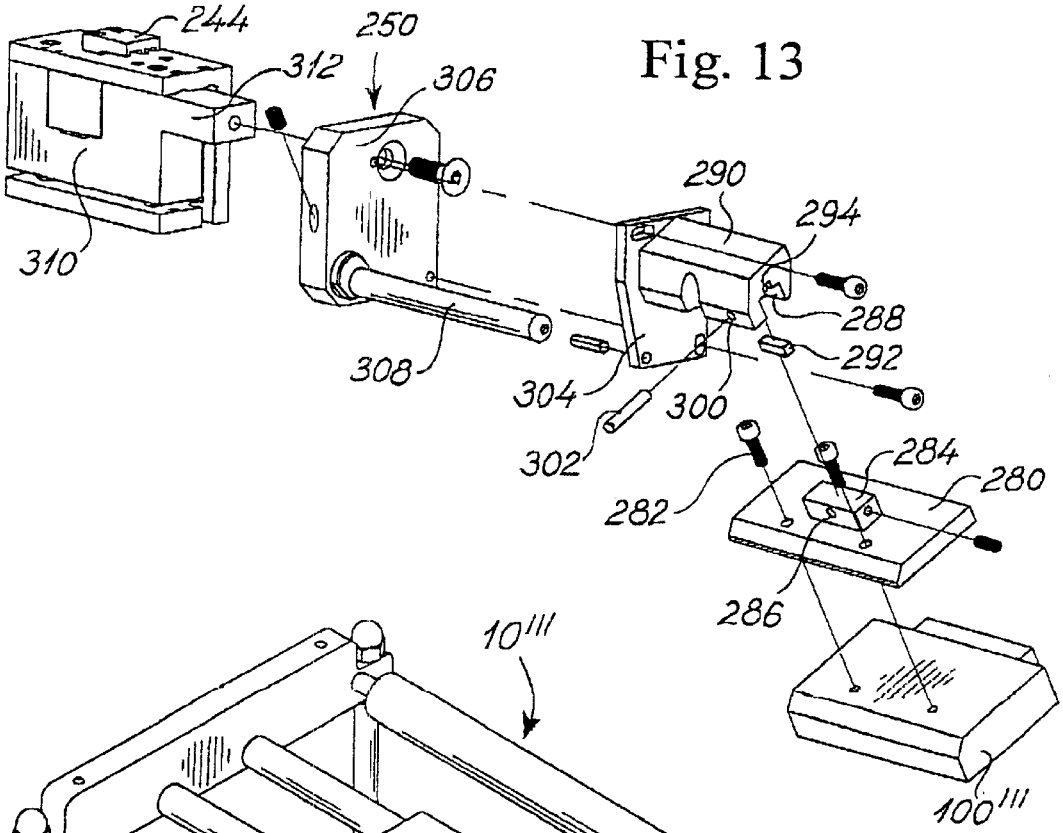
FIG. 13 is an exploded, perspective and schematic view of the printing head assembly of the fourth and presently preferred embodiment of the printing apparatus according to the present invention illustrated in FIGS. 11*a*–11*c* and FIG. 12.

In FIG. 13, the printing head supporting sledge 250 is shown in greater details. The printing head itself is shown in the lower right hand part of FIG. 13 and is mounted to a support plate 280 by means of two bolts 282. This plate 280 is at its top surface provided with a block 284 in which a transversal through-going bore 286 is provided. The block 284 is received within a groove 288 of a further block 290. A particular feature of the structure of the printing head assembly shown in FIG. 13 is the provision of a self-aligning feature which is established by the provision of a small, elongated resilient element preferably a natural rubber block-shaped element 292 which is received within a further groove 294 of the block 290. Transversally relative to the groove 288, a bore 300 is provided in the block 290 for receiving a locking pin 302 which is further to be received within the bore 296 of the block 284. As the plate having the printing head 100''' mounted thereto is fixated relative to the block 290 as the pin 302 is pressfitted into the bore 300 and further fitted into the bore 286, the natural rubber block-shaped element 292 is caused to be slightly compressed, thereby producing a certain pressure on the top surface of the block 284. It is to be realised that the printing head 100''' is to be mounted slightly movable within the supporting structure for allowing the printing head 100''' to accomodate to slight deviations from the intentional horisontal motion of the material onto which printing is to be produced. However, for realigning the printing head 100''' in its original position, the elongated box-shaped rubber element 292 provides the self-aligning feature of repositioning the plate 280 in the overall orientation parallel with the block 290 and in doing so also repositioning the printing head 100''' in its initial position. The block 290 is, as is evident from FIG. 13, fixated to a plate element 304 which is further bolted to a further block element 306 from which a protection pin 308 protrudes. The block 306 is further connected to a body 210 of the sledge structure 250 which body is provided with a protruding part 312 which is received within the aperture 240 for allowing the printing head supporting sledge 250 to move lengthwise as described above with reference to FIG. 11*b* through the rotation of the roller 248.

Figure 14:
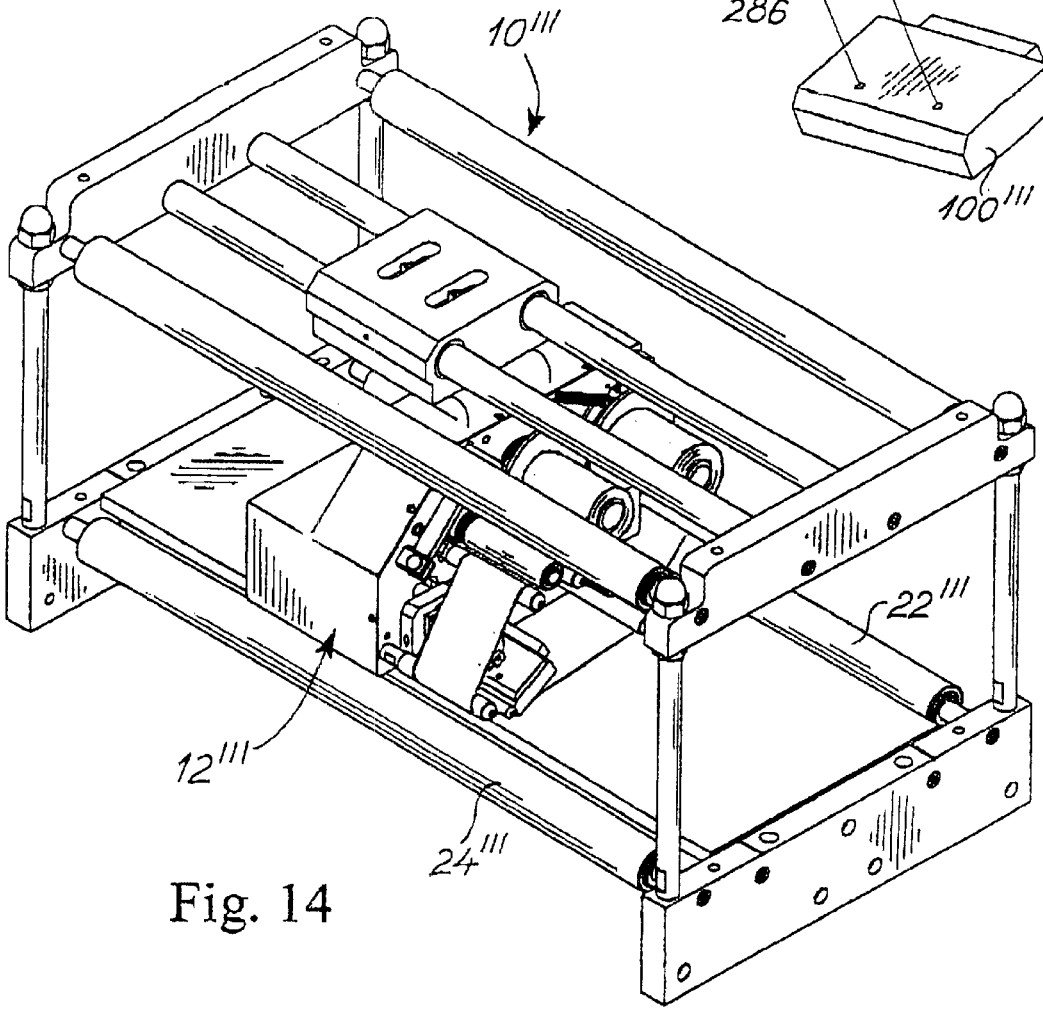
FIG. 14 is a perspective and schematic view of the fourth and presently preferred embodiment of the printing apparatus according to the present invention mounted in a frame of a packaging apparatus or similar apparatus.

In FIG. 14, the fourth and presently preferred embodiment of the printing apparatus 12''' is shown in its intentional application mounted within a frame 400 of a packaging machine. No detailed description of the frame is presented here for the reason that the frame itself constitutes no part of the present invention.

In FIG. 15, a fifth embodiment of the printing apparatus according to the present invention is shown, which fifth embodiment constitutes a modification of the above-described first embodiment of the printing apparatus modified through the easy access technique as described above with reference to the description of the fourth and presently preferred embodiment shown in FIGS. 11*a*–11*c*. The fifth embodiment of the printing apparatus according to the present invention is designated the reference numeral 12 IV in its entirety. In FIG. 15, elements or components identical to elements or components described above with reference to FIGS. 1–6 or 11–14 are designated the same reference numerals, whereas elements or components similar to or serving the purpose as elements or components described above with reference to FIGS. 1–6 and 11–14 are designated the same Figure, however, added the marking IV.

Basically, the fifth embodiment 12 IV constitutes a modification of the above-described first embodiment shown in FIGS. 1–4 by the modification of the part shown in the lower right hand part of FIG. 2 into a part with no mechanical drive elements. As distinct from the part supported by the front plate 56 shown in FIG. 2, the part shown in the lower right hand part of FIG. 15 comprises the front page 56 IV on which four fixed pins 92, 56, 98 and 98 IV are protruding inwardly. The pins 92, 96, 98 and 98 IV are located at the exterior corners of the plate for maintaining the thermo-printing ribbon 130 IV in a stretched position at the outermost edges of the front plate 56 IV. The thermo-printing ribbon 130 IV is received on a supplied bobbin 324 which is to cooperate with the reel or shaft 124 IV of the other part of the apparatus shown in the upper left hand part of FIG. 15. Similarly, a take-up bobbin 332 is to cooperate with the take-up reel or shaft 132 IV of the other part of the apparatus shown in the upper left hand part of FIG. 15.

The part of the apparatus constituted by the front plate 56 IV and the components and elements fixated thereto constitutes a passive part of the apparatus,whereas the remaining part of the apparatus shown in the upper left hand part of FIG. 15 constitutes the active or mechanically driven part of the apparatus.

As distinct from the above-described first embodiment of the printing apparatus shown in FIGS. 1–4, the easy access concept as illustrated in FIG. 15 necessitates that the guiding pins closely encircling the drive roller 128 IV are to be relocated from there active position to an inactive position shown in FIG. 15 in which the pins 97 IV and 99 IV are positioned spaced apart from the drive roller 128 IV. Similarly, for allowing the loading of the ribbon 130 IV by the positioning of the front plate 56 IV in its intentional position in front of the rear plate 54 IV shown in the upper left hand part fo FIG. 15, the printing head 100 is relocated from its operational position shown in phantom line in FIG. 15 to a retracted position shown in solid line in FIG. 100.

The shifting of the pins 97 IV and 99 IV and the shifting of the printing head 100 IV from the active position shown in phantom lines in FIG. 15 to the retracted or easy access position shown in solid line in FIG. 15 are readily accomplished by the provision of a detector, such as the detector 262 detecting the proper position of the handle 260 or alternatively the detector 272 detecting the end position of the printing head supporting sledge 250, both shown in FIG. 11*b* and by means of motion generating means, such as motors, solenoids, push rods, cam followers etc. for generating the shifting of the pins 97 IV and 99 IV and the printing head 100.

Figure 16:
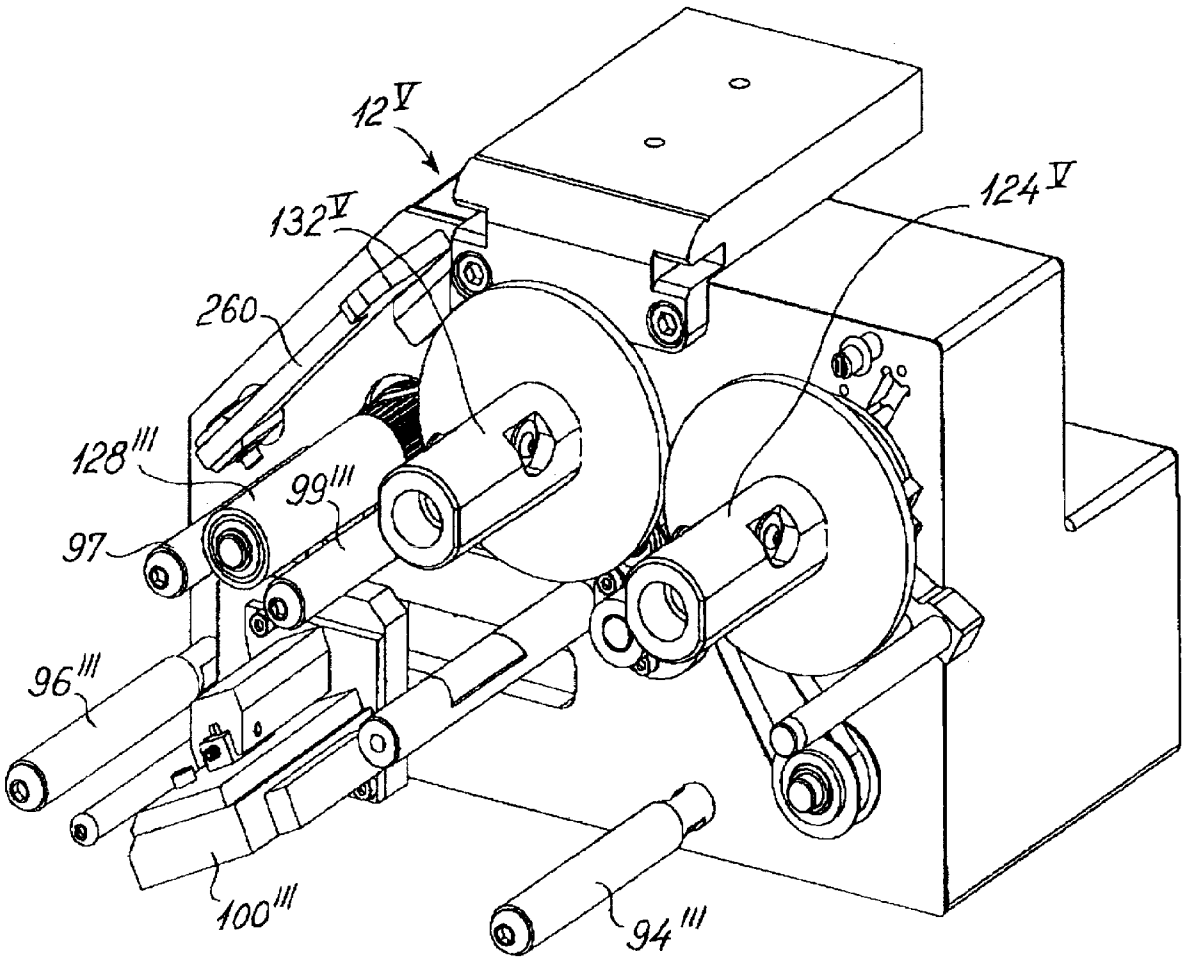
FIG. 16 is a perspective and schematic view similar to the view of FIG. 11*a* of a sixth embodiment of the printing apparatus according to the present invention in a disassembled state disclosing the stationary part of the printing apparatus exclusively.
Figure 18B:
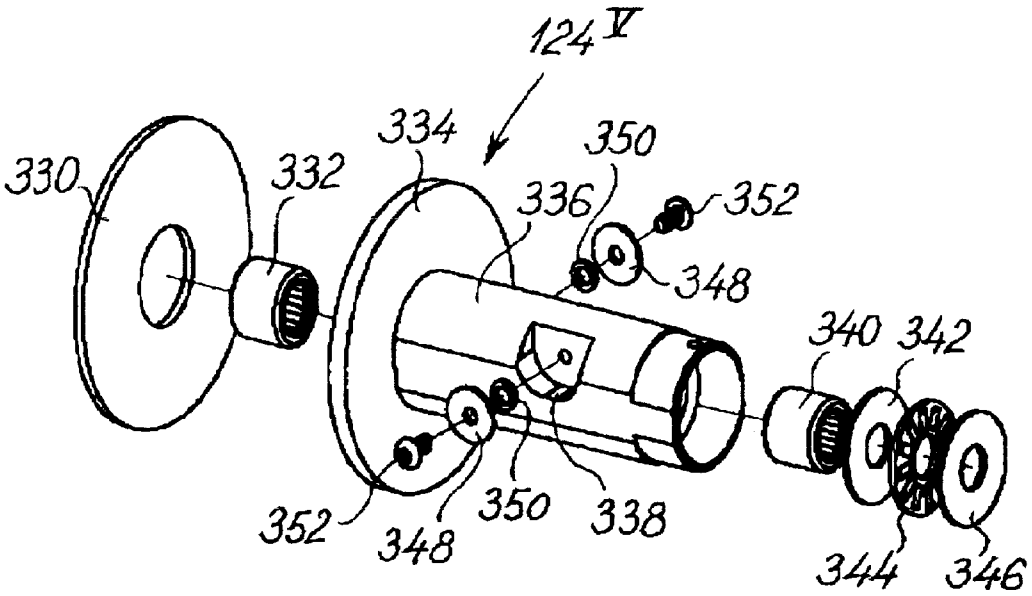
FIGS. 18*a* and 18*b* are a perspective and schematic view, and a perspective, schematic and exploded view, respectively, of a reel or shaft component of the sixth and seventh embodiments of the printing apparatus according to the present invention.

In FIG. 16, a sixth embodiment of the printing apparatus according to the present invention is shown, which sixth embodiment constitutes a modification of the above-described fourth embodiment shown in FIGS. 11*a,* 11*b* and 11*c*. In FIG. 16, components and elements identical to components or elements, respectively, described above with reference to FIGS. 11*a*–11*c* are designated the same reference numerals as used in FIGS. 11*a*–11*c* and no detailed of these components or elements are present in the context. Components or elements serving the same purpose or having the same functionality as components or elements previously described however geometrically or otherwise differing from the previously described components or elements are designated the same reference numerals added the marking V. Basically, the sixth embodiment shown in FIG. 16 differs from the above-described fourth embodiment in that the thermal ribbons supporting cores 124 V and 132 V are configurated differently from the above-described cores 124 III and 132 III as the cores 124 V and 132 V shown in FIG. 16 and also shown in greater details in FIGS. 18*a* and 18*b* provide a self-locking and easily disengaging feature when used in connection with a plastic or cardboard core supporting the thermal printing ribbon.

Figure 18A:
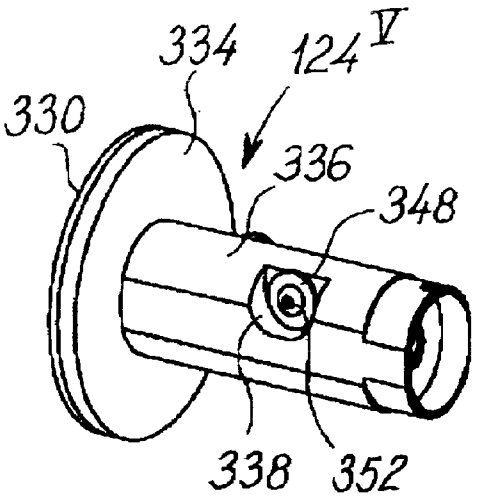

In FIG. 18*a,* the core 124 V which is identical to the core 132 V is shown in greater details in assembled and disassembled or exploded view, respectively. The core 124 V is composed of an annular base plate 330 in which a locking bushing 232 is received. The core 124 V further includes an integral aluminium body including a annular base plate 334 from which a shaft 336 protrudes which shaft is of a slightly conical or outwardly tapering configuration defining an outer open end in which a set of locking elements including a locking bushing 340 two annular plates 342 and 346 and a toothed plate 344 are received. Approximately at the centre of the shaft 336 to recesses are machined one of which is designated the reference numeral 338. Each of the two recesses, one of which is designated the reference numeral 338, defines a plane base plate supporting a locking ring-shaped plate 348 which is positioned on a metal O-ring 350 and fixated relative to the shaft 336 by means of a bolt 352. The ring-shaped locking plate 348 is in the structure shown in FIG. 18*a* allowed to rotate relative to the fixating bolt 352 and is further journalled so as to be allowed to tilt relative to the fixation blot 352. It is to be realised that the two ring-shaped arresting plates 348 are orientated parallel relative to one another and extend in a none-radial orientation from the outer surface of the shaft 336.

The locking or arresting ring-shaped plates 348 serve the purpose of locking a plastic or cardboard core relative to the reel 124 V. The locking is a self arresting locking as the plastic or cardboard core is easily mounted on the shaft 336 due to the rotational journalling of the rotatably journalled ring-shaped locking plates 348. When the plastic or cardboard core is received on the shaft 336, and the reel is rotated clockwise or counterclockwise, and the inner surface of the plastic or cardboard body supporting the thermo-printing ribbon causes the one of the ring-shaped fixation plates 348 to tilt thereby increasing the overall diameter defined by the outer periphery of the ring-shaped locking plate 348 in question, and consequently providing a self-locking of the plastic or cardboard core supporting the thermo printing ribbon relative to the shaft 336.

When the plastic or cardboard core is to be removed, the plastic or cardboard core is simply twisted both ways, i.e. clockwise and counterclockwise relative to the shaft 336 disengaging the two ring-shaped locking plates 348 from their engagement within the inner wall of the plastic or cardboard core and allowing an easy removal of the plastic or cardboard core from the shaft 336. It is to be realised that the conventional arresting assemblies including spring elements or other arresting or locking elements generally suffer from the drawback that the locking is adequate and sufficient in relation to one of the two conventionally used core materials, namely the plastic core or alternatively the cardboard core whereas the fixation is insufficient in relation to the alternative material. Further, in terms of cleaning, the structure of the self-arresting or self-locking core 124 V shown in FIGS. 18*a* and 18*b* is believed to provide a distinct advantage as compared to the conventional core structures in particular since the ring-shaped plates 348 are not including any sharp edges which during a cleaning operation might cause injury to a person cleaning the apparatus.

In FIG. 17, a seventh embodiment of the printing apparatus according to the present invention is shown. The seventh embodiment basically constitutes a modification of the above-described first embodiment of the printing apparatus modified through the use of the reel assemblies 124 V and 132 V shown in FIGS. 18*a* and 18*b* and also in FIG. 16 and further through the provision of a separate step motor for the take-up reel 132 V and the provision of two take-up tensioning pins for each of the two reels 124 V and 132 V constituting the delivery and the take-up reel, respectively. These tensioning pins are designated the reference numerals 125 V and 133 V, respectively. The provision of the two tensioning pins 125 V and 133 V serve the purpose of allowing the printing apparatus to be used at an extremely high production rate up to 1600 mm/s and allowing fast acceleration and fast deceleration of the printing ribbon relative to the plastics foil on which a printing is to be applied without necessitating accelerating the reels 124 V and 132 V and the ribbon material supported thereon which material would necessitate the use of extremely power-consuming motors for the acceleration and deceleration. The take-up reel 132 V is powered by a step motor and the tensioning pin 133 V co-operates with the step motor controlled by the microprocessor included in the electronic circuitry of the apparatus included in the housing 70 shown in FIGS. 1*a,* 1*b* and 11*a*. The programming of the microprocessor of the electronic circuitry allows the apparatus to determine the precise amount of printing ribbon present on the delivery reel 124 V and taking-up by the take-up reel 132 V and at the same time, the angular rotation of the tensioning pin 125 V is monitored by means of an encoder which rotation of the tensioning pin 125 V represents a measure of the motion of the printing ribbon delivered from the delivery reel 124 V and therefore also a measure of the diameter of the delivery reel. Similarly, the rotation of the tensioning pin 133 V in comparison with the speed of the thermo-printing ribbon as determined by the drive roller 128 V, provides information regarding the overall diameter of the material present on the take-up reel 132 V. Based on these measurements of the angular rotation of the tensioning pins 125 V and 133 V, the apparatus informs the operator when a minimum amount of thermo-printing ribbon is present on the delivery reel 124 V and when a maximum diameter of the thermo-printing ribbon is present on the take-up reel 132 V.

The apparatus shown in FIG. 17 further includes a particular reset feature when the apparatus is assembled as the drive roller 128 V is caused to rotate a specific number of rotations corresponding to a specific length of thermo-printing ribbon delivered to the take-up reel 132 V such as a length of 100 mm thermo-printing ribbon and at the same time the step motor powering the take-up reel 132 V is actuated and the number of steps is counted for providing a measure representing the number of rotations or the angle rotated by the take-up reel 132 V and thereby a measure representing the arch rotated by the take-up reel 132 V for taking up, e.g. 100 mm thermo-printing ribbon.

Figure 7:
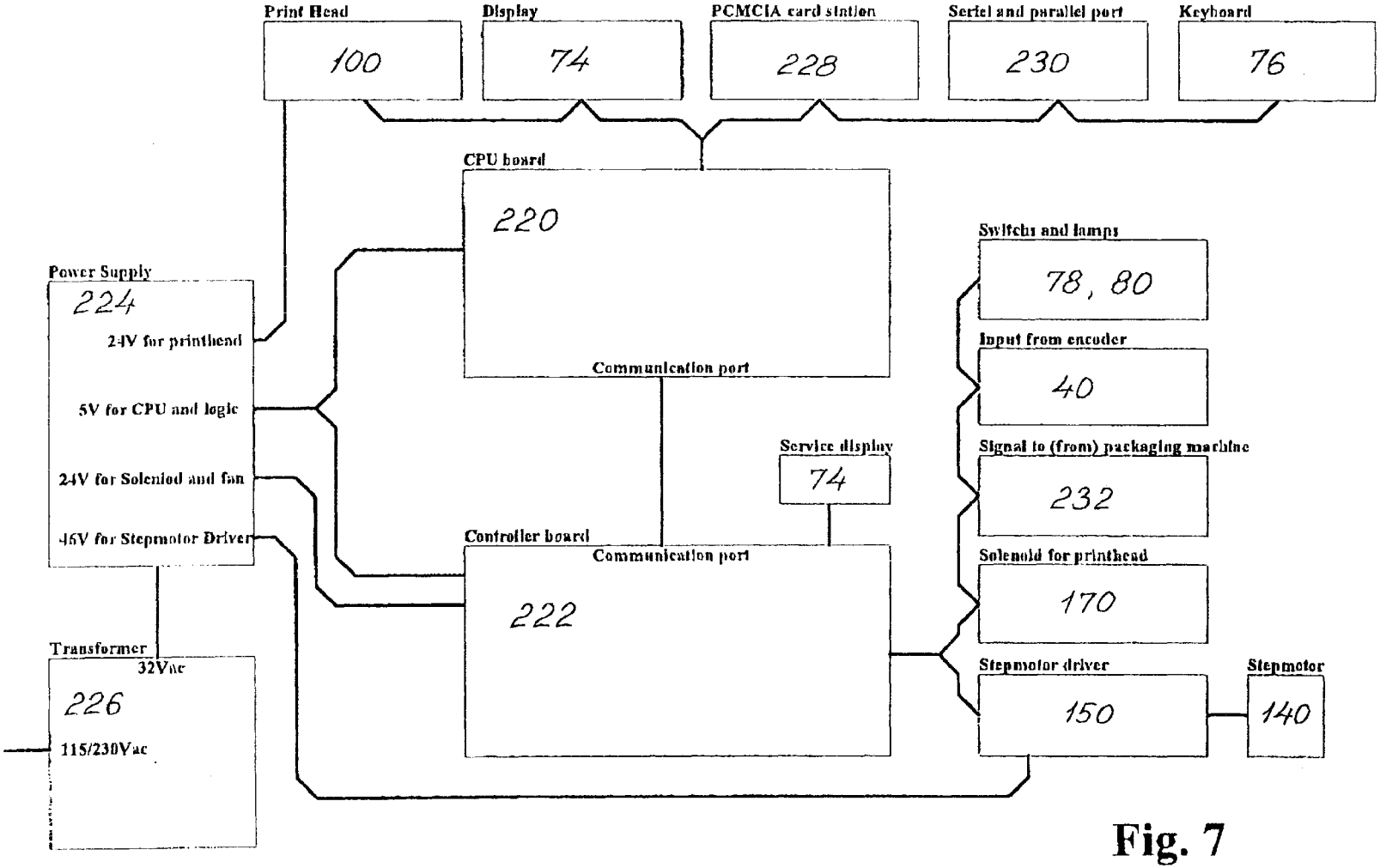
FIG. 7 is a block diagrammatic view of the electronic circuitry of the first embodiment of the printing apparatus shown in FIG. 1, FIGS. 8*a*–8*c* are diagrammatic views illustrating in greater details the electronic circuitry of the first embodiment of the printing apparatus shown in FIG. 1, FIGS. 9*a*–9*q* are flow charts illustrating a first mode of operation of the first embodiment of the printing apparatus shown in FIG. 1, FIGS. 10*a*–10*v* are flow charts illustrating a second mode of operation of the first embodiment of the printing apparatus shown in FIG. 1.

In FIG. 7, the electronic circuitry of the printing apparatus described above with reference to FIGS. 1–4 and 11–17 is shown in block diagrammatic view. The electronic circuitry includes centrally a CPU-board 220 communicating with a controller board 222 and also communicating with a power supply block 224. The power supply block receives electric power from a transformer 226 which is further connected to the mains supply, i.e. a 115 V, 60 Hz or a 230 V, 50 Hz mains supply. The electronic circuitry further includes blocks identifying the printer head 100, the display 74, a PCMCIA card station block 228, a serial and parallel port block 230 and the keyboard 76.

These blocks all communicate with the CPU board 220. Similarly, the controller board 222 communicates with a block constituting the display 74, the indicators and lamps 78 and 80, respectively, and also the detector 180. The controller board 222 communicates with the above described peripheral element illustrated by a block identifying the foil motion detector or encoder 40, the solenoid 170 for actuating the printing head 100 and the control circuit 150 for controlling the motor 140. An additional block 232 is provided for establishing communication to an external detector concerning the state of operation of the packaging machine or for controlling the shift of printing from one specific print to another alternative printing, or for modifying the printing on any arbitrary basis, such as a counter-based modification, a time-based modification, or even a modification of the printing based on an external input entity.

Figure 8A:
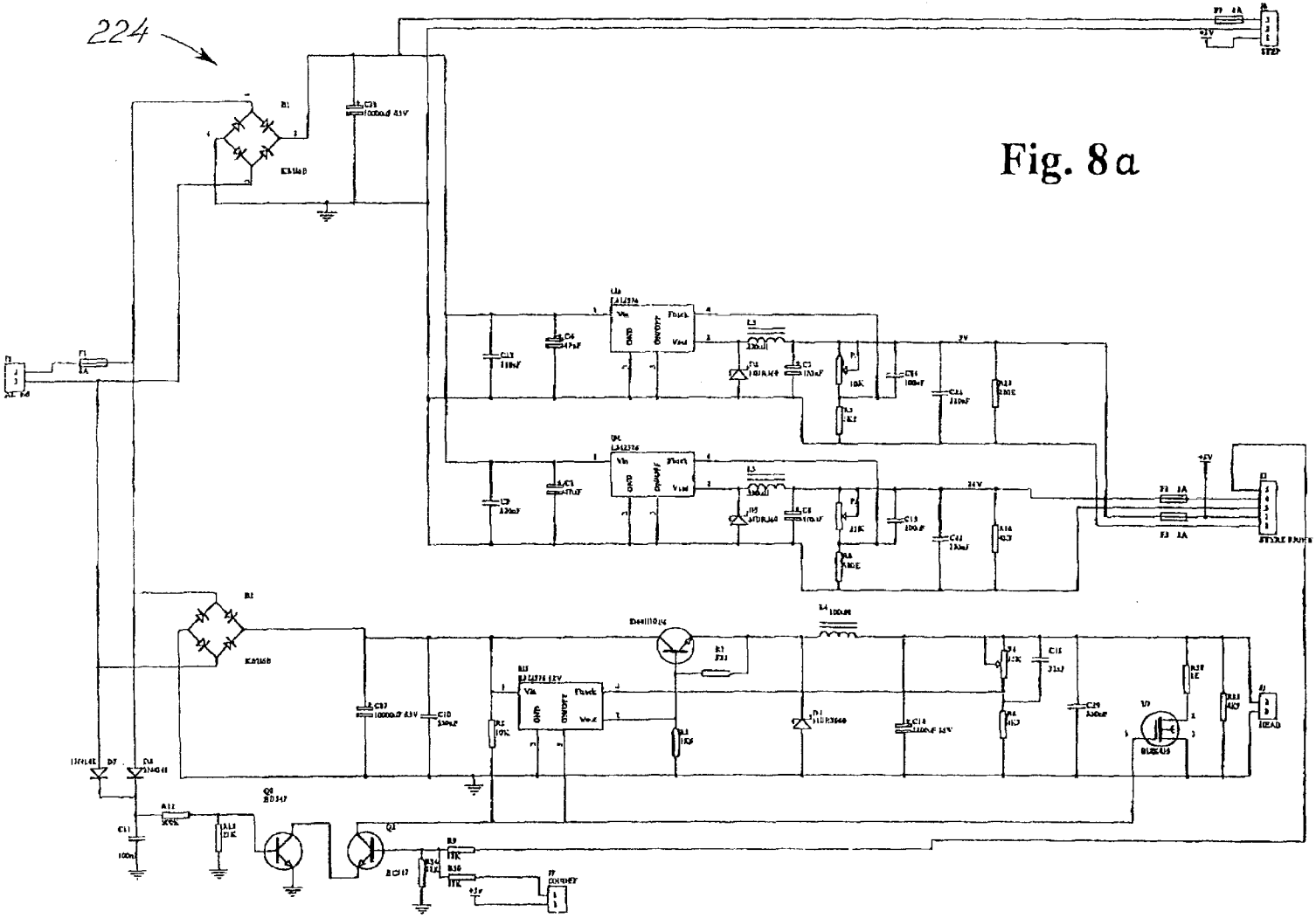
Figure 8B:
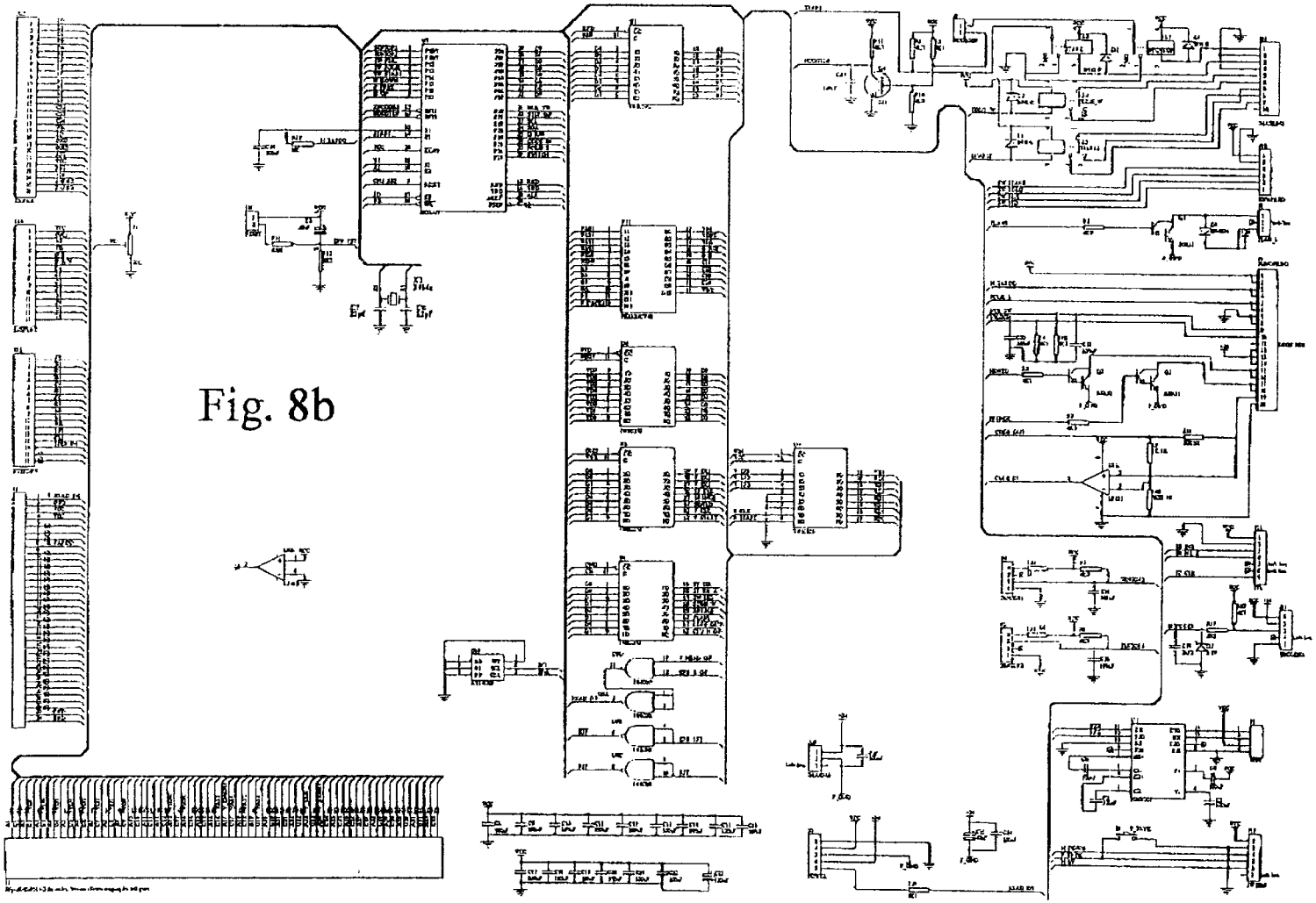
Figure 8C:
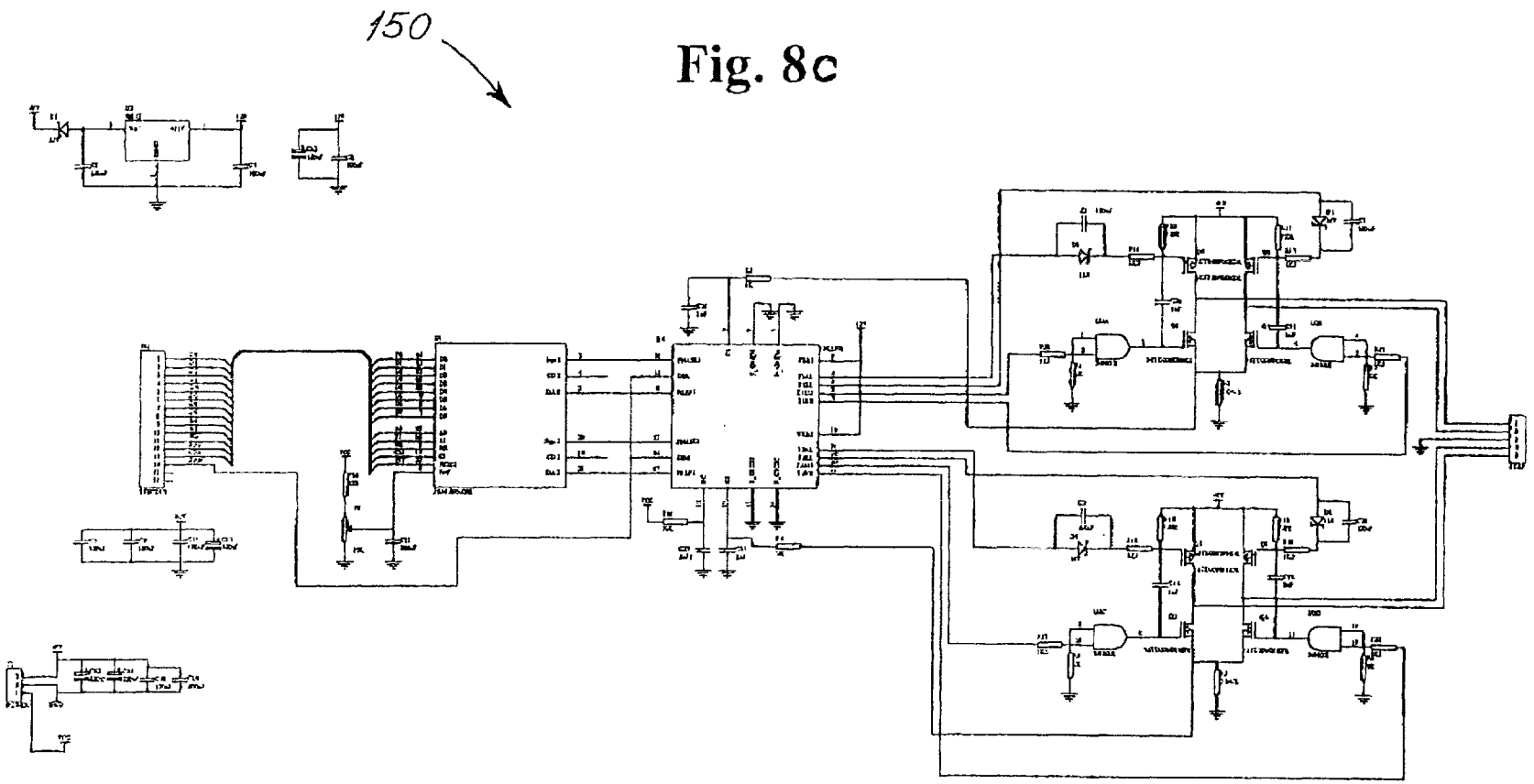

In FIGS. 8*a*–8*c,* the electronic circuitry of the printing apparatus 10 is illustrated in greater detail. The circuit diagrams are believed to be self-explanatory and no detailed discussion of the electronic circuitry is presented as the diagrams solely serve the purpose of illustrating the presently preferred implementation or embodiment of the electronic circuitry of the first and presently preferred embodiment of the printing apparatus 10 according to the present invention. FIG. 8*a* illustrates the power supply block 224, FIG. 8*b* illustrates the electronic circuitry of the controller board 22, FIG. 8*c* illustrates the electronic circuitry of the motor driver circuitry included in the electronic circuit board 150.

Example

The electronic circuitry of the above described embodiments of the printing apparatus according to the present invention was implemented in a prototype embodiment as follows, including the components identified in FIGS. 8*a*–8*c*.

The transformer block 226 included a 230 V/32 V transformer. The power supply block 224 included a rectifier for rectifying 32 V AC to 46 V DC and further three switch mode regulators of the type LM2576 for producing two 24 V DC and one 5 V DC supply outputs. One of the 24 V DC outputs was amplified by a transistor for providing a 10 A output current capacity. The step motor driver circuit included in the printed circuit board 150 was supplied by the 46 V DC, the solenoid circuits were supplied by 24 V and the CPU analogical circuits were supplied by 5 V DC. The printing head was a 2 inch (51.2 mm) corner edge printing head of the type Delta V2.00 supplied from the Japanese company Kyocera. The display 74 was of the type mdls24265-lv-led04 including two times 24 characters. The PCMCIA station was adapted to operate on two boards of the type sram from 256 Kbyte to 2 Mbyte. The serial and parallel ports were constituted by a parallel standard centronic parallel port, and a serial standard RS232 serial port, respectively, adapted for 2400 baud to 19200 baud operation.

The keyboard 74 was a softkey keyboard including a numeric keyboard also including directional arrow keys for programming the printing apparatus. The CPU board 220 was a conventional label printer printing board, however, including modified software for complying with the requirements of the printing apparatus. The CPU board was connected as described above to the blocks and elements illustrated in FIG. 7. The controller board block 222 was configured around an Atmel 89C52 chip and connected as and configured and interconnected to the various blocks and elements illustrated in FIG. 7. The motor 140 was a Vexta PH266-E1.2, 200 steps per revolution step motor. The motor driver circuit was constituted by a step motor driver circuit implemented by PBM3960 and PBL3770 integrated circuits supplied from Ericsson Electronics and was further implemented in accordance with the electronic circuit illustrated in FIG. 8*c*.

Figure 9C:
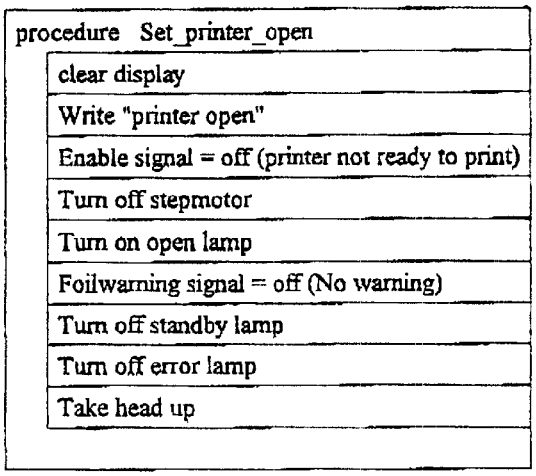
Figure 9D:
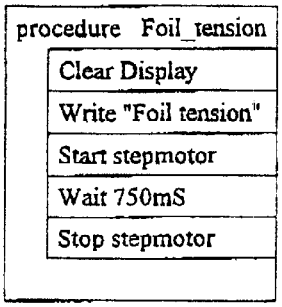

In FIGS. 9*a*–9*q,* a first mode of the operation of the printing apparatus 10 described above with reference to FIGS. 1–4 and FIGS. 11–15 is illustrated in an overall flow chart illustrated in FIGS. 9*a* and 9*b* and individual sub-flow charts illustrated in FIGS. 9*d*–9*q*. The flow charts are believed to be self-explanatory and no detailed discussion of the flow charts is being presented, apart from the below listing of the various sub-flow charts illustrated in FIGS. 9*d*–9*q:*

Figure 9E:
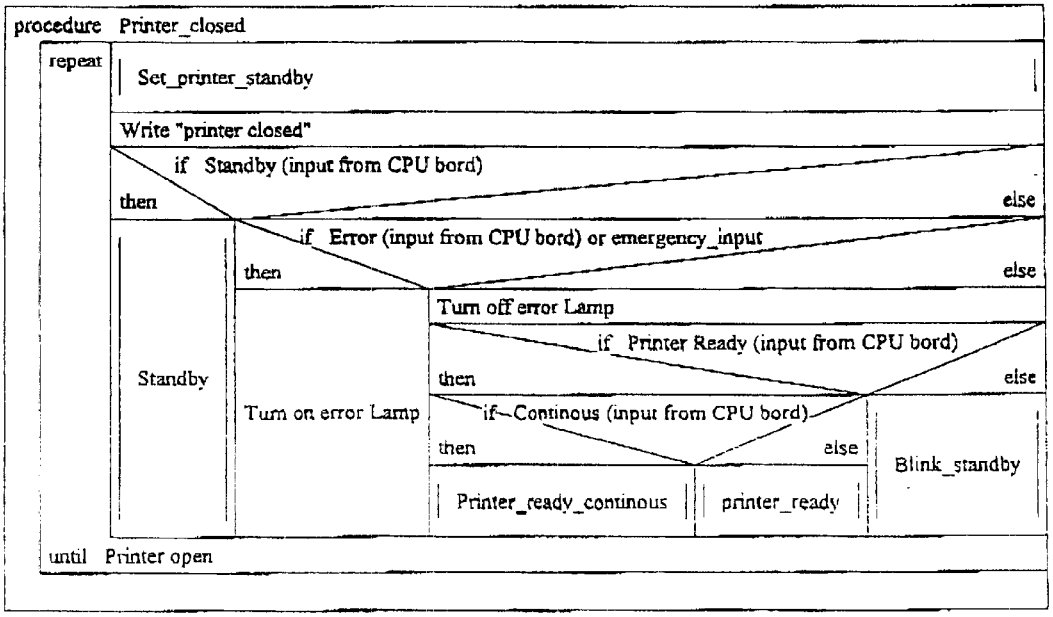
Figure 9F:
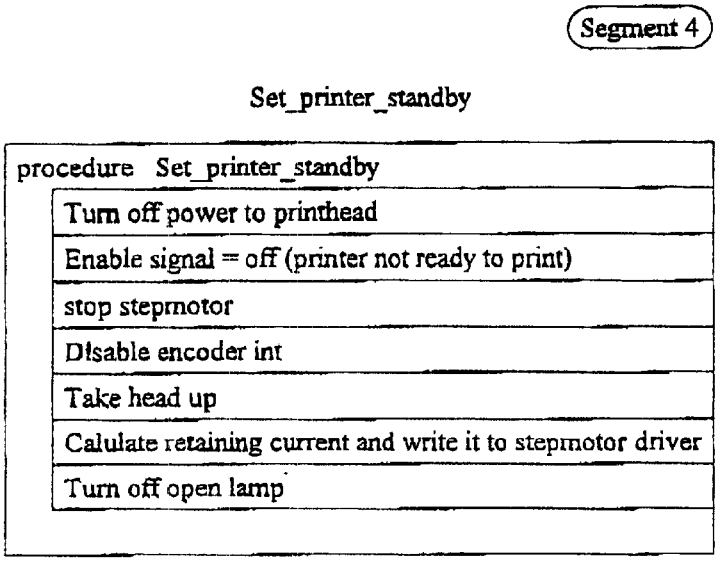
Figure 9G:
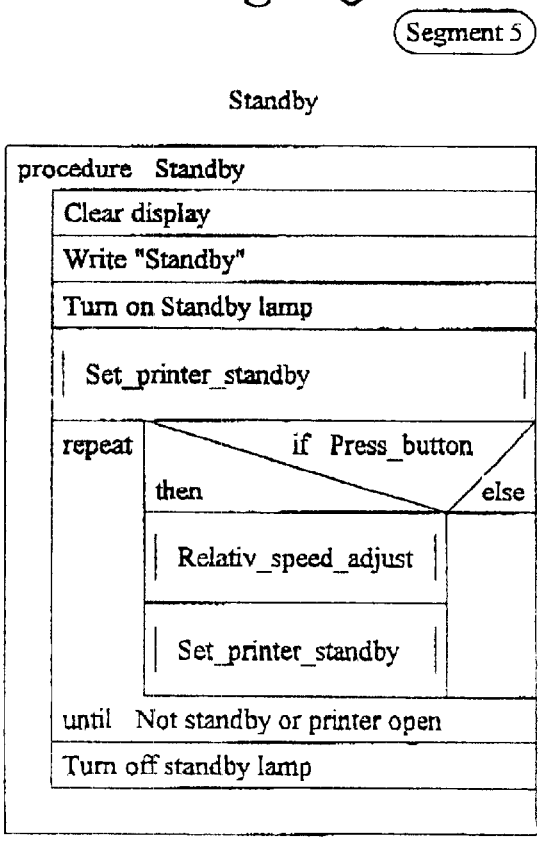
Figure 9H:
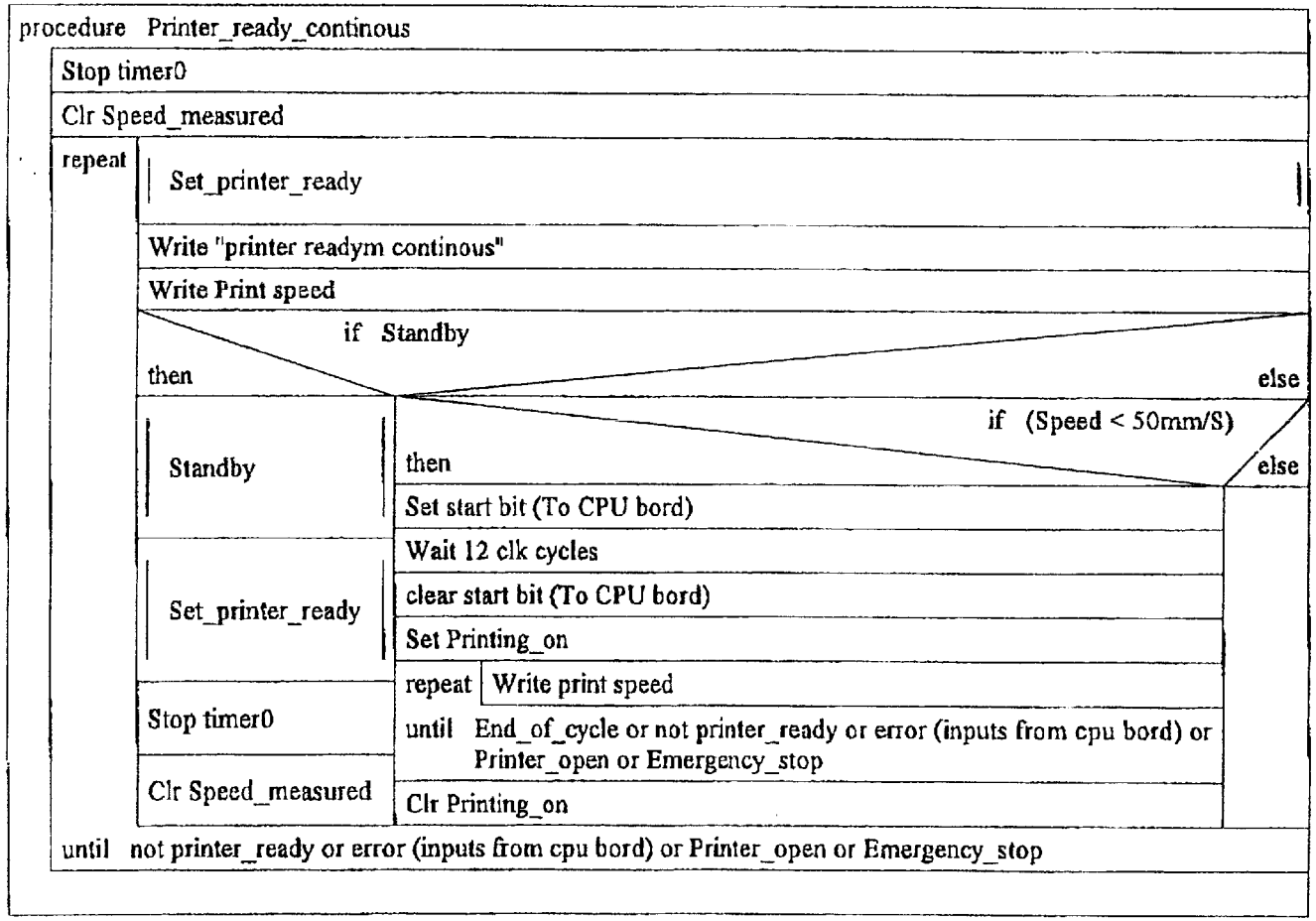
Figure 9J:
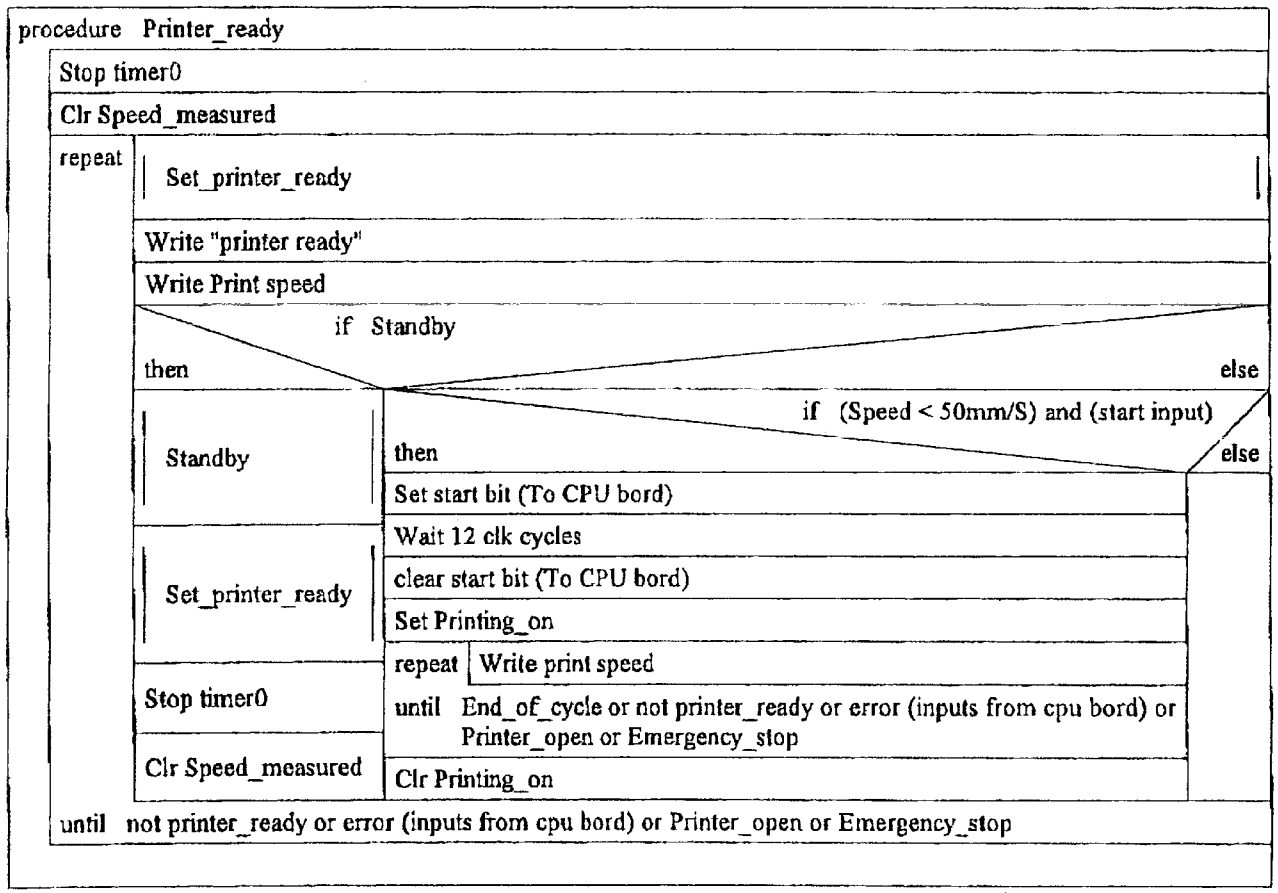
Figure 9J:
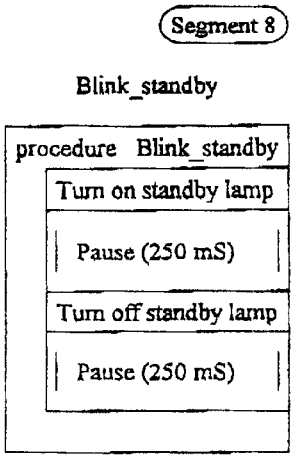
Figure 9K:
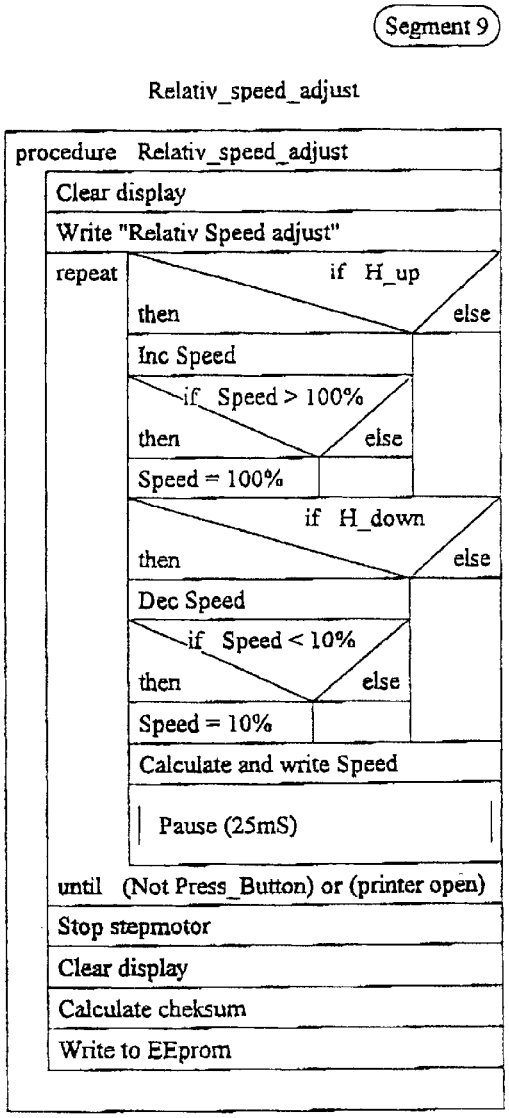
Figure 9L:
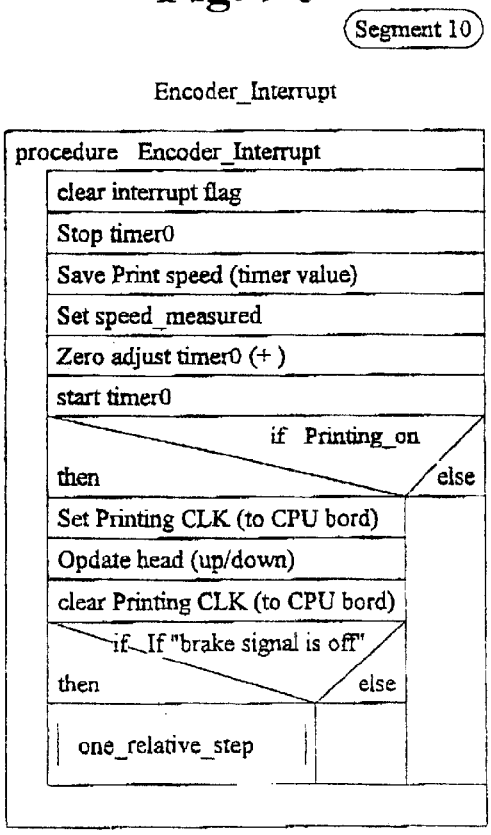

FIG. 9*c* illustrates Segment 1 of the overall flow chart of FIGS. 9*a* and 9*b*, Set printer.
FIG. 9*d* illustrates Segment 2, Foil tension.
FIG. 9*e* illustrates Segment 3, Printer closed.
FIG. 9*f* illustrates Segment 4, Set printer stand-by.
FIG. 9*g* illustrates Segment 5, Stand-by.
FIG. 9*h* illustrates Segment 6, Printer ready continuous.
FIG. 9*i* illustrates Segment 7, Printer ready.
FIG. 9*j* illustrates Segment 8, Blink stand-by.
FIG. 9*k* illustrates Segment 9, Relative speed adjust.
FIG. 9*l* illustrates Segment 10, Encoder interrupt.
FIG. 9*m* illustrates Segment 11, Step motor interrupt.
FIG. 9*n* illustrates Segment 12, Pause.
FIG. 9*o* illustrates Segment 13, Set printer ready.
FIG. 9*p* illustrates Segment 14, Set-up div.
FIG. 9*q* illustrates Segment 15, One relative step.

Figure 10F:
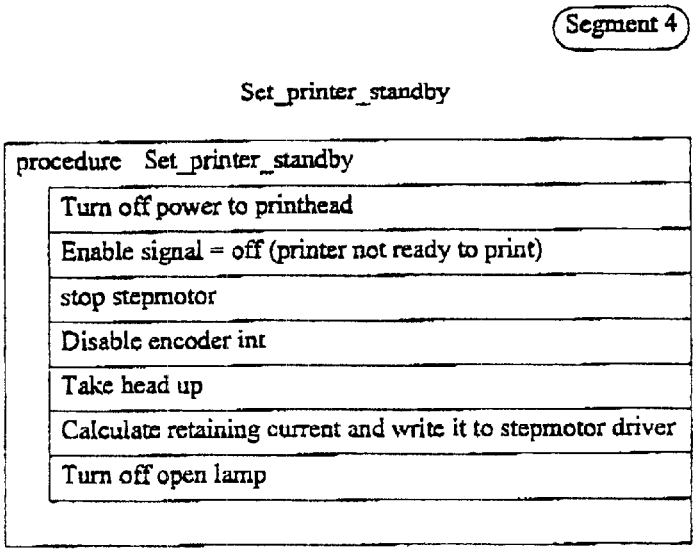
Figure 10G:
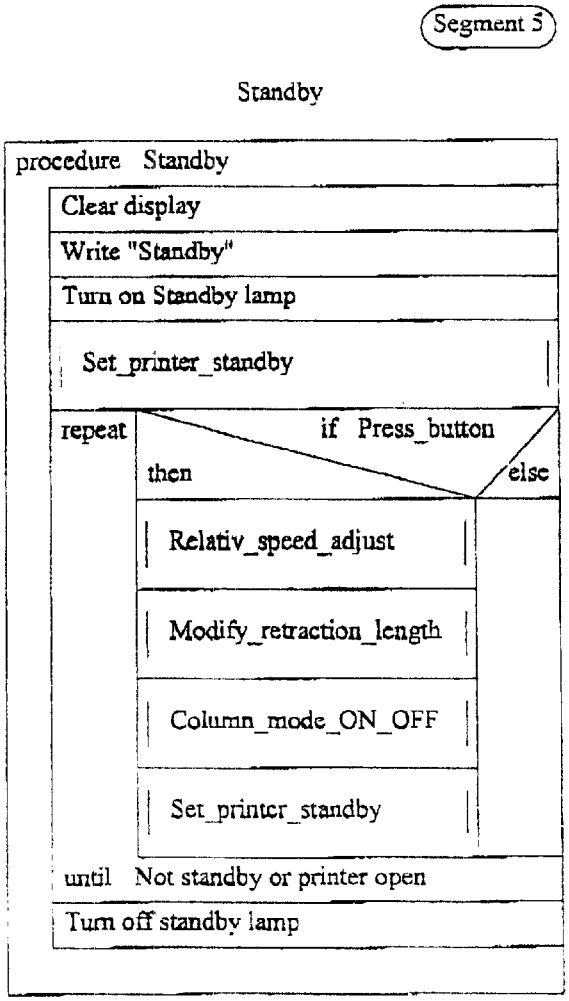
Figure 10H:
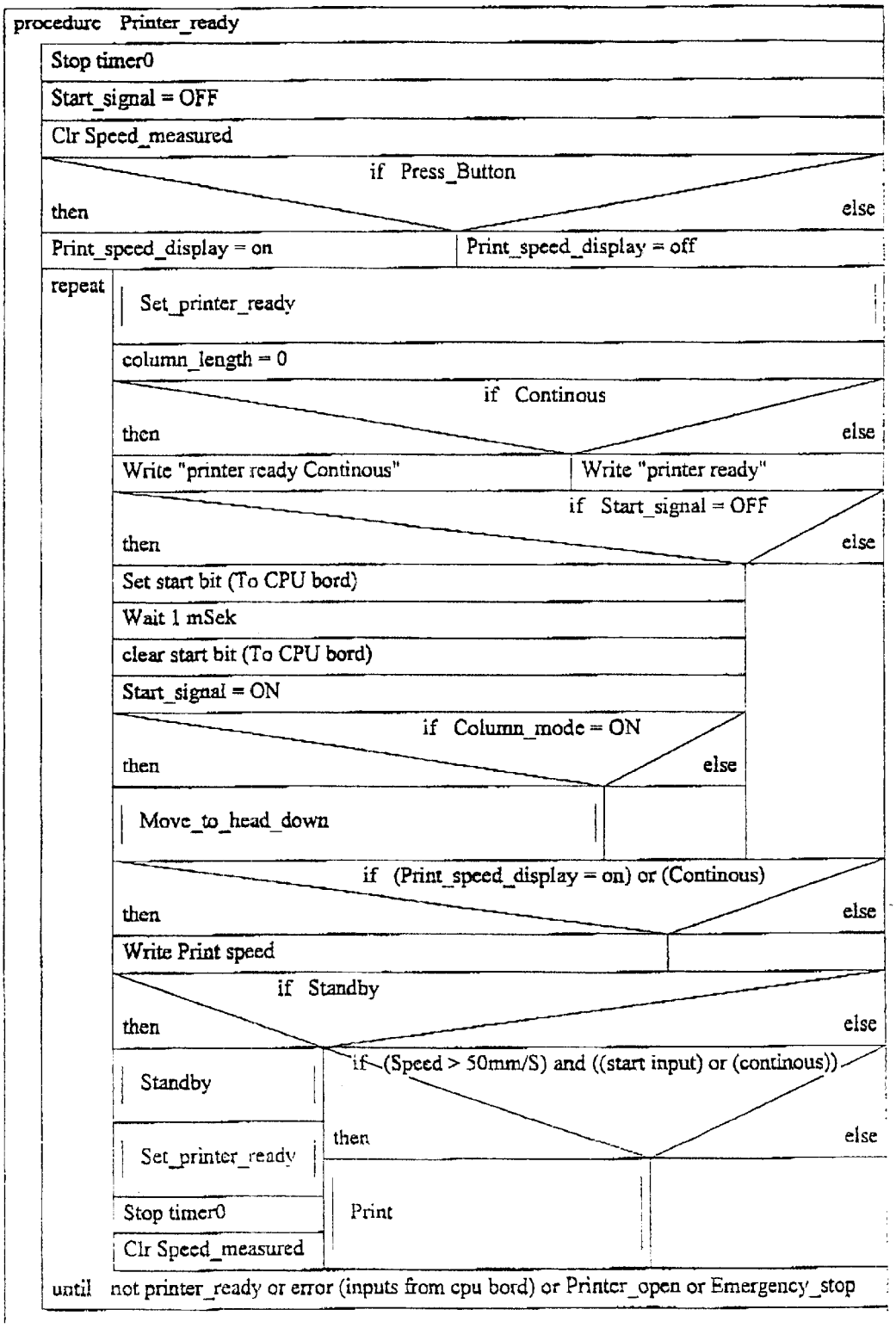
Figure 10I:
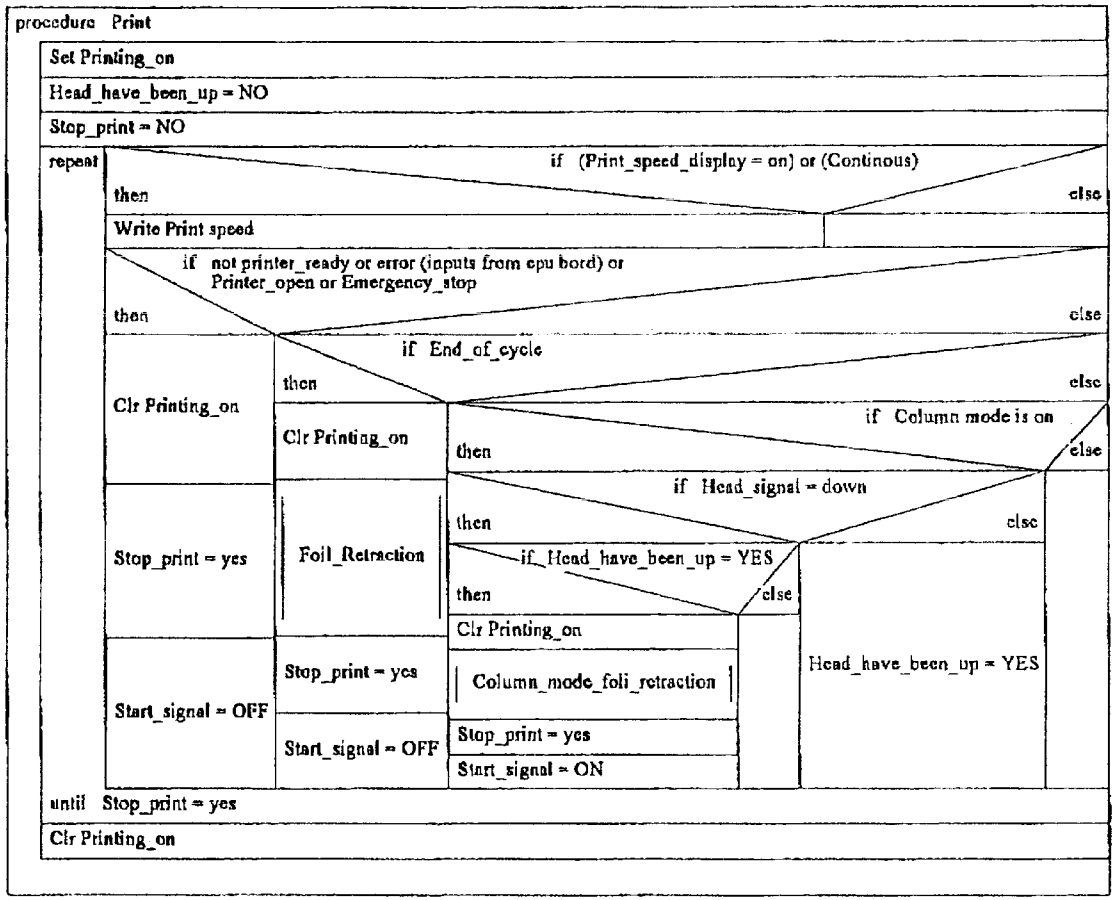
Figure 10J:
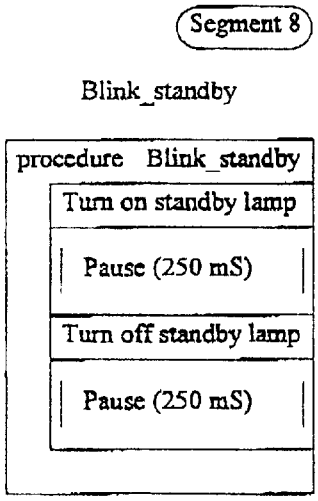
Figure 10K:
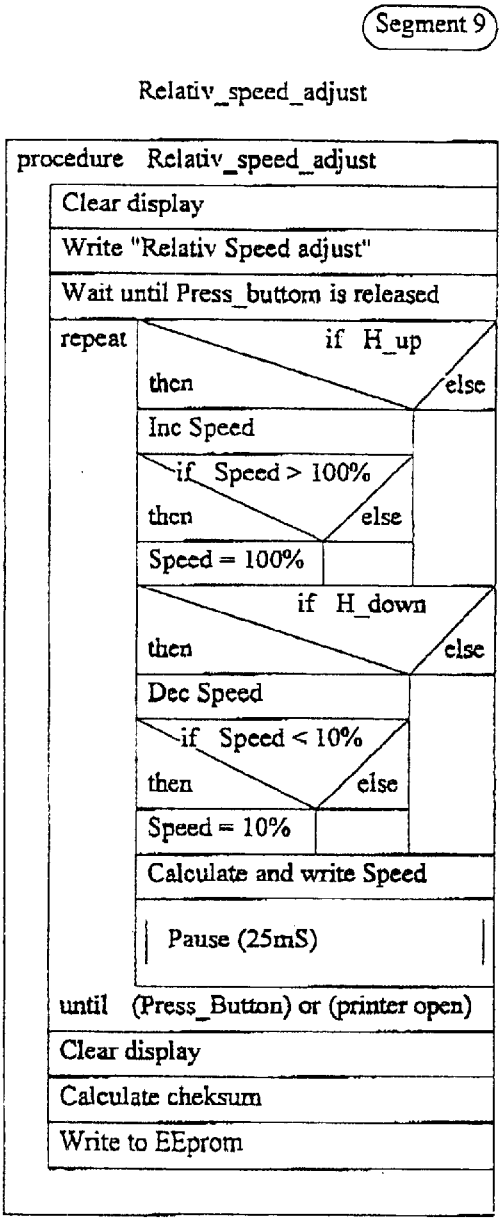
Figure 101:
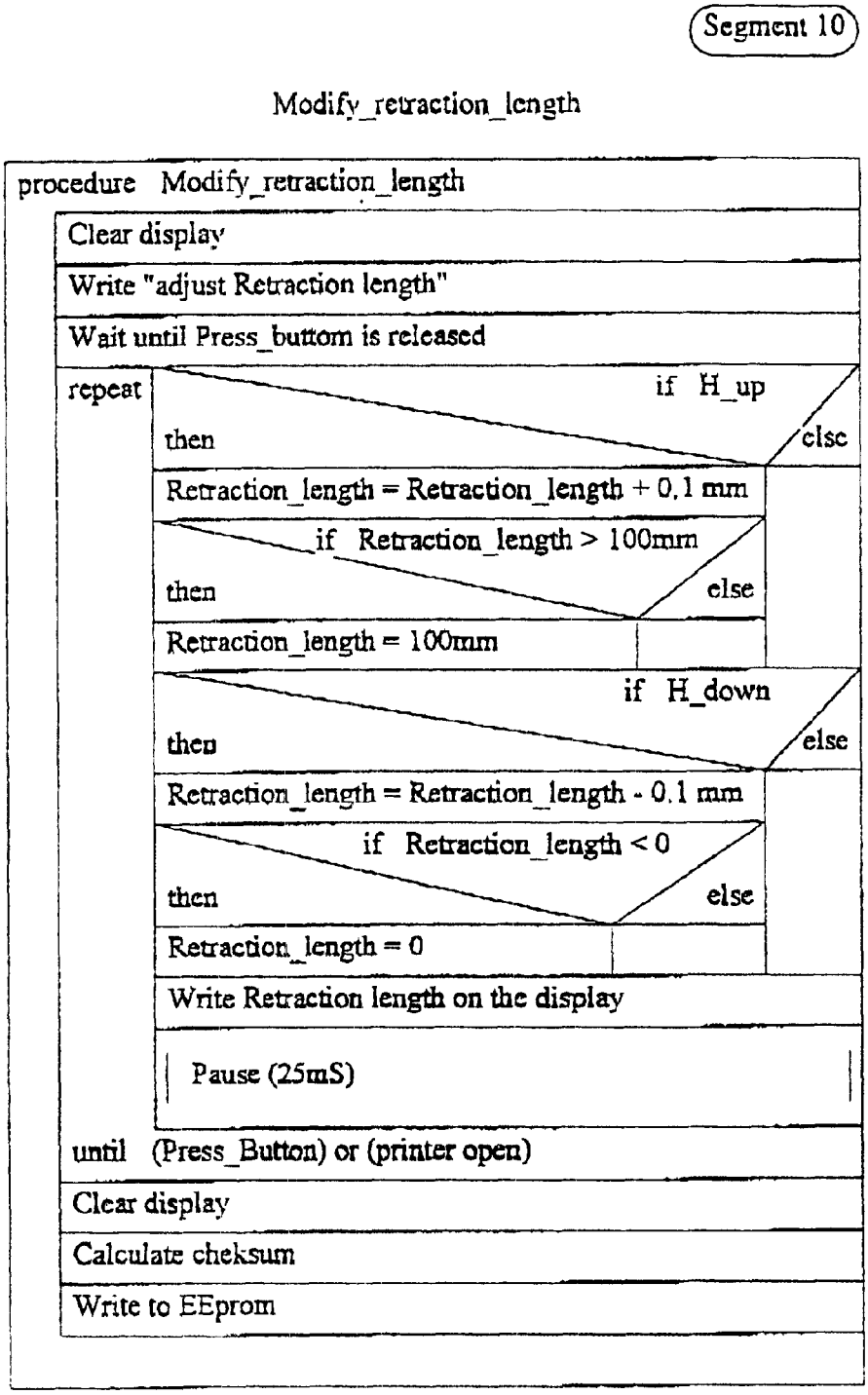
Figure 10M:
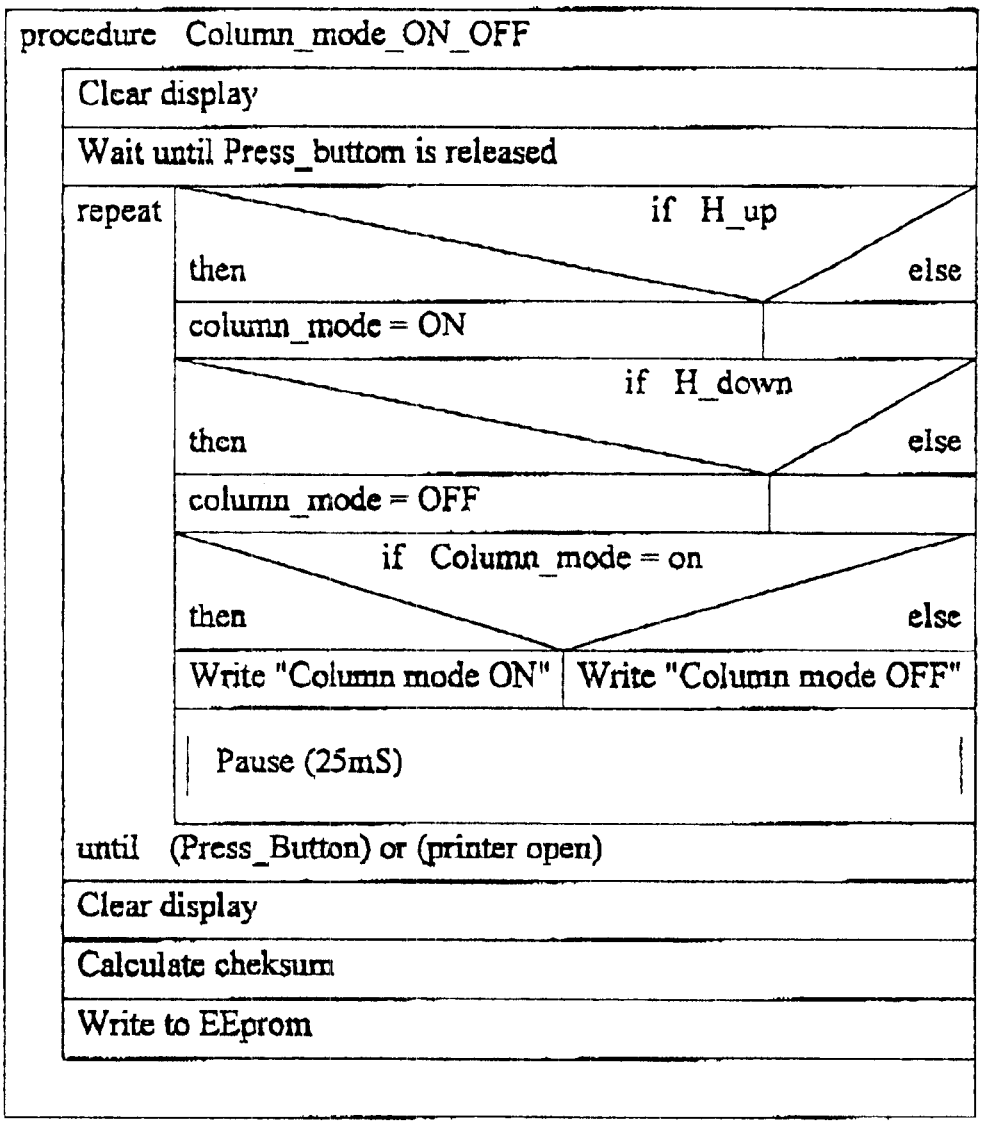
Figure 10N:
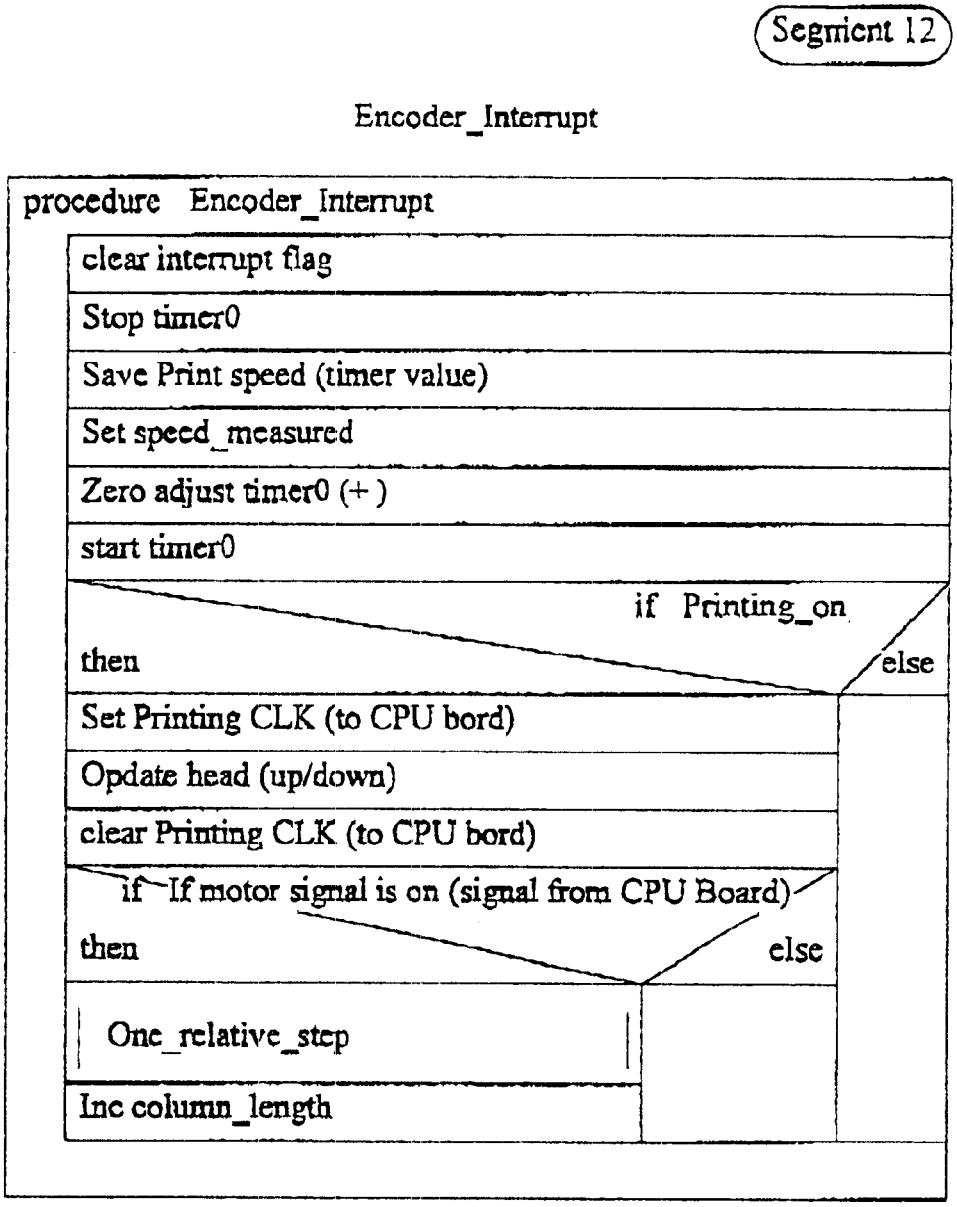
Figure 10O:
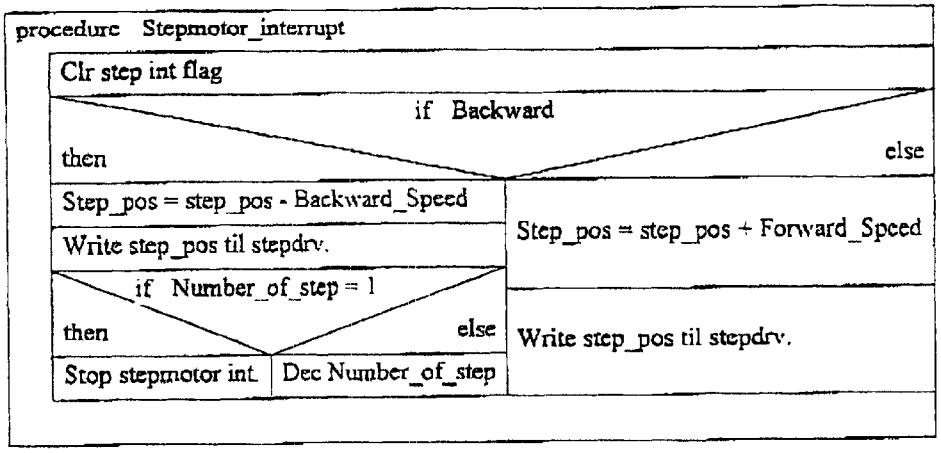
Figure 10Q:
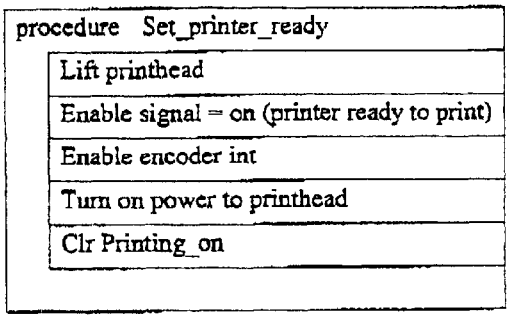
Figure 10P:
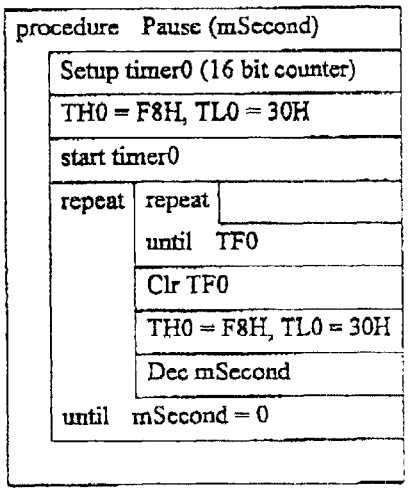
Figure 10R:
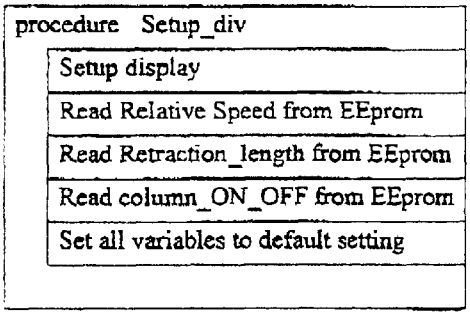

In FIGS. 10*a*–10*v* a second mode operation of the printing apparatus 10 described above with reference to FIGS. 1–4 and FIGS. 11–15 is illustrated in an overall flow chart illustrated in FIGS. 10*a* and 10*b* and in individual sub-flow charts illustrated in FIGS. 10*d*–10*v*. Like the above described flow charts illustrated in FIGS. 9*a*–9*q*, the flow charts illustrated in FIGS. 10*a*–10*v* are believed to be self-explanatory and no detailed discussion of the flow charts is being presented, apart from the below listing of the various sub-flow charts illustrated in FIGS. 10*d*–10*v*:

FIG. 10*c* illustrates Segment 1 of the overall flow chart of FIGS. 10*a* and 10*b*, Set printer up.
FIG. 10*d* illustrates Segment 2, Foil tension.
FIG. 10*e* illustrates Segment 3, Printer closed.
FIG. 10*f* illustrates Segment 4, Set printer stand-by.
FIG. 10*g* illustrates Segment 5, Stand-by.
FIG. 10*h* illustrates Segment 6, Printer ready continuous.
FIG. 10*i* illustrates Segment 7, Printer ready.
FIG. 10*j* illustrates Segment 8, Blink stand-by.
FIG. 10*k* illustrates Segment 9, Relative speed adjust.
FIG. 10*l* illustrates Segment 10, Modify retraction length.
FIG. 10*m* illustrates Segment 11, Column mode ON-OFF.
FIG. 10*n* illustrates Segment 12, Encoder interrupt.
FIG. 10*o* illustrates Segment 13, Stepmotor interrupt.
FIG. 10*p* illustrates Segment 14, Pause.
FIG. 10*q* illustrates Segment 15, Set printer ready.
FIG. 10*r* illustrates Segment 16, Setup div.
FIG. 10*s* illustrates Segment 17, One relative step.
FIG. 10*t* illustrates Segment 18, Move to head down.
FIG. 10*u* illustrates Segment 19, Foil retraction.
FIG. 10*v* illustrates Segment 20, Column mode foil retraction.

The above flow charts illustrating the mode of operation of the printing apparatus may of course be modified in numerous ways through elimination of a specific sub-flow chart corresponding to a specific operation or through combining the sub-flow charts illustrated in FIGS. 9*a*–9*q* with one or more of the sub-flow charts illustrated in FIGS. 10*c*–10*v* or vice versa corresponding to the combination of specific operations illustrated in FIG. 9 with specific illustrations illustrated in FIG. 10 or vice versa.

Like the possible combination of the various routines of the modes of operation illustrated in FIGS. 9*a*–9*q* and in FIGS. 10*a*–10*v*, the above described embodiments may of course also be modified through the elimination of specific elements provided a specific embodiment is to be implemented allowing only specific individual routines of the overall mode of operation illustrated in FIGS. 9*a* and 9*q* and in FIGS. 10*a* and 10*v* or alternatively, the above described embodiments may be combined through combining elements from the second or third embodiment illustrated in FIGS. 5*a*–5*c* and FIG. 6, respectively, with the first embodiment illustrated in FIGS. 1–4 and FIGS. 11–15 or alternatively combining elements from the first embodiment illustrated in FIGS. 1–4 and FIGS. 11–15 with the second or third embodiment illustrated in FIGS. 5*a*–5*c* and FIG. 6, respectively or further alternatively combining elements from the first embodiment illustrated in FIGS. 1–4 and FIGS. 11–15 with the fourth or fifth embodiments illustrated in FIGS. 11–12 and FIG. 15, respectively. Of course, the second or third embodiments illustrated in FIGS. 5*a*–5*c* and FIG. 6 may also be combined in numerous ways obvious to a person having ordinary skill in the art for deducing a specific printing apparatus complying with specific requirements as to fulfilling certain operational requirements.

Although the present invention has been described above with reference to different, presently preferred embodiments of the apparatus and the method of producing printings by the thermo-transfer technique as discussed above, the invention is by no means to be construed limited to the above described embodiments, as numerous modifications are deduceable by a person having ordinary skill in the art, without still deviating from the spirit and aim of the present invention as defined in the appending claims.

What is claimed is:

1. A thermal printer for producing a printing on the surface of a foil in an ink transfer operation, comprising:

means for supplying said foil to said thermal printer, a thermal transfer ribbon including an ink which is transferable in said ink transfer operation at specific locations of said thermal transfer ribbon by heating said specific locations to an elevated temperature causing said ink to be fluid, means for arranging said thermal transfer ribbon in facial contact with said surface of said foil, energizable printing means for heating said specific locations of said thermal transfer ribbon to said elevated temperature in said ink transfer operation, means for energizing said energizable printing means, means for moving said energizable printing means towards said foil so as to sandwich said thermal transfer ribbon therebetween in a constrained state and for moving said energizable printing means away from said foil, said means for moving said energizable printing means towards and away from said foil including an actuator means, means for moving said foil and said energizable printing means relative to one another at a specific speed while pressing said energizable printing means and said foil together and while energizing said energizable printing means, and means for moving said thermal transfer ribbon relative to said energizable printing means for causing said ink of said thermal transfer ribbon to be transferred at said specific locations to said foil at specific areas thereof constituting said printing, said thermal transfer ribbon being delivered from a delivery reel to a first spring biased tensioning pin, being moved past said energizable printing means to a second spring biased tensioning pin and being received by a take-up reel, said means for moving said thermal transfer ribbon relative to said energizable printing means including a roller driven by a motor, and said first and second tensioning pins serving the purpose of allowing said thermal transfer ribbon to be accelerated or decelerated without simultaneously accelerating or decelerating, respectively, said delivery and take-up reels.

2. The thermal printer according to claim 1, wherein said means for moving said thermal transfer ribbon further including guide pins for guiding said thermal transfer ribbon past said energizable printing means.

3. The thermal printer according to claim 1, including a supporting structure, said energizable printing means being pivotably mounted in said supporting structure for allowing said energizable printing means to pivote transversally relative to said specific direction of motion of said thermal transfer ribbon, said supporting structure including a biasing element for biasing said energising printing means in said pivotable mounting towards a specific initial position for self-aligning said energizable printing means in said specific initial position.

4. The thermal printer according to claim 1, wherein said biasing means being constituted by a spring element selected from the group consisting of a helical coil, a spiral coil, a resilient spring element and a resilient rubber spring element.

5. The thermal printer according to claim 1, further comprising a control means for controlling said means for supplying said foil to said thermal printer, said means for arranging said thermal transfer ribbon in facial contact with said surface of said foil, said energizable printing means, said means for energizing said energizable printing means, said means for pressing said energizable printing means and said foil together, said means for moving said foil and said energizable printing means relative to one another, and means for moving said thermal transfer ribbon relative to said energizable printing means.

6. The thermal printer according to claim 1, wherein said energizable printing means being constituted by a printing head including individual energizable printing elements.

7. The thermal printer according to claim 6, wherein said energizable printing elements of said printing head being arranged at a mutual spacing of 0.05 mm–1 mm.

8. The thermal printer according to claim 1, wherein said energizable printing means being stationary and said means for moving said foil and said energizable printing means relative to one another causing said foil to move relative to said energizable printing means in a continuous motion and said means for moving said thermal transfer ribbon relative to said energizable printing means at a reduced speed as compared to said specific speed of said foil relative to said energizable printing means and consequently moving said thermal transfer ribbon relative to said foil for causing said ink of said thermal transfer ribbon to be transferred at said specific locations to said foil at specific areas thereof constituting said printing so as to smear said ink of said thermal transfer ribbon at said specific locations onto said foil through said motion of said thermal transfer ribbon relative to said foil while said energizable printing means are heated during said ink transfer operation and keeping said thermal transfer ribbon stationary relative to said energizable printing means while said energizable printing means are not heated.

9. The thermal printer according to claim 8, wherein said specific speed is 50–1,600 mm/sec, while said reduced speed constitutes 20–98% of said specific speed.

10. The thermal printer according to claim 1, wherein said energizable printing means being stationary and said means for moving said foil and said energizable printing means relative to one another causing said foil to move relative to said energizable printing means in a continuous motion and said means for moving said thermal transfer ribbon relative to said energizable printing means at a reduced speed as compared to said specific speed of said foil relative to said energizable printing means and consequently moving said thermal transfer ribbon relative to said foil for causing said ink of said thermal transfer ribbon to be transferred at said specific locations to said foil at specific areas thereof constituting said printing so as to smear said ink of said thermal transfer ribbon at said specific locations onto said foil through said motion of said thermal transfer ribbon relative to said foil while said energizable printing means are heated during said ink transfer operation and moving said thermal transfer ribbon relative to said energizable printing means in the reverse direction relative to said energizable printing means while said energizable printing means are not heating so as to utilize an unused part of said thermal transfer ribbon in a subsequent ink transfer operation.

11. The thermal printer according to claim 1, wherein said means for moving said foil and said energizable printing means relative to one another causing said foil to move intermittently and maintaining said foil stationary during said ink transfer operation and causing said energizable printing means to move relative to said stationary foil and said means for moving said thermal transfer ribbon relative to said energizable printing means moving said thermal transfer ribbon relative to said energizable printing means at a reduced speed as compared to said specific speed of said foil relative to said energizable printing means and consequently moving said thermal transfer ribbon relative to said foil for causing said ink of said thermal transfer ribbon to be transferred at said specific locations to said foil at specific areas thereof constituting said printing so as to smear said ink of said thermal transfer ribbon at said specific locations onto said foil through said motion of said thermal transfer ribbon relative to said foil while said energizable printing means are heated during said ink transfer operation and moving said thermal transfer ribbon in the reverse direction relative to said energizable printing means while said energizable printing means are not heated so as to utilize an unused part of said thermal transfer ribbon in a subsequent ink transfer operation.

12. The thermal printer according to claim 1, wherein said energizable printing means being controlled so as to perform said ink transfer operation utilizing a part of said thermal transfer ribbon not previously used in a preceding ink transfer operation.

13. The thermal printer according to claim 12, wherein said energizable printing means being controlled so as to perform said ink transfer operation utilizing said part of said thermal transfer ribbon used for said specific ink transfer operation being positioned at least partly transversly offset relative to that part of said thermal transfer ribbon used in a preceding ink transfer operation.

14. A thermal printer for producing a printing on the surface of a foil in an ink transfer operation, comprising:

means for supplying said foil to said thermal printer, a thermal transfer ribbon including an ink which is transferable in said ink transfer operation at specific locations of said thermal transfer ribbon by heating said specific locations to an elevated temperature causing said ink to be fluid, means for arranging said thermal transfer ribbon in facial contact with said surface of said foil, energizable printing means for heating said specific locations of said thermal transfer ribbon to said elevated temperature in said ink transfer operation, means for energizing said energizable printing means, means for moving said energizable printing means towards said foil so as to sandwich said thermal transfer ribbon therebetween in a constrained state and for moving said energizable printing means away from said foil, said means for moving said energizable printing means towards and away from said foil including an actuator means, means for moving said foil and said energizable printing means relative to one another at a specific speed while pressing said energizable printing means and said foil together and while energizing said energizable printing means, and means for moving said thermal transfer ribbon relative to said energizable printing means for causing said ink of said thermal transfer ribbon to be transferred at said specific locations to said foil at specific areas thereof constituting said printing, said thermal transfer ribbon being delivered from a delivery reel, being moved past said energizable printing means and being received by a take-up reel, said means for moving said thermal transfer ribbon relative to said energizable printing means including a roller driven by a motor, said delivery reel and said take-up reel being constituted by hollow plastics or cardboard cores or bobbins received on respective reel cores, each of said reel cores having a cylindrical or conical shaft defining an outer surface in which outer surface a pair of planar and non-radially extending support surfaces are provided for supporting in a respective support surface a rotatably and tiltably journalled, circular plate extending beyond said outer surface of said cylindrical or conical shaft.

15. The thermal printer according to claim 14, wherein each of said circular plates being journalled on a spacer and fixated relative to its respective support surface by means of a through-going bolt extending through a cent[]al core of said circular plate.

* * * * *